US012637800B2

(12) United States Patent
Yoon et al.

(10) Patent No.: US 12,637,800 B2
(45) Date of Patent: May 26, 2026

(54) LAUNDRY TREATING APPARATUS

(71) Applicant: LG Electronics Inc., Seoul (KR)

(72) Inventors: Juhan Yoon, Seoul (KR); Jinhyouk Shin, Seoul (KR); Manseok Lee, Seoul (KR); Jeongwoong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 876 days.

(21) Appl. No.: 17/666,165

(22) Filed: Feb. 7, 2022

(65) Prior Publication Data

US 2022/0251765 A1 Aug. 11, 2022

(30) Foreign Application Priority Data

Feb. 8, 2021 (KR) ..... 10-2021-0017567

(51) Int. Cl.
*D06F 58/24* (2006.01)
*D06F 58/08* (2006.01)

(52) U.S. Cl.
CPC ..... *D06F 58/24* (2013.01); *D06F 58/08* (2013.01)

(58) Field of Classification Search
CPC ..... D06F 58/24
See application file for complete search history.

(56) References Cited

U.S. PATENT DOCUMENTS

2005/0132593 A1 6/2005 Doh et al.
2012/0246960 A1 10/2012 Lee et al.
2013/0031798 A1 2/2013 Bea et al.
2013/0305553 A1 11/2013 Heo et al.
2017/0002508 A1 1/2017 Nam et al.
2017/0191215 A1 7/2017 Yoon et al.
2018/0148885 A1* 5/2018 Kitayama ..... D06F 58/20
2018/0171537 A1* 6/2018 Lee ..... B08B 3/14
(Continued)

FOREIGN PATENT DOCUMENTS

CN 1724795 1/2006
CN 101078172 11/2007
(Continued)

OTHER PUBLICATIONS

Extended European Search Report in European Appln. No. 22155554.3, dated Jul. 6, 2022, 9 pages.
(Continued)

*Primary Examiner* — David J Laux
(74) *Attorney, Agent, or Firm* — Fish & Richardson P.C.

(57) ABSTRACT

A laundry treating apparatus includes a cabinet, a drum for accommodating laundry, a base disposed below the drum, a motor for providing power to rotate the drum, and a heat exchange unit including a first heat exchanger, a second heat exchanger, and a compressor. The base includes a circulation flow path part through which air in the drum circulates, a compressor installation part spaced apart from the circulation flow path part and configured to allow the compressor to be seated thereon, and a water collection part spaced apart from the compressor installation part and configured to collect water condensed in the circulation flow path part. The motor is disposed behind the drum so as to be separate from and spaced apart from the base. The water collection part is disposed parallel to the compressor installation part in the direction in which the circulation flow path part extends.

19 Claims, 24 Drawing Sheets

(56) References Cited

U.S. PATENT DOCUMENTS

| | | | | |
|---|---|---|---|---|
| 2019/0323164 | A1* | 10/2019 | Kim | D06F 58/30 |
| 2021/0262149 | A1* | 8/2021 | Lee | D06F 58/206 |

FOREIGN PATENT DOCUMENTS

| | | | | |
|---|---|---|---|---|
| EP | 2775028 | | | 9/2014 |
| EP | 2549008 | | | 6/2015 |
| EP | 3026168 | | | 6/2016 |
| EP | 3767027 | | | 1/2021 |
| JP | 2009247600 | | | 10/2009 |
| JP | 2009247600 | A | * | 10/2009 |
| JP | 2010-035894 | | | 2/2010 |
| KR | 20170016750 | | | 2/2017 |
| KR | 20170024265 | | | 3/2017 |
| KR | 10-2019-0128468 | | | 11/2019 |
| KR | 20190128484 | | | 11/2019 |
| KR | 20200001729 | | | 1/2020 |
| KR | 10-2020-0065931 | A | | 6/2020 |
| KR | 10-2021-0010143 | | | 1/2021 |
| WO | WO 2016204414 | | | 12/2016 |
| WO | WO 2020214004 | | | 10/2020 |

OTHER PUBLICATIONS

International Search Report and Written Opinion in International Application No. PCT/KR2022/001841, dated May 30, 2022, 10 pages.

Office Action in Chinese Appln. No. 202210118019.0, mailed on Apr. 8, 2023, 15 pages (with English translation).

Office Action in European Appln. No. 22155554.3, mailed on Apr. 3, 2025, 5 pages.

* cited by examiner

LAUNDRY TREATING APPARATUS

CROSS-REFERENCE TO RELATED APPLICATION

This application claims the benefit of Korean Patent Application No. 10-2021-0017567, filed on Feb. 8, 2021, which is hereby incorporated by reference as if fully set forth herein.

TECHNICAL FIELD

The present disclosure relates to a laundry treating apparatus, and more particularly to a laundry treating apparatus including a driving unit directly connected to a drum configured to accommodate laundry so as to rotate the drum.

BACKGROUND

Laundry treating apparatuses are apparatuses configured to remove dust or foreign substances from laundry by applying physical force thereto, and include washers, dryers, clothing refreshers (or clothing stylers), etc.

The washers are configured to perform a washing cycle in which foreign substances are separated and removed from laundry by supplying water and detergent to the laundry.

The dryers are classified into an exhaust-type dryer and a circulation-type dryer, and both dryers are configured in common to perform a drying cycle in which moisture is removed from laundry by producing hot air having a high temperature using a heater and exposing the laundry to the hot air.

Recently, a dryer is configured to intensively perform the drying cycle by omitting components for supplying water to laundry or draining water and omitting a tub provided in a cabinet to receive water. Thereby, the internal structure of the dryer may be simplified, and drying efficiency may be improved by directly supplying hot air to a drum accommodating the laundry.

Such a dryer may include a drum configured to accommodate laundry, a hot air supplier configured to supply hot air to the drum, and a driving unit configured to rotate the drum. The dryer may dry the laundry accommodated in the drum by supplying hot air to the inside of the drum, and may uniformly expose the surface of the laundry to hot air by rotating the drum. Consequently, drying of the laundry may be completed through uniform contact of all surfaces of the laundry with hot air.

In order to rotate the drum, the driving unit needs to be fixed to the inside of the cabinet. Further, when the driving unit is provided to rotate a rotating shaft coupled to the drum, the driving unit needs to be provided parallel to the rotating shaft. However, the dryer does not include a tub fixed to the inside of the cabinet, and thus it is difficult to fix the driving unit to the tub in the same manner as the washer.

In order to overcome this drawback, dryers configured such that a driving unit is fixed to the rear surface of a cabinet have appeared (refer to Japanese Patent Laid-Open Publication No. S55-081914A, Japanese Patent Laid-Open Publication No. S55-115455A, Japanese Patent Laid-Open Publication No. S57-063724A, and Japanese Patent Laid-Open Publication No. S57-124674A).

FIG. 1 shows the structure of a conventional dryer configured such that a driving unit is coupled to the rear surface of a cabinet.

The above dryer may include a cabinet 1 forming the external appearance thereof, a drum 2 rotatably provided inside the cabinet 1 so as to accommodate laundry, and a driving unit 3 provided so as to rotate the drum 2.

The driving unit 3 may be disposed on the rear surface of the drum 2 so as to rotate the drum 2, and may be fixedly coupled to a rear panel 11 forming the rear surface of the cabinet 1. Therefore, the driving unit 3 may be fixed to the cabinet 1, and may thus rotate the drum 2.

The driving units 3 of the above-described conventional dryers may include in common a stator 31 fixed to the rear panel 11, a rotor 32 configured to be rotated by the stator 31, and a rotating shaft 33 coupled to the rotor 32 so as to rotate the drum 2, and may further include a speed reducer 37 provided to increase torque while reducing the RPM of the rotating shaft 33 so as to rotate the drum 2.

Further, the conventional dryers may further include in common a fixing unit 4 for fixing the driving unit 3 to the rear panel 11. The fixing unit 4 may include at least one of a first fixing part 41 for fixing the stator 31 to the rear panel 111 or a second fixing part 42 for fixing the rotating shaft 33 to the rear panel 11. Therefore, in the conventional dryers, the driving unit 3 is disposed parallel to the rotating shaft 33 coupled to the drum 2, and may thus stably rotate the drum 2.

However, the rear panel 11 of the cabinet is implemented as a thin steel plate, and is thus easily deformed or vibrated even by a considerably small external force. Further, the rear panel 11 receives not only the load of the driving unit 3 but also the load of the drum 2 through the rotating shaft 33, and maintaining the shape of the rear panel 11 may thus be difficult.

Further, when laundry is imbalanced in the drum 2 or repeatedly falls in the drum 2 during the process of rotating the drum 2, external force is repeatedly transmitted to the rear panel 11, and thus the rear panel 11 may vibrate.

When the rear panel 11 is even temporarily bent or deformed due to vibration or external force transmitted thereto, the rotating shaft 33 connecting the driving unit 3 to the drum 2 may be distorted. Accordingly, the driving unit 3 may generate unnecessary vibration or noise and, in severe cases, the rotating shaft 33 may be damaged. Furthermore, bending or deformation of the rear panel 11 may generate unnecessary noise.

Furthermore, when the rear panel 11 vibrates, the gap between the rotor 32 and the stator 31 temporarily changes in size, which causes the rotor 32 and the stator 31 to collide with each other or to generate unnecessary vibration and noise.

Moreover, when the driving unit 3 further includes the speed reducer 37, the rotating shaft 33 coupled to the speed reducer 37 and a speed reduction shaft 33*a* connecting the speed reducer 37 to the drum 2 are provided separately from each other. Here, since the speed reducer 37 is supported by the rear panel 11 via the stator 31 or the rotating shaft 33, when the rear panel 11 is deformed even slightly, the speed reduction shaft 33*a* and the rotating shaft 33 may be distorted or misaligned from each other.

In other words, variation in the position of the speed reduction shaft 33*a*, which is connected to the drum 2, may be less than that of the rotating shaft 33, which is coupled to the driving unit 3, due to the load of the drum 2. Therefore, when the rear panel 11 is temporarily bent or deformed, the orientations of the rotating shaft 33 and the speed reduction shaft 33*a* are different, and thus the rotating shaft 33 and the speed reduction shaft 33*a* are misaligned from each other.

Therefore, in the above conventional laundry treating apparatus, whenever the driving unit 3 operates, the rotating shaft 33 and the speed reduction shaft 33*a* are misaligned from each other, and thus the reliability of the speed reducer 37 may not be ensured, and the speed reducer 37 may be damaged.

Accordingly, the above-described dryer has been disclosed in a patent document, but may not be launched as an actual product.

Further, such a conventional dryer does not propose a flow path through which air in the drum flows to the base, which is located below the drum, and does not explicitly or implicitly disclose a structure for dealing with water condensed in the flow path. Therefore, the conventional dryer does not suggest how to change the structure of the base when the position of the driving unit is changed.

Another conventional dryer that is on the market is configured such that a driving unit 3 is fixed to the bottom surface of a cabinet 1 (refer to Korean Patent Laid-Open Publication No. 10-2019-0121656).

FIGS. 2A and 2B show a dryer in which a driving unit 3 is fixed to the bottom surface of a cabinet 1 or to a base.

The dryer may include a cabinet 1 and a drum 2, and may further include a circulation flow path 5 for circulating air in the drum 2 to the outside and a heat pump 6 accommodated in the circulation flow path 5 to condense and reheat air. Water condensed by the heat pump 6 may be collected in a storage tank 9 using a pump 8.

Even when the driving unit 3 vibrates or external force is temporarily transmitted thereto via the driving unit 3, the bottom surface 12 of the cabinet 1 may be prevented from being deformed or tilted.

Therefore, the conventional dryer is provided such that the driving unit 3 is fixed to the bottom surface 12 of the cabinet 1 or to the base, which is fixed to the bottom surface of the cabinet 1 below the drum 2. In the dryer, the driving unit 3 is not disposed parallel to the axis of rotation of the drum 2, and thus the drum 2 is rotated using an additional component.

Specifically, the driving unit 3 may include a motor 34 fixed to the bottom of the cabinet 1, a rotating shaft 37 configured to be rotated by the motor 34, a pulley 35 configured to be rotated by the rotating shaft 37, and a belt 36 provided to connect the outer circumferential surface of the drum 2 to the outer circumferential surface of the pulley 35.

Accordingly, when the motor 34 rotates the rotating shaft 37, the pulley 35 may rotate the belt 36, and the belt 36 may rotate the drum 2. Here, since the diameter of the pulley 35 is much smaller than the diameter of the drum 2, the dryer may omit a speed reducer.

However, in the above dryer, since the diameter of the pulley 35 is much smaller than the diameter of the drum 2, when the motor 34 rapidly rotates, the belt 36 may slip on the drum 2 or the pulley 35. Therefore, the dryer has problems in that the rotational acceleration of the motor 34 must be limited to a designated level or less and in that the motor 34 must be accelerated or decelerated slowly in order to prevent the belt 36 from slipping when the drum 2 is rotated.

Therefore, the conventional dryer may not be capable of rapidly changing the rotating direction of the drum 2, thus failing to control rotation of the drum 2, or may not be capable of changing the rotating direction of the drum 2. Accordingly, the dryer is not capable of controlling the rotating direction or the rotational speed of the drum 2 as intended during a drying cycle, and thus is not capable of maximizing drying efficiency.

Referring to FIG. 2B, the base 5 of the conventional dryer includes a motor installation part 531, on which that the motor 34 is installed, a circulation flow path part 520, through which air in the drum flows, a compressor installation part 532, which is provided outside the circulation flow path part 520 and on which a compressor is installed, and a water collection part 534, which collects water condensed in the circulation flow path part 520. An evaporator-fixing part 524 for fixing an evaporator and a condenser-fixing part 523 for fixing a condenser may be provided in the circulation flow path part 520. Water condensed in the evaporator-fixing part 524 may be collected in the water collection part 534 through a communication hole 551.

Further, the compressor installation part 532 needs to be installed as close to the circulation flow path part 520 as possible in order to reduce loss of heat of a refrigerant. Further, the water collection part 534 needs to be installed as close to the circulation flow path part 520 as possible in order to receive the condensed water.

Here, the motor 34 is provided to have a considerable volume so as to generate power to rotate the drum, and the range of possible installation positions for the motor 34 is limited due to the requirement to rotate the drum using the belt. Therefore, the motor installation part 531 needs to occupy at least a specific area of the base 5 at one side of the circulation flow path part 520, and disposition of the motor installation part 531 needs to be determined prior to disposition of the compressor installation part 532 and the water collection part 534.

Therefore, the compressor installation part 532 and the water collection part 534 need to be installed so as to avoid the motor installation part 531, and need to be installed in a region of the base 5 other than the circulation flow path part 520 and the motor installation part 531.

Because the compressor 61 also occupies a considerable volume, the compressor installation part 532 and the water collection part 534 may not be disposed in the direction in which the circulation flow path part 520 extends (e.g. a forward-backward direction).

Here, the water collection part 534 needs to be disposed immediately adjacent to the circulation flow path part 520, and thus the water collection part 534 needs to be disposed between the compressor installation part 532 and the circulation flow path part 520.

Consequently, it is not possible to install a water collection part 534 having a specific volume or more, and thus the water collection part 534 is not capable of collecting a sufficient amount of condensed water.

SUMMARY

The present disclosure has been made in view of the above problems, and an object of the present disclosure is to provide a laundry treating apparatus in which a driving unit for rotating a drum is disposed at a position spaced apart from a base, which is disposed below the drum, thus providing a larger space for installation of parts in the base.

Another object of the present disclosure is to provide a laundry treating apparatus capable of effectively using the remainder of a space in a base other than a circulation flow path part for circulating air in a drum.

Another object of the present disclosure is to provide a laundry treating apparatus capable of securing the volume of a water collection part, which collects condensed water discharged from a drum, in a base without being restricted by a heat pump system or a driving unit.

Another object of the present disclosure is to provide a laundry treating apparatus in which a water collection part and a compressor of a heat pump system are disposed parallel to each other beside a circulation flow path part in a flow direction.

Another object of the present disclosure is to provide a laundry treating apparatus in which a compressor of a heat pump system is installed closer to the rear side of a cabinet than to the front side of the cabinet, thus reducing leakage of noise to outside.

Another object of the present disclosure is to provide a laundry treating apparatus capable of increasing the amount of space for storing condensed water generated during a drying cycle, thus increasing the volume of the condensed water that can be accommodated.

Another object of the present disclosure is to provide a laundry treating apparatus capable of increasing the amount of space for storing condensed water generated during a drying cycle, thus reducing the frequency with which a user removes the stored condensed water.

Another object of the present disclosure is to provide a laundry treating apparatus in which a compressor installation part, in which a compressor is installed, and a water collection part, in which condensed water is stored, are disposed in the forward-backward direction of the laundry treating apparatus, thus increasing the amount of space for accommodating the water collection part.

In order to accomplish the above and other objects, a driving unit for rotating a drum may be separate from and spaced apart from a base, which is disposed below the drum in order to form a circulation flow path or to provide a space for collecting condensed water.

That is, since the driving unit is completely separate from the base, the area of a water collection part for collecting condensed water may be increased in the base.

Accordingly, the water collection part may be disposed parallel to a compressor, which supplies a refrigerant for exchange of heat with air to the inside of the circulation flow path, in the direction in which the circulation flow path extends.

The water collection part may be disposed between a cabinet and a circulation flow path part. Specifically, the water collection part may be expanded such that one surface thereof faces the cabinet and the other surface thereof faces the circulation flow path part.

The driving unit may be provided so as to face the drum, and may be disposed further upwards than the water collection part for collecting water, a compressor installation part in which the compressor is installed, and the circulation flow path part.

Accordingly, the water collection part may overlap the compressor installation part, which provides a space for installation of the compressor in the base, in the forward-backward direction, and may not overlap the compressor installation part in the width direction.

The base may secure a space for installation of a control panel therein. When the control panel is mounted in the base so as to face side panels of the cabinet, the water collection part may be disposed between the control panel and the circulation flow path part.

The water collection part may be disposed so as to overlap an evaporator of a heat exchanger in the leftward-rightward direction, thereby minimizing the amount of residual water. The water collection part may be disposed so as not to overlap a condenser in the leftward-rightward direction.

The width of the circulation flow path part may be set to be greater than half the width of the base. The width of the water collection part may be set to be greater than the width or diameter of the compressor installation part.

The length of the water collection part in the forward-backward direction or the length of the water collection part in the direction in which the circulation flow path part extends may be set to be longer than the length of the compressor installation part.

The water collection part may be provided in the base so as to be expanded such that one surface thereof faces an inflow duct of the circulation flow path part and the other surface thereof faces the compressor installation part.

Further, the water collection part may be disposed between an opening in the cabinet and the compressor.

Accordingly, both the water collection part and the compressor installation part may be further forwards than the driving unit.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
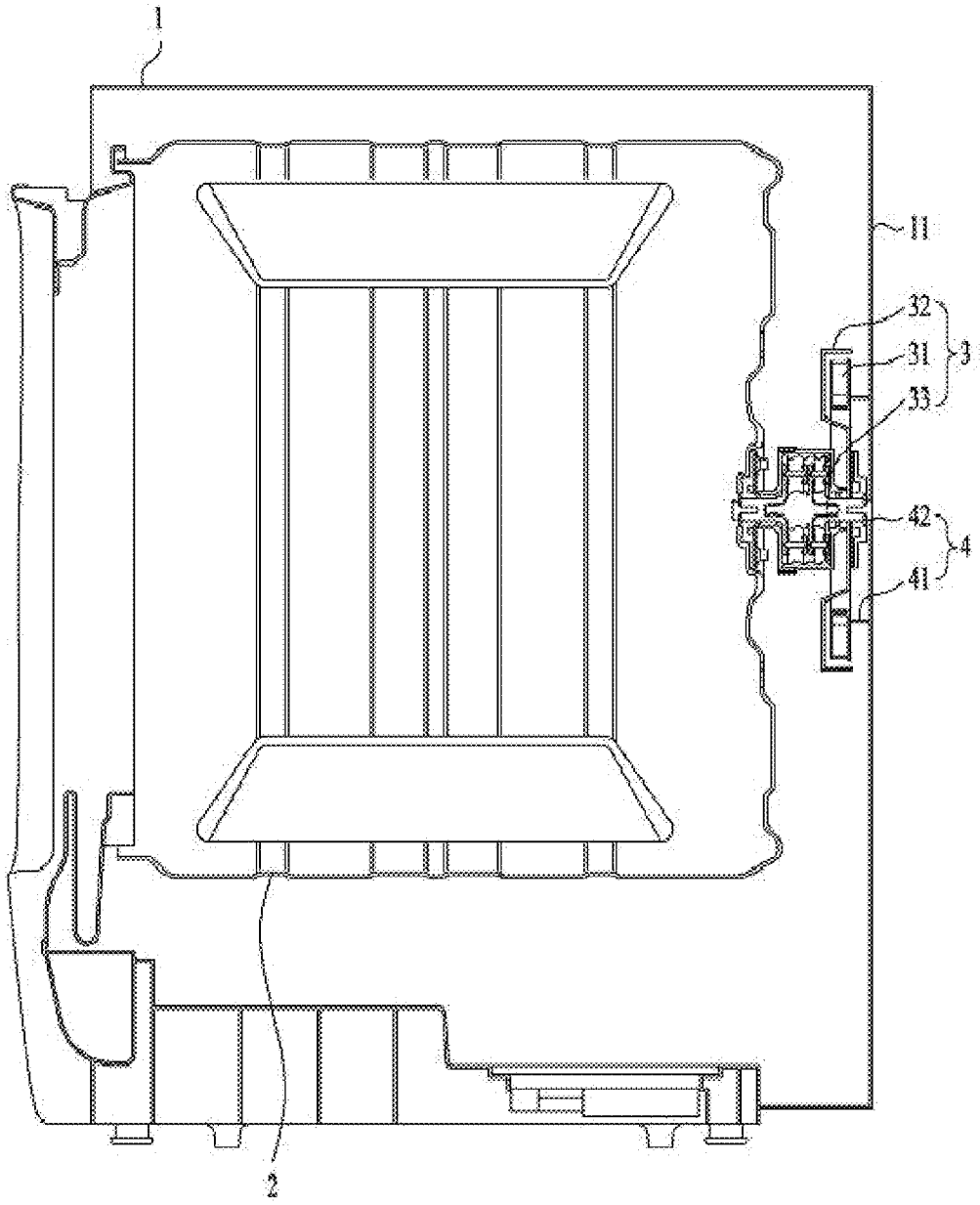
FIG. 1 is a view illustrating the structure of one exemplary conventional dryer.
Figure 2A:
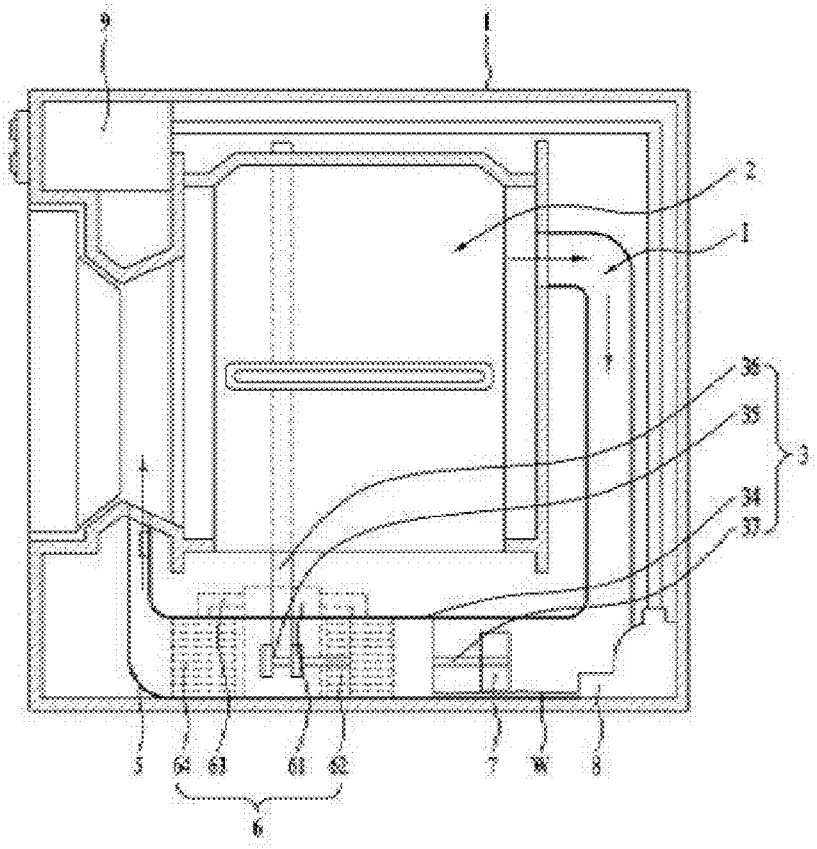
FIGS. 2A and 2B are views illustrating the structure of another exemplary conventional dryer.
Figure 2B:
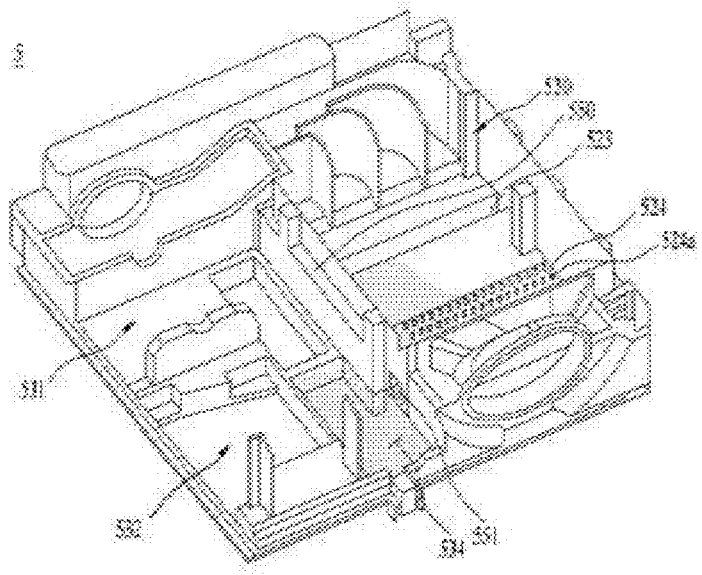

Reference will now be made in detail to exemplary embodiments of the present disclosure, examples of which are illustrated in the accompanying drawings, to make the description of the present disclosure thorough and to fully convey the scope of the present disclosure to those skilled in the art.

However, the present disclosure is not limited to aspects disclosed herein and may be implemented in various different forms. In the drawings, in order to clearly describe the present disclosure, descriptions of elements which are not related to the present disclosure are omitted, and the same or similar elements are denoted by the same reference numerals even when they are depicted in different drawings.

In the following description of the embodiments of the present disclosure, redundant description of the same elements will be omitted.

When an element is referred to as being "engaged with", "connected to", or "coupled to" another element, it may be directly engaged with, connected to or coupled to the other element, or intervening elements may be present. In contrast, when an element is referred to as being "directly engaged with" "directly connected to", or "directly coupled to" another element, there may be no intervening elements present.

The terminology used herein is for the purpose of describing particular embodiments only and is not intended to be limiting.

As used herein, singular forms may be intended to include plural forms as well, unless the context clearly indicates otherwise.

Further, in the following description of the embodiments of the present disclosure, the terms "comprising," "including," or "having" are inclusive and therefore specify the presence of stated features, integers, steps, operations, elements, components, or combinations thereof, but do not preclude the presence or addition of one or more other features, integers, steps, operations, elements, components, or combinations thereof.

Further, as used herein, the term "and/or" includes any and all combinations of one or more of the associated listed items. In the following description of the embodiments of the present disclosure, "A or B" may include "A", "B" or "both A and B".

Figure 3:
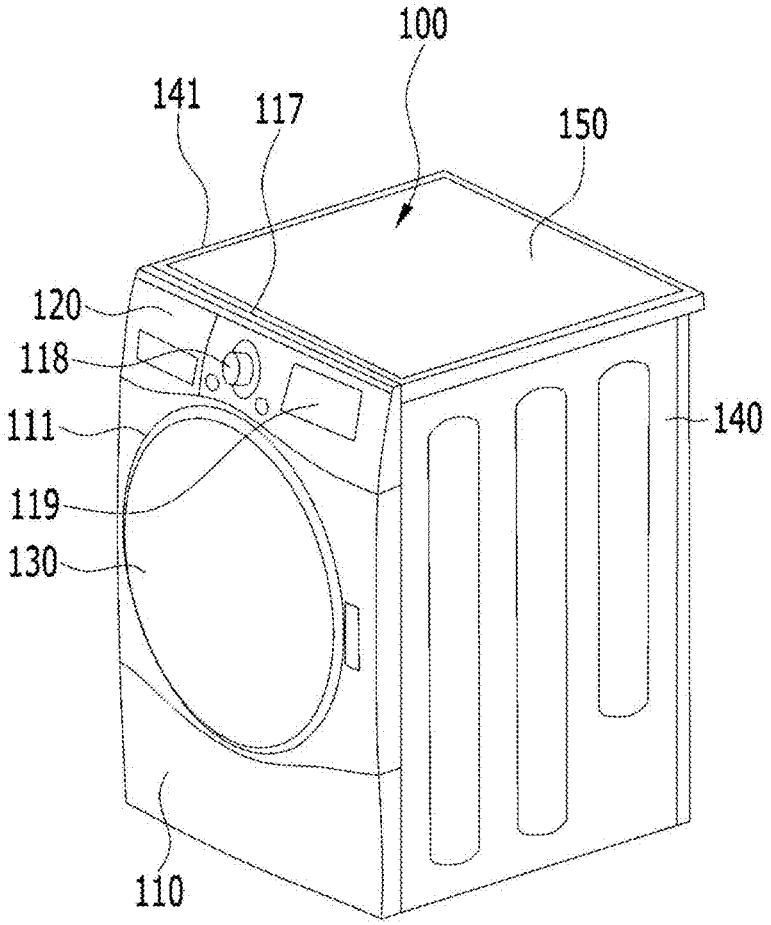
FIG. 3 is a view illustrating a laundry treating apparatus according to one embodiment of the present disclosure.

FIG. 3 illustrates the external appearance of a laundry treating apparatus according to one embodiment of the present disclosure.

The laundry treating apparatus according to one embodiment of the present disclosure may include a cabinet 100 forming the external appearance of the laundry treating apparatus.

The cabinet 100 may include a front panel 110 forming the front surface of the laundry treating apparatus, an upper panel 150 forming the upper surface of the laundry treating apparatus, and side panels 140 forming the side surfaces of the laundry treating apparatus. The side panels 140 may include a left panel 141 forming the left surface of the laundry treating apparatus. The front panel 110 may be provided with an opening 111 formed therein to communicate with the inside of the cabinet 100 and a door 130 rotatably coupled to the cabinet 100 so as to open and close the opening 111.

A control panel 117 may be installed on the front panel 110. The control panel 117 may include an input unit 118 for receiving control commands from a user and a display 119 for outputting information, such as control commands selectable by the user. The control commands may include a drying course for performing the drying cycle or drying options. A control box (refer to FIG. 10) for controlling the inner elements of the laundry treating apparatus so as to perform the control command input through the input unit 118 may be installed in the cabinet 100. The control box may be connected to the inner elements of the laundry treating apparatus, and may thus control the corresponding elements so as to perform the input control command.

The input unit 118 may include a power supply request unit for requesting the supply of power to the laundry treating apparatus, a course input unit for allowing the user to select a desired course from among a plurality of courses, and an execution request unit for requesting commencement of the course selected by the user.

The display 119 may include at least one of a display panel for outputting text and graphics or a speaker for outputting a voice signal and sound.

Further, the laundry treating apparatus according to the present disclosure may include a water storage tank 120 for separately storing moisture generated during a process of drying the laundry. The water storage tank 120 may include a handle provided on one side of the front panel 110 so as to withdraw the water storage tank 120 to the outside therethrough. The water storage tank 120 may be provided to collect condensed water generated during the drying cycle. Therefore, the user may withdraw the water storage tank 120 from the cabinet 100, may remove the condensed water, and may then insert the water storage tank 120 back into the cabinet 100. Thereby, the laundry treating apparatus according to the present disclosure may be installed even in a place in which there is no drain.

The water storage tank 120 may be disposed above the door 130. Therefore, when the user withdraws the water storage tank 120 from the front panel 110, the user may be required to stoop relatively little, and thus user convenience may be improved.

Figure 4:
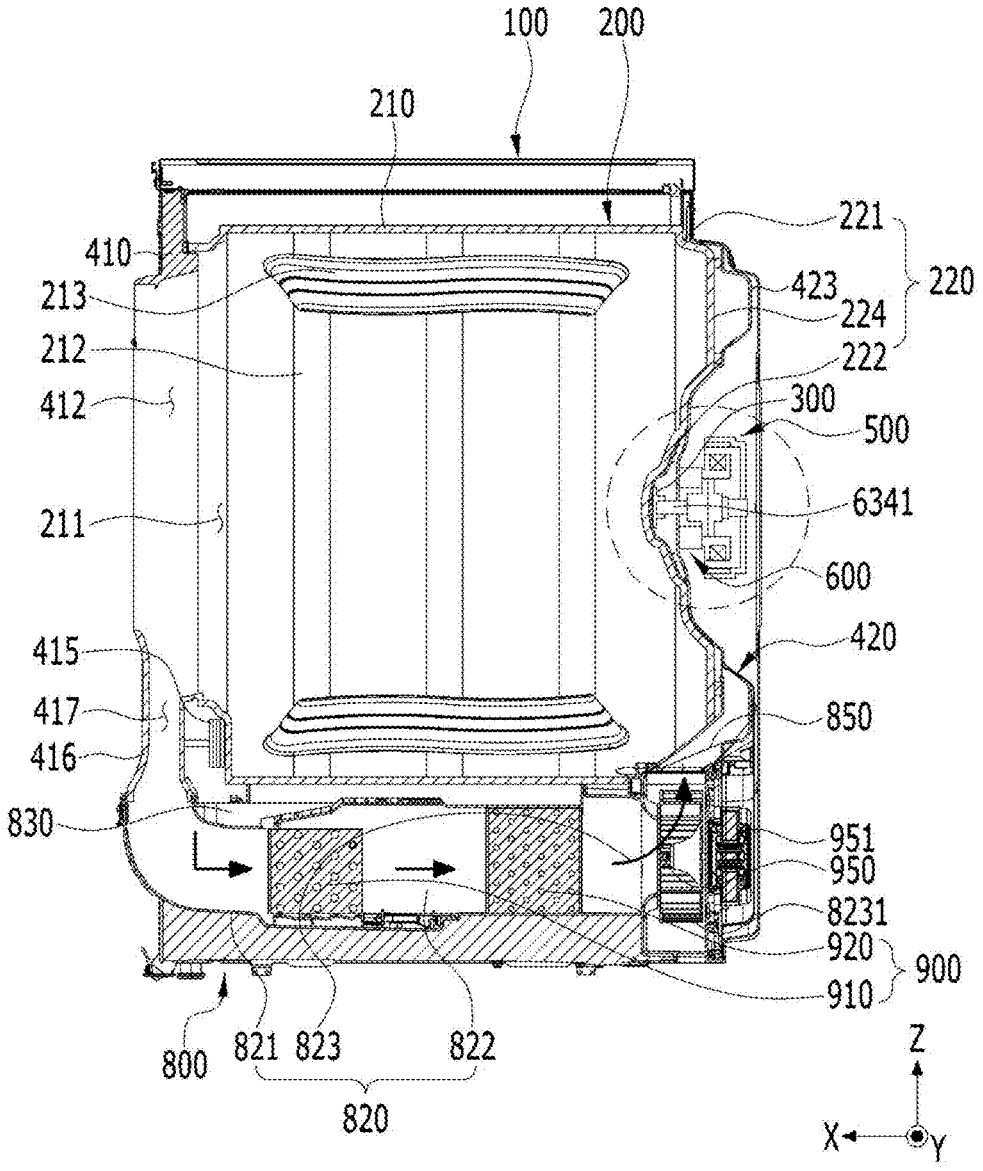
FIG. 4 is a view illustrating the inside of the laundry treating apparatus according to one embodiment of the present disclosure.

FIG. 4 schematically illustrates the inside of the laundry treating apparatus according to the present disclosure. The laundry treating apparatus according to the present disclosure may include a drum 200 provided in the cabinet 100 so as to accommodate laundry, a driving unit for rotating the drum 200, a heat exchange unit 900 provided to supply hot air to the drum 200, and a base 800 provided with a circulation flow path part 820 formed therein. The circulation flow path part 820 is provided to communicate with the drum 200. Air discharged from the drum 200 may be supplied to the circulation flow path part 820. Further, air discharged from the circulation flow path part 820 may be supplied again to the drum 200.

The driving unit may include a motor 500 for providing power to rotate the drum 200. The driving unit may be directly connected to the drum 200 so as to rotate the drum 200. For example, the driving unit may be provided in a direct-drive unit (DD) type. Therefore, the driving unit may directly rotate the drum 200 without a power transmission medium, such as a belt or a pulley, thus controlling the rotation direction or the rotational speed of the drum 200.

The motor 500 may rotate at a high RPM. For example, the motor 500 may rotate at a much higher RPM than the RPM at which the drum 200 is capable of rotating in the state in which laundry in the drum 200 is adhered to the inner wall of the drum 200.

However, when the drum 200 continuously rotates in the state in which the laundry in the drum 200 is adhered to the inner wall of the drum 200, the portions of the laundry that are adhered to the inner wall of the drum 200 are not exposed to hot air, and thus drying efficiency may be reduced.

When a rotor 520 is rotated at a low RPM in order to allow the laundry in the drum 200 to be tumbled or agitated without being adhered to the inner wall of the drum 200, output or torque generated by the driving unit is not properly used.

Therefore, the driving unit of the laundry treating apparatus according to the present disclosure may further include a speed reducer 600 for increasing torque while reducing the RPM so as to utilize the maximum output of the motor 500.

Further, the driving unit may include a drum rotating shaft 6341 connected to the drum 200 so as to rotate the drum 200.

The drum 200 may be provided in a cylindrical shape so as to accommodate laundry. Further, unlike a drum used for washing, in the case of a drum 200 used only for drying, it is not necessary to supply water to the drum 200 or to discharge water in a condensed liquid state from the drum 200 to the outside of the drum 200. Therefore, it is not necessary to form through-holes in the circumferential surface of the drum 200. That is, the drum 200 used only for drying may be formed differently from a drum used for washing.

The drum 200 may be formed in an integrated cylindrical shape, or may be configured such that a drum body 210, having a circumferential surface, and a rear drum surface 220, forming the rear surface of the drum 200, are coupled to each other.

An inlet 211 through which laundry enters or exits the drum 200 may be formed in the front surface of the drum body 210. The driving unit for rotating the drum 200 may be connected to the rear drum surface 220. The drum body 210 and the rear drum surface 220 may be coupled to each other by fastening members, such as bolts, but the present disclosure is not limited thereto. The drum body 210 and the rear drum surface 220 may be coupled to each other using various methods, so long as the drum body 210 and the rear drum surface 220 are coupled to each other so as to be rotatable together.

A lift 213 for moving laundry in the drum 200 upwards so as to toss the laundry according to rotation of the drum 200 may be provided in the drum body 210. When the drum 200 rotates, the laundry accommodated therein may be repeatedly lifted and dropped by the lift 213. Accordingly, the laundry accommodated in the drum 200 may evenly contact hot air while being repeatedly lifted and dropped. As a result, drying efficiency may be increased, and a drying time may be shortened.

A reinforcing bead 212 may be formed on the circumferential surface of the drum body 210. The reinforcing bead 212 may be provided so as to be recessed from or protrude from the inner or outer circumferential surface of the drum 200. The reinforcing bead 212 may be provided in a plural number, and the plurality of reinforcing beads 212 may be spaced apart from each other. The reinforcing beads 212 may be provided in a designated pattern on the inner or outer circumferential surface of the drum 200.

The reinforcing beads 212 may increase the rigidity of the drum body 210. Therefore, even when a large amount of laundry is accommodated in the drum body 210 or rotational force is suddenly transmitted to the drum body 210 through the driving unit, the drum body 210 may be prevented from being twisted. Further, the reinforcing beads 212 may increase the distance between the inner circumferential surface of the drum body 210 and the laundry compared to the case in which the circumferential surface of the drum body 210 is flat, thereby allowing hot air supplied to the drum 200 to more effectively flow to a gap between the laundry and the drum 200. The reinforcing beads 212 may increase the durability of the drum 200, and may increase the drying efficiency of the laundry treating apparatus.

In general, in a DD-type washer, a driving unit may be fixedly coupled to a tub accommodating a drum, and the drum may be coupled to the driving unit so as to be supported by the tub. However, the laundry treating apparatus according to the present disclosure is configured to intensively perform the drying cycle, and thus omits a tub fixed to the cabinet 100 so as to accommodate the drum 200.

Therefore, the laundry treating apparatus according to the present disclosure may further include a support unit 400, provided to support or fix the drum 200 or the driving unit to the inside of the cabinet 100.

The support unit 400 may include a front plate 410 disposed in front of the drum 200 and a rear plate 420 disposed behind the drum 200. The front plate 410 and the rear plate 420 may be provided in a plate shape, and may be disposed so as to face the front side and the rear side of the drum 200. The distance between the front plate 410 and the rear plate 420 may be set to be equal to or greater than the length of the drum 200. The front plate 410 and the rear plate 420 may be fixedly supported by the bottom surface of the cabinet 100 or the base 800.

The front plate 410 may be disposed between the front panel forming the front surface of the cabinet and the drum 200. Further, an inlet communication hole 412 may be formed in the front plate 410 so as to communicate with the inlet 211. Since the inlet communication hole 412 is formed in the front plate 410, the front surface of the drum 200 may be supported, and laundry may be put into or withdrawn from the drum 200.

The front plate 410 may include a duct connector 416 provided under the inlet communication hole 412. The duct connector 416 may form the lower surface of the front plate 410.

The front plate 410 may include a duct communication hole 417 formed through the duct connector 416. The duct communication hole 417 may be provided in a hollow shape, and may guide air discharged from the inlet 211 of the drum 200 to a region under the drum 200. Further, the duct communication hole 417 may guide air discharged from the drum 200 to the circulation flow path part 820 located under the drum 200.

A filter (not shown) may be installed in the duct communication hole 417 so as to filter out lint or large particulate foreign substances generated from laundry. The filter may filter air discharged from the drum 200, and may thus prevent accumulation of foreign substances in the laundry treating apparatus and hindering of air circulation due to the accumulated foreign substances.

Since the inlet 211 is disposed at the front part of the laundry treating apparatus, it is desirable for the driving unit to be installed on the rear plate 420 rather than the front plate 410. The driving unit may be mounted on the rear plate 420 so as to be supported thereby. Therefore, the driving unit may rotate the drum 200 in the state in which the position of the driving unit is stably fixed by the rear plate 420.

At least one of the front plate 410 or the rear plate 420 may rotatably support the drum 200. At least one of the front plate 410 or the rear plate 420 may rotatably accommodate the front end or the rear end of the drum 200.

For example, the front part of the drum 200 may be rotatably supported by the front plate 410, and the rear part of the drum 200 may be spaced apart from the rear plate 420 so as to be connected to the motor 500, which is mounted on the rear plate 420, and may thus be indirectly supported by the rear plate 420. Therefore, a contact or friction area between the drum 200 and the support unit 400 may be minimized, and generation of unnecessary noise or vibration may be prevented.

Of course, the drum 200 may be provided so as to be rotatably supported by both the front plate 410 and the rear plate 420.

One or more support wheels 415 for supporting the front part of the drum 200 may be provided at the lower part of the front plate 410. The support wheels 415 may be rotatably provided on the rear surface of the front plate 410. The support wheels 415 may be rotated while contacting the lower part of the drum 200.

When the drum 200 is rotated by the driving unit, the drum 200 may be supported by the drum rotating shaft 6341, which is connected to the rear part of the drum 200. When laundry is accommodated in the drum 200, the magnitude of the load applied to the drum rotating shaft 6341 may be increased due to the laundry. Therefore, the drum rotating shaft 6341 may be bent by the load.

When the support wheels 415 support the front lower part of the drum 200, the support wheels 415 may alleviate the load applied to the drum rotating shaft 6341. Therefore, the support wheels 415 may prevent the drum rotating shaft 6341 from being bent, and may prevent generation of noise due to vibration.

The support wheels 415 may be provided at positions symmetrical to each other with respect to the center of rotation of the drum 200 so as to support the load of the drum 200. It is desirable for the support wheels 415 to be respectively provided at the left lower part and the right lower part of the drum 200 so as to support the drum 200. However, the present disclosure is not limited thereto, and a larger number of support wheels 415 may be provided, depending on the operating environment of the drum 200.

The circulation flow path part 820 provided on the base 800 may form a flow path along which the air in the drum 200 circulates and then returns to the inside of the drum 200.

The circulation flow path part 820 may include an inflow duct 821, into which the air discharged from the drum 200 flows, a discharge duct 823 for supplying air to the drum 200, and a transfer duct 822 connecting the inflow duct 821 to the discharge duct 823.

In the case in which air is discharged from the front part of the drum 200, the inflow duct 821 may be located at the front portion of the circulation flow path part 820. Further, the discharge duct 823 may be located at the rear portion of the circulation flow path part 820.

The discharge duct 823 may include an air blowing part 8231 for discharging air to the outside of the circulation flow path part 820. The air blowing part 8231 may be provided at the rear part of the discharge duct 823. Air discharged through the air blowing part 8231 may flow to the drum 200.

A duct cover 830 may be coupled to the upper portion of the circulation flow path part 820 so as to shield a portion of the open upper surface of the circulation flow path part 820. The duct cover 830 may prevent air from leaking to the outside of the circulation flow path part 820. In other words, the duct cover 830 may form one surface of the flow path along which air circulates.

Further, the heat exchange unit 900 provided on the base 800 may include a first heat exchanger 910 provided inside the circulation flow path part 820 so as to cool air and a second heat exchanger 920 provided inside the circulation flow path part 820 so as to heat the air cooled by the first heat exchanger 910.

The first heat exchanger 910 may dehumidify the air discharged from the drum 200, and the second heat exchanger 920 may heat the dehumidified air. The heated air may be supplied again to the drum 200 so as to dry the laundry accommodated in the drum 200.

The first heat exchanger 910 and the second heat exchanger 920 may be provided as heat exchangers in which a refrigerant flows. When the first heat exchanger 910 and the second heat exchanger 920 are provided as heat exchangers in which a refrigerant flows, the first heat exchanger 910 may be provided as an evaporator, and the second heat exchanger 920 may be provided as a condenser. The first heat exchanger 910 and the second heat exchanger 920 may be provided such that the refrigerant flowing through the first heat exchanger 910 and the second heat exchanger 920 exchanges heat with the air discharged from the drum 200.

The heat exchange unit 900 may include a circulation flow path fan 950 installed in the circulation flow path part 820 so as to cause air to flow in the circulation flow path part 820. In addition, the heat exchange unit 900 may further include a circulation flow path fan motor 951 for rotating the circulation flow path fan 950. The circulation flow path fan 950 may be rotated by the rotational power supplied thereto from the circulation flow path fan motor 951. When the circulation flow path fan 950 operates, the air dehumidified by the first heat exchanger 910 and heated by the second heat exchanger 920 may flow to the rear part of the drum 200.

The circulation flow path fan 950 may be installed in any one of the inflow duct 821, the transfer duct 822, and the discharge duct 823. The circulation flow path fan 950 is provided so as to be rotatable, and thus, when the circulation flow path fan 950 operates, noise may be generated. Therefore, it is desirable for the circulation flow path fan 950 to be disposed at the rear portion of the circulation flow path part 820.

The circulation flow path fan 950 may be installed at the air blowing part 8231. Further, the circulation flow path fan motor 951 may be located behind the air blowing part 8231. When the circulation flow path fan 950 is rotated by the circulation flow path fan motor 951, the air in the circulation flow path part 820 may be discharged to the outside of the circulation flow path part 820 through the air blowing part 8231.

It is desirable for the inlet 211 of the drum 200 to be disposed at a relatively high position in order to enable the user to easily withdraw laundry from the drum 200. Therefore, it may be desirable for the circulation flow path part 820 and the heat exchange unit 900 to be disposed under the drum 200.

The rear plate 420 for guiding the air discharged from the circulation flow path part 820 to the drum 200 may be provided behind the drum 200. The rear plate 420 may be spaced apart from the rear drum surface 220. The circulation flow path part 820 may receive air from the inside of the drum 200 through the front plate 410, and may supply air to the drum 200 through the rear plate 420. The air discharged from the circulation flow path part 820 may pass through the rear plate 420, and may then be guided to the drum 200.

The base 800 may further include a connector 850 for guiding the air discharged from the circulation flow path part 820 to the rear plate 420. The connector 850 may uniformly disperse the air discharged from the circulation flow path part 820 throughout the rear plate 420.

The connector 850 may be installed at the air blowing part 8231. That is, the connector 850 may guide air discharged from the air blowing part 8231 to the rear plate 420. Hot air supplied to the rear plate 420 may flow into the drum 200 through the rear drum surface 220.

The drum 200 of the laundry treating apparatus according to the present disclosure may be directly connected to the driving unit located behind the drum 200 so as to be rotated, rather than being coupled to a belt or the like so as to be indirectly rotated. Therefore, unlike the drum of the conventional dryer, which is formed in the shape of a cylinder having an open front part and an open rear part, the drum of the laundry treating apparatus according to the present disclosure may have a closed rear part so as to be directly coupled to the driving unit.

As described above, the drum 200 may include the drum body 210 provided in a cylindrical shape so as to accommodate laundry and the rear drum surface 220 coupled to the rear part of the drum body 210 so as to form the rear surface of the drum 200.

The rear drum surface 220 may provide a coupling surface for closing the rear part of the drum body 210 so as to be directly coupled to the driving unit. That is, the rear drum surface 220 may be connected to the driving unit, and may rotate the entirety of the drum 200 by receiving rotational power from the driving unit. Accordingly, the inlet 211, through which laundry is put into the drum 200, may be formed in the front part of the drum body 210, and the rear part of the drum body 210 may be closed by the rear drum surface 220.

A bushing 300, which connects the driving unit to the rear drum surface 220, may be provided on the rear drum surface 220. The bushing 300 provided on the rear drum surface 220 may form the center of rotation of the drum 200. The bushing 300 may be provided integrally with the rear drum surface 220, or may be formed of a material having greater rigidity or durability than the rear drum surface 220 so as to be firmly coupled to the rotating shaft for transmitting power. The bushing 300 may be seated on and coupled to the rear drum surface 220 so as to form a concentric axis with the center of rotation of the rear drum surface 220.

The rear drum surface 220 may include a flange part 221 coupled to the outer circumferential surface of the drum body 210 and a mounting plate 222 provided inside the flange part 221 so as to be coupled to the driving unit. The bushing 300 may be seated on and coupled to the mounting plate 222. The rotating shaft for rotating the drum 200 may be more firmly coupled to the mounting plate 222 owing to the bushing 300. Further, the bushing 300 may prevent deformation of the rear drum surface 220.

The rear drum surface 220 may include an intake hole 224 formed therethrough between the flange part 221 and the mounting plate 222 so as to allow the region in front of the rear drum surface 220 and the region behind the rear drum surface 220 to communicate with each other therethrough. Hot air supplied through the circulation flow path part 820 may flow into the drum body 210 through the intake hole 224. The intake hole 224 may be provided as a plurality of holes formed through the rear drum surface 220, or may be provided as a mesh-type net.

The driving unit for rotating the drum 200 may be located behind the rear plate 420. The driving unit may include the motor 500 for generating rotational power and the speed reducer 600 for reducing the rotational power of the motor 500 and transmitting the reduced power to the drum 200.

The motor 500 may be disposed behind the rear plate 420. Further, the motor 500 may be coupled to the rear side of the rear plate 420 via the speed reducer 600.

The speed reducer 600 may be fixed to the rear surface of the rear plate 420, and the motor 500 may be coupled to the rear surface of the speed reducer 600. That is, the rear plate 420 may provide a support surface for supporting the speed reducer 600 or the motor 500. However, the present disclosure is not limited thereto, and the motor 500 may be coupled to the rear plate 420.

Figure 5:
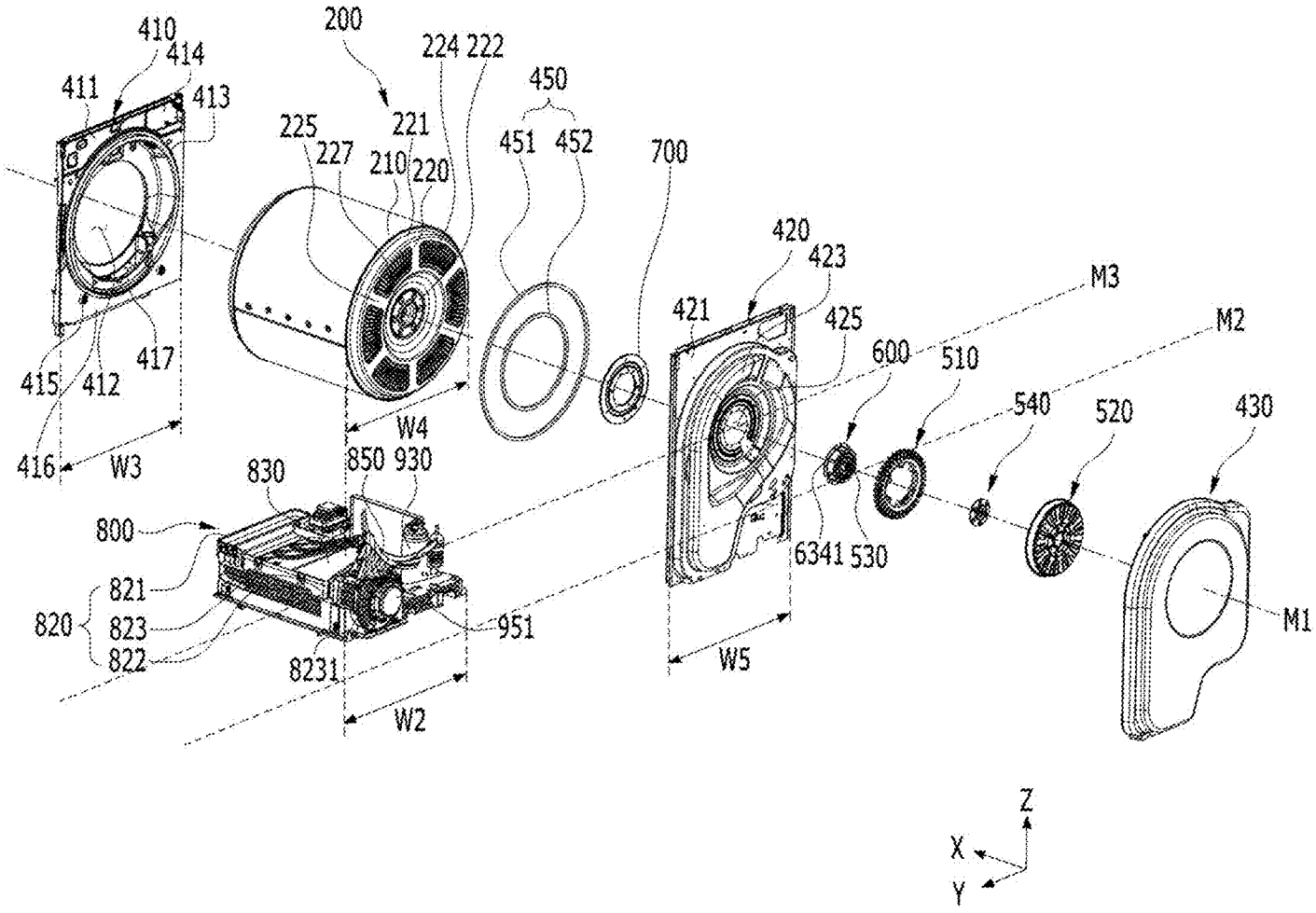
FIG. 5 is an exploded perspective view of the laundry treating apparatus according to one embodiment of the present disclosure.

FIG. 5 is an exploded perspective view illustrating the inner elements of the laundry treating apparatus.

The laundry treating apparatus according to one embodiment of the present disclosure may include the drum 200 for accommodating laundry, the front plate 410 supporting the front surface of the drum 200, the rear plate 420 located behind the drum 200, the base 800 provided under the drum 200 so as to provide a space in which air in the drum 200 circulates or moisture contained in the air is condensed, the motor 500 (510, 520, and 540) located behind the drum 200 so as to provide rotational power to the drum 200, the speed reducer 600 for reducing the rotational power of the motor 500 and transmitting the reduced rotational power to the drum 200, and a rear cover 430 coupled to the rear plate 420 so as to prevent the motor 500 from being exposed to the outside.

The base 800 may include the circulation flow path part 820, which communicates with the drum 200 so as to receive air supplied from the drum 200 or to discharge air to the drum 200.

The front plate 410 may include a front panel 411 forming the front surface thereof and the inlet communication hole 412 formed through the front panel 411 so as to communicate with the drum 200. The front plate 410 may further include a front gasket 413, which is provided on the rear surface of the front panel 411 and surrounds the radially outer surface of the inlet communication hole 412 so as to accommodate a portion of the drum body 210.

The front gasket 413 may rotatably support the drum body 210, and may be provided so as to be in contact with the outer circumferential surface or the inner circumferential surface of the inlet 211. The front gasket 413 may prevent hot air in the drum 200 from leaking through a gap between the drum body 210 and the front plate 410. The front gasket 413 may be formed of a plastic resin or an elastomer, and a separate sealing member may be additionally coupled to the front gasket 413 so as to prevent laundry or hot air from being released from the drum body 210 to the front plate 410.

The front plate 410 may include the duct communication hole 417 formed through the inner circumferential surface of the inlet communication hole 412. Further, the front plate 410 may include the duct connector 416, which extends downwards below the duct communication hole 417 so as to form a flow path through which the drum body 210 and the circulation flow path part 820 communicate with each other.

The duct connector 416 may communicate with the drum body 210 through the duct communication hole 417, and air discharged from the drum body 210 may flow into the duct connector 416 through the duct communication hole 417 and may be guided to the circulation flow path part 820. The air discharged from the drum body 210 may be guided to the circulation flow path part 820 by the duct connector 416, and thus leakage of air in the drum 200 to the outside may be prevented.

A filter member (not shown) for removing lint or foreign substances from the air discharged from the drum 200 may be installed in the duct connector 416, thereby preventing the foreign substances from entering the circulation flow path part 820.

The support wheels 415 may be installed on the front plate 410. The support wheels 415 may be rotatably installed on the rear surface of the front panel 411 so as to support the lower part of the drum 200. The support wheels 415 may support the front part of the drum 200, thereby preventing the rotating shaft connected to the drum 200 from being bent.

The front plate 410 may have a water storage tank support hole 414 formed through the front panel 411. The water storage tank 120 (refer to FIG. 3) storing condensed water generated during the drying cycle may be withdrawn through or supported by the water storage tank support hole 414. In the case in which the water storage tank support hole 414 is provided at the upper part of the front plate 410, the user does not need to stoop when withdrawing the water storage tank 120, and thus user convenience may be improved.

The drum 200 for accommodating laundry may include the drum body 210, which has the inlet 211 formed through the front part thereof so as to allow laundry to enter or exit the drum 200 therethrough, and the rear drum surface 220 forming the rear surface of the drum 200.

The rear drum surface 220 may include the flange part 221 connected to the drum body 210, the intake holes 224 formed through the rear drum surface 220 inside the flange part 221, and the mounting plate 222 provided at the center of rotation of the rear drum surface 220 so as to be coupled to the rotating shaft. Air may flow to the region behind the drum 200 through the intake holes 224.

The rear drum surface 220 may further include reinforcing ribs 225, which extend from the flange part 221 toward the center of rotation of the rear drum surface 220. The reinforcing ribs 225 may extend while avoiding the intake holes 224. The reinforcing ribs 225 may prevent a reduction in the rigidity of the rear drum surface 220 due to the intake holes 224. The reinforcing ribs 225 may be provided so as to radially extend from the outer circumferential surface of the mounting plate 222 toward the inner circumferential surface of the flange part 221.

In addition, the rear drum surface 220 may further include a circumferential rib 227, which extends in the circumferential direction of the rear drum surface 220 so as to connect the reinforcing ribs 225 to each other. The intake holes 224 may be disposed in the regions defined by the reinforcing ribs 225, the circumferential rib 227, and the flange part 221. The reinforcing ribs 225 and the circumferential rib 227 may prevent deformation of the rear drum surface 220 when rotational power from the motor 500 is transmitted to the rear drum surface 220.

The inflow duct 821 may communicate with the duct communication hole 417 in the front plate 410 so as to communicate with the flow path formed in the front plate 410. The transfer duct 822 may extend from the end of the inflow duct 821 toward the rear part of the drum 200, and the discharge duct 823 may be provided at the end of the transfer duct 822 so as to guide air to the drum 200.

The air blowing part 8231 may be located downstream of the discharge duct 823, and may provide a space in which the circulation flow path fan 950 is installed. When the circulation flow path fan 950 operates, the air introduced into the inflow duct 821 may be discharged upwards from the air blowing part 8231.

The heat exchange unit 900 for cooling and heating the air circulating in the drum 200 may be installed on the base 800. The heat exchange unit 900 may include a compressor 930 connected to the first heat exchanger 910 and the second heat exchanger 920 so as to supply a compressed refrigerant. The compressor 930 may be located outside the circulation flow path part 820 so as to avoid directly exchanging heat with the circulating air.

Further, the heat exchange unit 900 may include the circulation flow path fan motor 951 supported by the rear part of the air blowing part 8231 so as to rotate the circulation flow path fan 950. The circulation flow path fan motor 951 may be coupled to the rear part of the air blowing part 8231.

The laundry treating apparatus according to one embodiment of the present disclosure may further include the connector 850 coupled to the circulation flow path part 820 so as to guide the hot air discharged from the circulation flow path part 820 to the rear part of the drum 200 or to the rear plate 420.

The connector 850 may be disposed above the discharge duct 823 so as to guide the hot air passing through the second heat exchanger 920 to a region above the discharge duct 823. Further, the connector 850 may be coupled to an opening formed in the upper part of the air blowing part 8231.

The connector 850 may be provided so as to form a flow path therein. The connector 850 may serve to uniformly guide air flow, generated by the circulation flow path fan 950, to the rear plate 420. That is, the connector 850 may be configured such that the area of the flow path formed therein gradually increases in a direction away from the air blowing part 8231.

The rear plate 420 may be coupled to or supported by the base 800, and may be located behind the drum 200. The rear plate 420 may include a rear panel 421 located so as to face the front plate 410 and a duct 423 provided so as to be recessed from the rear panel 421 so as to form a flow path along which air flows and to guide the air discharged from the circulation flow path part 820 to the drum 200.

The rear plate 420 may include a mounting part 425 configured such that the driving unit is coupled thereto or supported thereby. The mounting part 425 may be provided so as to penetrate the rear panel 421, and may be disposed on the inner circumferential surface of the duct 423. The mounting part 425 may be provided so as to be spaced radially inwards apart from the inner circumferential surface of the duct 423.

Here, the driving unit may be an assembly of the speed reducer 600 and the motor 500, as described above. Alternatively, the driving unit may be implemented only as the motor 500. That is, an element configured to generate rotational power and to transmit the rotational power to the drum 200 may be referred to as the driving unit.

The driving unit may be mounted in the mounting part 425. The mounting part 425 may support the load of the driving unit. The driving unit may be connected to the drum 200 in the state in which the driving unit is supported by the mounting part 425.

The duct 423 may be provided so as to accommodate a portion of the rear drum surface 220. The duct 423 may form a flow path along which air flows, together with the rear drum surface 220.

The driving unit may be installed in the mounting part 425 so as to prevent interference with the duct 423. That is, the driving unit may be disposed so as to be spaced radially inwards apart from the inner circumferential surface of the duct 423. The driving unit may be installed in the mounting part 425 such that the rear part thereof is exposed to the outside, thus being cooled by external air.

The driving unit may include the motor 500 for providing power to rotate the drum 200. The motor 500 may include a stator 510 for generating a rotating magnetic field and a rotor 520 configured to be rotated by the stator 510.

The rotor 520 may be provided as an outer rotor type, configured to accommodate the stator 510 and to rotate around the circumference of the stator 510. A drive shaft may be coupled to the rotor 520, and may penetrate the stator 510 and the mounting part 425 so as to be directly connected to the drum 200. In this case, the rotor 520 may directly transmit rotational power to the drum 200.

The rotor 520 may be coupled to the drive shaft via a washer 540. The washer 540 may function to connect the drive shaft to the rotor 520. The contact area between the rotor 520 and the drive shaft may be increased by the washer 540, and thus rotation of the rotor 520 may be more effectively transmitted to the drum 200.

The speed reducer 600 may be provided so as to connect the motor 500 to the drum 200. The speed reducer 600 may convert the power of the motor 500 so as to rotate the drum 200. The speed reducer 600 may be disposed between the motor 500 and the drum 200, may receive power from the motor 500, may convert the power, and may then transmit the converted power to the drum 200. The speed reducer 600 may increase the torque value of the rotor 520 while reducing the RPM of the rotor 520, and may then transmit the increased torque to the drum 200.

Specifically, the speed reducer 600 may be coupled to the rotor 520 so as to be connected to the drive shaft, which rotates together with the rotor 520. The speed reducer 600 may include a gear assembly provided therein so as to be engaged with and rotated by the drive shaft, thereby increasing the torque of the drive shaft while converting the RPM of the drive shaft. The gear assembly may be coupled to the drum 200 so as to be connected to the drum rotating shaft to rotate the drum 200. Therefore, when the drive shaft 530 rotates, the drum rotating shaft may rotate at a lower RPM than the drive shaft 530, but may generate a greater torque than the torque generated by the drive shaft 530.

The performance of the speed reducer 600 may depend on whether the drive shaft and the drum rotating shaft remain coaxial with each other. That is, when the drive shaft and the drum rotating shaft are misaligned from each other, coupling between components forming the gear assembly in the speed reducer 600 and at least one of the drive shaft or the drum rotating shaft may be loosened or released. Therefore, the power of the drive shaft may not be properly transmitted to the drum rotating shaft, or the drive shaft may idly rotate.

Further, if the drive shaft and the drum rotating shaft are even temporarily misaligned from each other, gears in the speed reducer 600 may be dislocated and may thus collide with each other, thus leading to occurrence of unnecessary vibration or noise.

Further, if the misalignment angle between the drive shaft and the drum rotating shaft becomes large even temporarily, the speed reducer 600 may completely deviate from the original position thereof, or may be damaged.

In order to prevent such problems, laundry treating apparatuses including a speed reducer may be generally configured such that the speed reducer and a motor are fixed to a support that maintains the original state thereof without being deformed when external force is applied thereto.

For example, in a washer, a tub for accommodating a drum may be primarily fixed to a cabinet, and a motor and a speed reducer may be secondarily fixed to a bearing housing, which is produced as a rigid body embedded in the tub through injection molding. Thereby, when the tub generates considerable vibration, the speed reducer and the driving unit may be tilted or vibrate together with the bearing housing or a fixed steel plate. Consequently, the coupled state of the speed reducer and the driving unit may always be maintained constant, and the coaxial state between a drive shaft and a rotating shaft may be maintained.

However, the laundry treating apparatus according to the present disclosure is provided as a dryer, and thus a tub fixed to the inside of the cabinet is omitted. Further, the rear panel of the cabinet is provided as a relatively thin plate, and thus, although the stator 510 is fixed, the rear panel may be easily vibrated or bent due to repulsive power when the rotor 520 rotates. If the rear panel is vibrated or bent even temporarily, the centers of rotation of the speed reducer 600 and the motor 500, which are coupled to the drum 200, are misaligned from each other.

Further, the rear panel is provided as a thin steel plate, and thus it may be difficult for the rear panel to support both the speed reducer 600 and the motor 500. For example, in the case in which the speed reducer 600 and the motor 500 are coupled to the rear panel in parallel with each other, moment of inertia may occur due to the overall length and weight of the speed reducer 600 and the motor 500, and thus the speed reducer 600 may sag. Accordingly, the drum rotating shaft coupled to the drum may be misaligned from the speed reducer 600, and thus may not remain coaxial with the drive shaft.

The motor 500 may be supported by coupling the stator 510 to the rear pate 420. When a large amount of laundry is accommodated in the drum 200 or the laundry in the drum 200 is unbalanced, the drum rotating shaft may deviate from the original position thereof depending on the disposition of the laundry whenever the drum 200 rotates. Here, since the stator 510 is separate from the drum 200 and is fixed to the rear plate 420, the drum rotating shaft may vibrate at a different amplitude from the stator 510, or may be tilted at a different angle from the stator 510. Therefore, the drum rotating shaft and the drive shaft may not remain coaxial with each other.

From another point of view, the mounting position of the drum 200 supported by the front plate 410 and the rear plate 420 may be fixed to a certain extent. Therefore, the position of the drum rotating shaft coupled to the drum 200 may also be fixed to a certain extent. Accordingly, when the drum 200 vibrates, the vibration of the drum 200 may be attenuated by at least one of the front plate 410 or the rear plate 420.

However, in the case in which the vibration of the drum 200 is transmitted to the motor 500, although the speed reducer 600 and the motor 500 are fixed to the rear plate 420, the amplitude at which the motor 500 and the rear plate 420 vibrate may be greater than the amplitude at which the drum rotating shaft vibrates. In this case, the drive shaft and the drum rotating shaft may not remain coaxial with each other.

In order to solve the above problems, in the laundry treating apparatus according to the present disclosure, the motor 500 may be fixedly coupled to the speed reducer 600. In other words, the speed reducer 600 may serve as a reference point for the entire driving unit. That is, the speed reducer 600 may serve as a reference to determine the vibration and the tilt angle amount of the entire driving unit.

Since the motor 500 is fixed only to the speed reducer 600, without being fixed to other elements of the laundry treating apparatus, when vibration or external force is transmitted to the driving unit, the motor 500 may always be tilted or vibrated together with tilting or vibration of the speed reducer 600.

Accordingly, the speed reducer 600 and the motor 500 may form a single vibration system, and may remain fixed to each other, rather than moving relative to each other.

The stator 510 of the motor 500 may be directly coupled to and fixed to the speed reducer 600. Therefore, the mounting position of the drive shaft 530 with respect to the speed reducer 600 may not vary. The drive shaft 530 and the speed reducer 600 may be disposed such that the center of the drive shaft 530 and the center of the speed reducer 600 are coaxial with each other, and the drive shaft 530 may rotate in the state in which the center thereof remains coaxial with the center of the speed reducer 600.

A first axis M1 may be a virtual line extending in the forward-backward direction along the center of rotation of the drum 200. That is, the first axis M1 may be parallel to the X-axis.

A second axis M2 and a third axis M3 may be virtual lines extending from the front part of the laundry treating apparatus to the upper region of the rear part of the laundry treating apparatus. That is, the second axis M2 and the third axis M3 may be parallel to the XZ plane, or may be perpendicular to the Y-axis.

The first axis M1 and the second axis M2 may intersect each other at the speed reducer 600. Further, the first axis M1 and the third axis M3 may intersect each other at the mounting part 425.

The speed reducer 600 and the motor 500 may be designed so as to be disposed along the first axis M1, which is parallel to the ground, when there is no load in the drum 200 or when the motor 500 does not operate.

However, when the drum 200 or the motor 500 is vibrated, the vibration may be transmitted to the speed reducer 600, and thus the speed reducer 600 may be tilted. Accordingly, the speed reducer 600 may be temporarily tilted along the second axis M2.

Here, since the motor 500 is coupled to the speed reducer 600, the motor 500 may be vibrated or tilted together with the speed reducer 600. Therefore, the motor 500 may be disposed parallel to the speed reducer 600 on the second axis M2. Accordingly, the drive shaft and the drum rotating shaft may also be disposed parallel to each other along the second axis M2.

Consequently, even when the speed reducer 600 is tilted, the motor 500 may move integrally with the speed reducer 600, and the drive shaft and the drum rotating shaft may remain coaxial with each other.

The speed reducer 600 may be coupled to and fixed to the rear plate 420. In this case, since the speed reducer 600 is tilted or vibrated in the state in which the speed reducer 600 is coupled to the rear plate 420, it may be considered that the rear plate 420 serves as the center of the vibration system including the speed reducer 600, the motor 500, and the drum 200. In this case, the motor 500 may be fixedly coupled only to the speed reducer 600, rather than being directly coupled to the rear plate 420.

In the state in which the speed reducer 600, the motor 500, and the drum 200 are disposed parallel to each other along the first axis M1, the speed reducer 600 may be tilted parallel to the third axis M3 due to vibration of the drum 200 or the motor 500. The third axis M3 may pass through the speed reducer 600 coupled to the rear plate 420. Here, since the speed reducer 600 and the motor 500 are coupled to each other, the motor 500 may also be tilted parallel to the third axis M3 in the same manner as the speed reducer 600.

Accordingly, since the motor 500 and the drum 200 are coupled to the speed reducer 600, the motor 500 and the drum 200 may be tilted parallel to the speed reducer 600, or may vibrate together with the speed reducer 600.

The above-described term "coaxial" or "coinciding" does not mean that two elements are physically perfectly coaxial with each other or coincide with each other, but conceptually means that the elements are within a mechanically allowable error range or are within a range recognized as approximating a coaxial state or a coinciding state by those skilled in the art. For example, the state in which the drive shaft 530 and the drum rotating shaft 6341 are misaligned within 5 degrees may be accepted as the coaxial state or the coinciding state. However, this angle value is only one example, and a design tolerance may be different.

Since the drive shaft 530 rotates relative to the speed reducer 600 but is fixed so as not to be tilted and the stator 510 is also fixed to the speed reducer 600, a constant distance between the stator 510 and the rotor 520 may always be maintained. Accordingly, collision between the stator 510 and the rotor 520 may be prevented, and noise or vibration, which may be caused by a change in the center of rotation of the rotor 520 around the stator 510, may be fundamentally prevented.

The drum rotating shaft 6341 may be provided so as to extend toward the drum 200 within the speed reducer 600, and may be vibrated and tilted together with the speed reducer 600. That is, the drum rotating shaft 6341 may be provided so as to be rotatable in the speed reducer 600, but the mounting position of the drum rotating shaft 6341 may be fixed. Accordingly, the drum rotating shaft 6341 and the drive shaft 530 may always be disposed parallel to each other, and may form a concentric axis. In other words, the drum rotating shaft 6341 and the drive shaft 530 may maintain the state in which the center of the drum rotating shaft 6341 and the center of the drive shaft 530 coincide with each other.

A sealing unit 450 may be provided between the rear drum surface 220 and the rear plate 420. The sealing unit 450 may seal a gap between the rear drum surface 220 and the rear plate 420 so that the air introduced into the duct 423 of the rear plate 420 flows into the intake holes 224 and does not leak to the outside.

The sealing unit 450 may be disposed on each of the outer surface and the inner surface of the duct 423. A first sealing member 451 may be provided radially outside the duct 423, and a second sealing member 452 may be provided radially inside the duct 423. The first sealing member 451 may prevent hot air between the rear drum surface 220 and the duct 423 from leaking radially outwards, and the second sealing member 452 may prevent hot air between the rear drum surface 220 and the duct 423 from leaking radially inwards.

In other words, the sealing unit 450 may be disposed radially outside and inside the intake holes 224. The first sealing member 451 may be provided radially outside the intake holes 224, and the second sealing member 452 may be provided radially inside the intake holes 224.

In order to prevent hot air from leaking, the sealing unit 450 may be provided so as to be in contact with both the rear drum surface 220 and the rear plate 420. Since the drum 200 rotates during operation of the laundry treating apparatus, the rear drum surface 220 continuously applies friction to the sealing unit 450. Therefore, it is desirable for the sealing unit 450 to be formed of a material that is capable of sealing the gap between the rear drum surface 220 and the duct 423 without degradation of performance due to frictional force or frictional heat generated by rotation.

The motor 500 or the speed reducer 600 may be coupled to the rear part of the rear plate 420. The rear plate 420 may be formed as a thin steel plate, and may thus be bent or deformed by the load of the speed reducer 600 or the load transmitted to the speed reducer 600 by the drum 200. That is, in order to install the speed reducer 600 and the motor 500 on the rear plate 420, it is required to increase the rigidity of the rear plate 420.

To this end, the rear plate 420 may further include a bracket 700 to increase the rigidity of the rear plate 420. The bracket 700 may be additionally coupled to the rear plate 420, and the speed reducer 600 and the motor 500 may be coupled to the rear plate 420 by the bracket 700.

The speed reducer 600 may be coupled both to the bracket 700 and to the rear plate 420. The speed reducer 600, the rear plate 420, and the bracket 700 may be coupled to each other using fastening members passing therethrough. The rigidity of the rear plate 420 may be increased by coupling the bracket 700 to the rear plate 420. The speed reducer 600 and the motor 500 may be coupled to the rear plate 420 having increased rigidity.

The speed reducer 600 may be first coupled to the bracket 700, and then the bracket 700 may be coupled to the rear plate 420. That is, the speed reducer 600 may be fixed to the rear plate 420 via the bracket 700, rather than being directly coupled to the rear plate 420.

When the motor 500 or the speed reducer 600 is coupled to the rear part of the rear plate 420, the motor 500 and the speed reducer 600 may be exposed to the outside. Therefore, it is necessary to prevent the motor 500 coupled to the rear part of the rear plate 420 from being exposed to the outside. Further, the duct 423 may be heated by hot air. Therefore, it is necessary to thermally isolate the rear surface of the duct 423.

The rear cover 430 may be coupled to the rear part of the rear plate 420 so as to prevent the duct 423 and the motor 500 or the speed reducer 600 from being exposed to the outside. The rear cover 430 may be spaced apart from the duct 423 and the driving unit.

The rear cover 430 may prevent the motor 500 from being damaged due to interference with an external object, or may prevent degradation of drying efficiency due to heat loss through the duct 423.

Figure 6A:
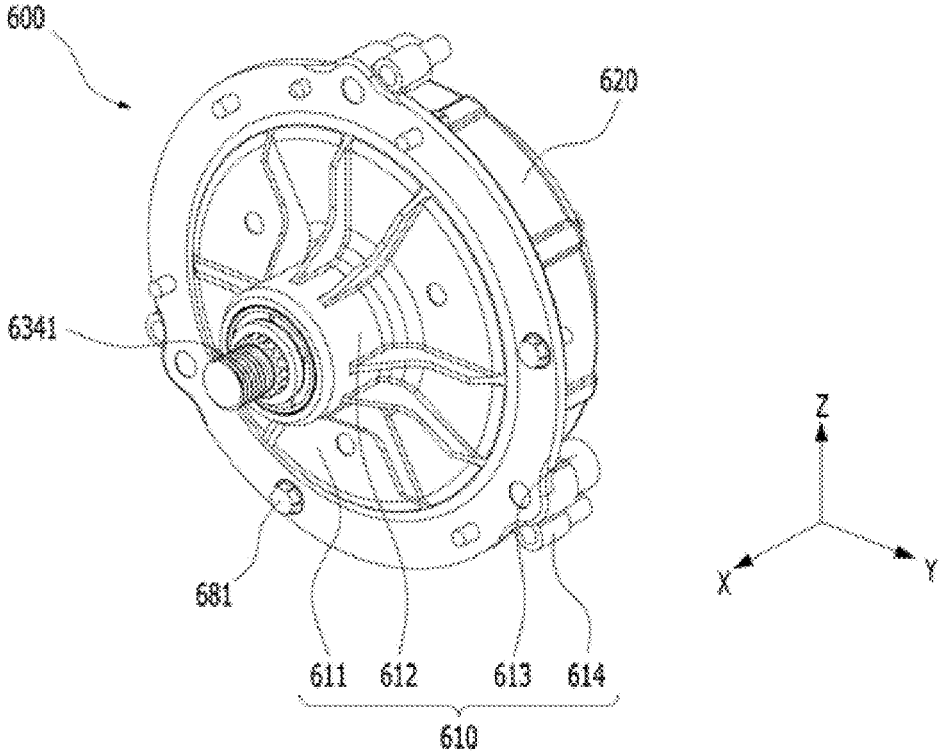
FIGS. 6A and 6B are views illustrating a speed reducer of the laundry treating apparatus according to one embodiment of the present disclosure.
Figure 6B:
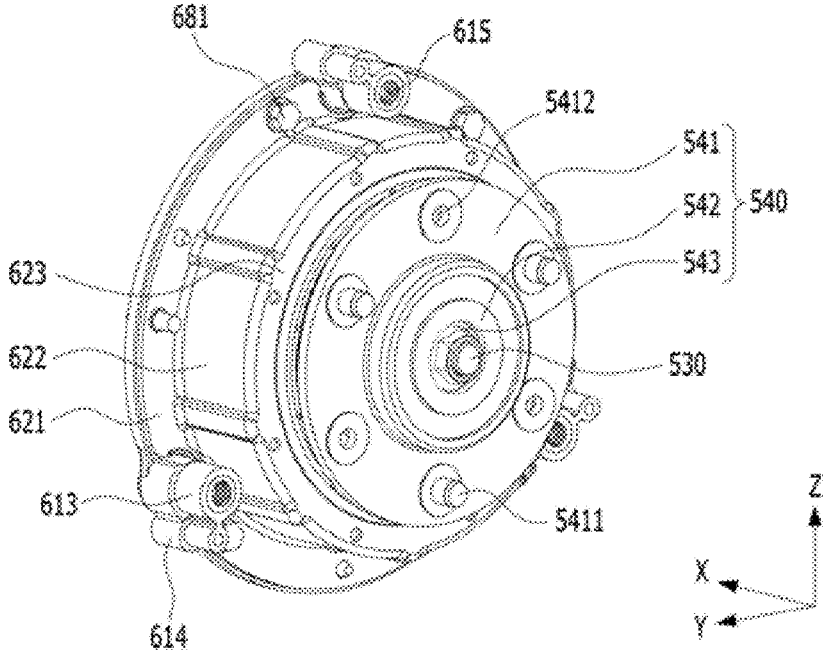

FIGS. 6A and 6B illustrate the external appearance of the speed reducer according to one embodiment of the present disclosure.

The speed reducer 600 may include speed reducer housings 610 and 620 forming the external appearance thereof. The speed reducer housings may include a first housing 610 provided so as to face the drum and a second housing 620 provided so as to face the motor.

The speed reducer 600 may include a gear box. The gear box may receive power from the motor, may increase the torque value of the motor while reducing the RPM of the motor, and may then transmit the increased torque to the drum. A great part of the gear box may be accommodated in the second housing 620, and the first housing 610 may be provided so as to shield the inside of the speed reducer 600. Thereby, the overall thickness of the speed reducer 600 may be reduced. A detailed description of the gear box will be made later.

The first housing 610 may include a first housing shield body 611 for shielding the second housing 620 and a first housing shaft receiver 612 extending from the first housing shield body 611 in a direction away from the second housing 620. The first housing shaft receiver 612 may accommodate the drum rotating shaft 6341, and may rotatably support the drum rotating shaft 6341.

The first housing 610 may include a stator coupler 613 for supporting the motor. The stator coupler 613 may extend from the circumferential surface of the first housing shield body 611 in a direction away from the first housing shaft receiver 612.

The stator coupler 613 may include a stator fastening hole 615 to which the motor is fastened. The stator fastening hole 615 may be recessed from the stator coupler 613. A separate fastening member may be inserted into the stator fastening hole 615. The stator coupler 613 and the motor may be coupled to each other using the fastening member.

The first housing 610 may further include a coupling guide 614 for guiding coupling of the motor to the first housing 610. The coupling guide 614 may extend from the circumferential surface of the first housing shield body 611 in the direction away from the first housing shaft receiver 612. The coupling guide 614 may extend from the first housing shield body 611 so as to be connected to the stator coupler 613. The coupling guide 614 may guide the position of the stator 510 when the stator 510 is coupled to the stator coupler 613. Thereby, assemblability may be improved.

Referring to FIGS. 6A and 6B, the second housing 620 may accommodate the gear assembly therein. In general, the gear box coupled to the speed reducer 600 may include a sun gear, a planetary gear configured to rotate around the sun gear, and a ring gear configured to accommodate the planetary gear so as to induce rotation of the planetary gear. The second housing 620 may include a second housing coupling body 621 coupled to the first housing 610, a second housing shield body 622 extending from the second housing coupling body 621 in a direction away from the first housing 610 so as to form a space for accommodating the gear box, and a second housing shaft receiver 623 extending from the inner circumferential surface of the second housing shield body 622 in the direction away from the first housing 610 so as to support the drive shaft 530.

The first housing 610 and the second housing 620 may be designed such that the center of the first housing 610 and the center of the second housing 620 are coaxial with each other. Coaxial arrangement of the drive shaft 530 and the drum rotating shaft 6341 is advantageous from the aspect of power transmission. Therefore, it is desirable for the first housing shaft receiver 612 for rotatably supporting the drum rotating shaft 6341 and the second housing shaft receiver 623 for rotatably supporting the drive shaft 530 to be coaxially coupled to each other.

The drive shaft 530 may be inserted into the second housing 620 so as to be rotatably supported in the second housing 620. The washer 540 for rotatably supporting the rotor 520 may be coupled to the drive shaft 530. The washer 540 may include an accommodation body 542 having a shaft support hole 543 formed in the center thereof so as to accommodate the drive shaft 530 and a washer coupling body 541 extending from the outer circumferential surface of the accommodation body 542 in the radial direction so as to form a surface to which the rotor 520 is coupled. The shaft support hole 543 may be formed in the shape of a recess corresponding to a protrusion formed on the outer circumferential surface of the drive shaft 530 so that the protrusion is fitted thereinto.

The washer 540 may include one or more washer coupling protrusions 5411, which protrude from the washer coupling body 541 in a direction away from the speed reducer 600. Further, the washer 540 may include one or more washer coupling holes 5412 formed through the washer coupling body 541.

The washer coupling protrusions 5411 may be coupled to receiving recesses formed in the rotor 520. Fastening members passing through the rotor 520 may be inserted into the washer coupling holes 5412, and may thus be used to couple the rotor 520 and the washer 540 to each other.

The washer coupling protrusions 5411 and the washer coupling holes 5412 may be provided in a plural number so as to be alternately arranged on the surface of the washer coupling body 541 in the circumferential direction.

Figure 7:
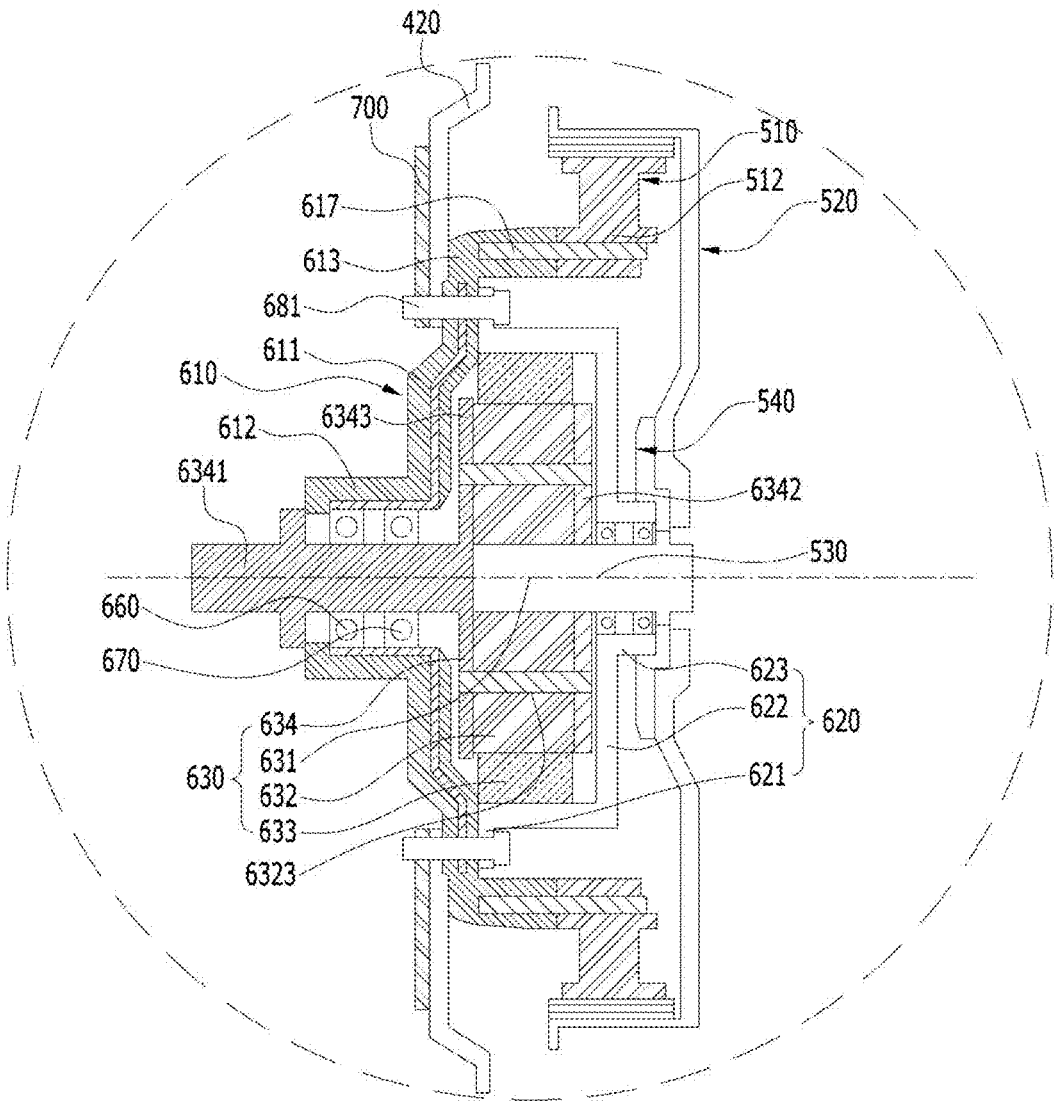
FIG. 7 is an enlarged cross-sectional view of the portion indicated by the dotted line in FIG. 4.

FIG. 7 is an enlarged cross-sectional view illustrating the driving unit, shown in brief in FIG. 4, in more detail.

The driving unit may include the motor 500 for generating rotational power and the speed reducer 600 for reducing the rotational speed of the motor 500 and transmitting the reduced rotational speed to the drum 200. The speed reducer 600 may include the drum rotating shaft 6341 for rotating the drum 200.

The motor 500 may include the stator 510 for generating a rotating magnetic field by receiving external power and the rotor 520 surrounding the outer circumferential surface of the stator 510. Permanent magnets may be arranged on the inner circumferential surface of the rotor 520.

The permanent magnets located on the inner circumferential surface of the rotor 520 may be moved in a specific direction by the rotating magnetic field generated by the stator 510. The permanent magnets may be fixed to the inner circumferential surface of the rotor 520. Therefore, the rotor 520 may be rotated by the rotating magnetic field of the stator 510.

The drive shaft 530 configured to rotate together with the rotor 520 so as to transmit the rotational power of the rotor 520 may be coupled to the center of rotation of the rotor 520. The drive shaft 530 may be provided so as to rotate together with the rotor 520. The drive shaft 530 may be coupled to the rotor 520 via the washer 540.

The drive shaft 530 may be directly coupled to the rotor 520. However, the drive shaft 530 may be more firmly coupled to the rotor 520 via the washer 540, and may thus more effectively transmit the rotational power of the rotor 520. Further, in this case, concentrated application of load to the drive shaft 530 may be prevented, and thus durability of the drive shaft 530 may be increased.

The drive shaft 530 may be directly connected to the drum 200. However, because the drive shaft 530 rotates at the same speed as the rotational speed of the rotor 520, it may be necessary to reduce the rotational speed of the drive shaft 530. Therefore, the drive shaft 530 may be connected to the speed reducer 600, and the speed reducer 600 may be connected to the drum 200. That is, the speed reducer 600 may reduce the rotational speed of the drive shaft 530 so that the drum 200 rotates at the reduced rotational speed.

The speed reducer 600 may include the first housing 610 and the second housing 620 forming the external appearance thereof and a gear box 630 for reducing the power of the drive shaft 530. The second housing 620 may provide a space for accommodating the gear box 630, and the first housing 610 may shield the space provided by the second housing 620.

The second housing 620 may include the second housing coupling body 621 coupled to the first housing 610, the second housing shield body 622 extending backwards from the inner circumferential surface of the second housing coupling body 621 so as to form the space for accommodating the gear box 630, and the second housing shaft receiver 623 extending backwards from the second housing shield body 622 so as to accommodate the drive shaft 530.

The gear box 630 may include a ring gear 633 installed along the inner circumferential surface of the second housing shield body 622. One or more planetary gears 632 engaged with the ring gear 633 may be provided on the inner circumferential surface of the ring gear 633, and a sun gear 631 engaged with the planetary gears 632 may be provided inside the ring gear 633. The sun gear 631 may rotate together with the drive shaft 530.

The sun gear 631 may be coupled to the drive shaft 530 so as to rotate together therewith. The sun gear 631 may be provided separately from the drive shaft 530, but the present disclosure is not limited thereto. The sun gear 631 may be formed integrally with the drive shaft 530.

The sun gear 631, the planetary gears 632, and the ring gear 633 may be provided as helical gears. When the gears 631, 632, and 633 are provided as helical gears, noise may be reduced, and power transmission efficiency may be increased. However, the present disclosure is not limited thereto. The sun gear 631, the planetary gears 632, and the ring gear 633 may be provided as spur gears.

As one example of operation of the gear box 630, when the drive shaft 530 and the sun gear 631 connected to the drive shaft 530 rotate as the rotor 520 rotates, the planetary gears 632 engaged with the outer circumferential surface of the sun gear 631 may rotate through engagement between the ring gear 633 and the sun gear 631.

Each of the planetary gears 632 may include a planetary gear shaft 6323, which is inserted into the center of rotation thereof. The planetary gear shaft 6323 may rotatably support the planetary gear 632.

The speed reducer 600 may further include a first carrier 6342 and a second carrier 6343 for supporting the planetary gear shafts 6323. The front parts of the planetary gear shafts 6323 may be supported by the second carrier 6343, and the rear parts of the planetary gear shafts 6323 may be supported by the first carrier 6342.

The drum rotating shaft 6341 may extend from the center of rotation of the second carrier 6343 in a direction away from the motor 500. The drum rotating shaft 6341 may be provided separately from the second carrier 6343, and may be coupled to the second carrier 6343 so as to rotate together therewith. Alternatively, the drum rotating shaft 6341 may be formed integrally with the second carrier 6343 so as to extend from the second carrier 6343.

The drum rotating shaft 6341 may be coupled to the drum so as to rotate the drum. As described above, the drum rotating shaft 6341 may be coupled to the drum via a connector, such as the bushing, or may be directly coupled to the drum without a separate connector.

The drum rotating shaft 6341 may be supported by the first housing 610. The first housing 610 may include the first housing shield body 611 for shielding the accommodating space in the second housing 620 and the first housing shaft receiver 612 extending from the first housing shield body 611 in the direction away from the second housing 620 so as to accommodate the drum rotating shaft 6341. A first bearing 660 and a second bearing 670 may be provided on the inner circumferential surface of the first housing shaft receiver 612 by press fit, thus rotatably supporting the drum rotating shaft 6341.

The first housing 610 and the second housing 620 may be coupled to each other via a speed reducer fastening member 681. The speed reducer fastening member 681 may penetrate both the first housing 610 and the second housing 620 so as to couple the housings 610 and 620 to each other. Further, the speed reducer fastening member 681 may penetrate the first housing 610, the second housing 620, and the rear plate 420 so as not only to couple the first housing 610 and the second housing 620 to each other, but also to fix the speed reducer 600 to the rear plate 420.

The rear plate 420 may be formed as a steel plate having a small thickness. Therefore, it may be difficult to secure rigidity of the rear plate 420 so as to support all of the speed reducer 600, the motor 500 coupled to the speed reducer 600, and the drum 200 connected to the speed reducer 600. Accordingly, in order to secure rigidity of the rear plate 420, the bracket 700 may be used when the speed reducer 600 is coupled to the rear plate 420. The bracket 700 may be formed of a material having higher rigidity than the rear plate 420, and may be coupled to the front or rear surface of the rear plate 420.

The bracket 700 may be coupled to the front surface of the rear pate 420 so as to secure rigidity of the rear plate 420 to couple the speed reducer 600 to the rear plate 420, and the speed reducer 600 may be coupled both to the rear plate 420 and to the bracket 700. In order to couple the rear plate 420, the bracket 700, and the speed reducer 600, a fastening member, such as a bolt, may be used.

Further, in order to fix the speed reducer 600 to the rear plate 420, the speed reducer fastening member 681 used to couple the first housing 610 and the second housing 620 may be used. That is, the speed reducer fastening member 681 may penetrate all of the second housing 620, the first housing 610, the rear plate 420, and the bracket 700, thus being capable of coupling the same. In this case, the front part of the rear plate 420 may be supported by the bracket 700, and the rear part of the rear plate 420 may be supported by the first housing 610. Thereby, the rear plate 420 may have sufficient rigidity when the speed reducer 600 is coupled thereto. However, the present disclosure is not limited thereto. The first housing 610 and the second housing 620 may be first coupled using the speed reducer fastening member 681, and then the speed reducer 600 may be coupled to the rear plate 420 using a separate fastening member.

In addition, a stator coupler 613, to which the motor 500 is coupled, may be formed at the radially outer part of the first housing 610. The stator coupler 613 may include a coupling recess formed so as to be depressed therein.

The stator 510 may be directly coupled to the rear plate 420, or may be coupled to the stator coupler 613. The stator 510 may include a fixing rib 512 provided on the inner circumferential surface of the stator 510 so as to support the stator 510. The fixing rib 512 may be coupled to the stator coupler 613. The fixing rib 512 and the stator coupler 613 may be coupled to each other via a stator coupling pin 617.

The motor 500 may be coupled to the speed reducer 600 while being spaced apart from the rear plate 420, and thus the motor 500 and the speed reducer 600 may form one vibrator. Therefore, when vibration is applied from the outside, the drive shaft 530 coupled to the rotor 520 and the drum rotating shaft 6341 connected to the speed reducer 600 may easily remain coaxial with each other.

The axial direction of the drum rotating shaft 6341 is in danger of deviating from the original direction thereof due to vibration of the drum 200. However, since the motor 500 is coupled to the first housing 610 supporting the drum rotating shaft 6341, when the axial direction of the drum rotating shaft 6341 deviates from the original direction thereof, the axial direction of the drive shaft 530 may also deviate from the original direction thereof due to the first housing 610 in a similar manner to the drum rotating shaft 6341. That is, the motor 500 may be moved integrally with the speed reducer 600, and thus the drum rotating shaft 6341 and the drive shaft 530 may remain coaxial with each other even when external force is applied thereto.

The above-described coupling structure may increase efficiency and reliability in transmission of power generated by the motor 500 to the drum 200, and may prevent abrasion of the gear box 630, degradation of power transmission efficiency, and reduction in durability and reliability due to misalignment between the drum rotating shaft 6341 and the drive shaft 530.

Figure 8:
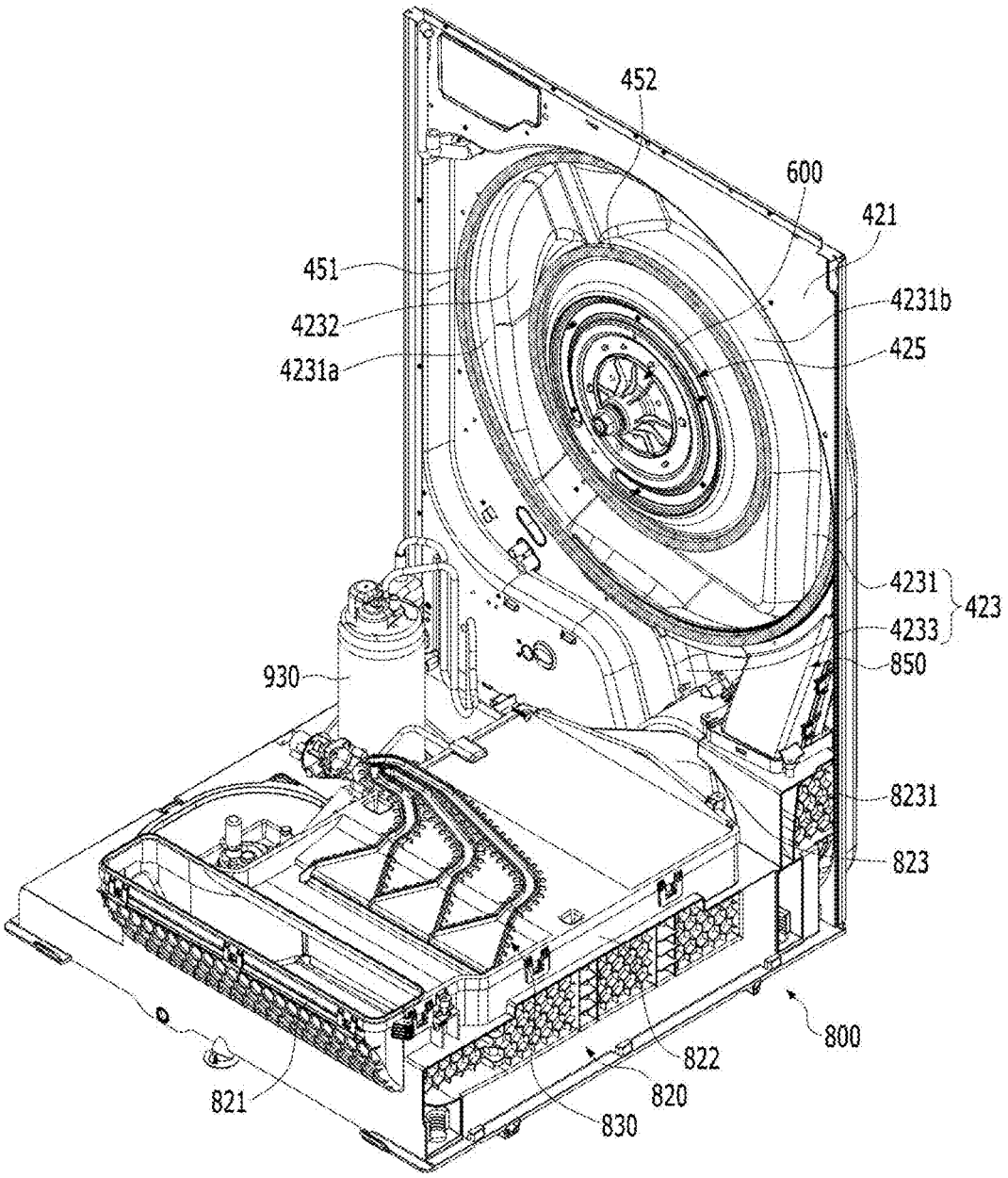
FIG. 8 is a view illustrating the coupling structure between a rear plate and a base of the laundry treating apparatus according to one embodiment of the present disclosure when viewed from the front.

FIG. 8 illustrates the base and the rear plate according to one embodiment of the present disclosure.

Referring to FIG. 8, the rear plate 420 may be located behind the drum. The rear plate 420 may guide hot air discharged from the circulation flow path part 820 to the drum. That is, the rear plate 420 may be located behind the drum, and may form a flow path so as to uniformly supply hot air to the entirety of the drum.

The rear plate 420 may include the rear panel 421 facing the rear drum surface and the duct 423 recessed backwards from the rear panel 421 so as to form the flow path. The duct 423 may be provided by pressing the rear panel 421 backwards. The duct 423 may be provided so as to accommodate a portion of the rear drum surface.

The duct 423 may include an inlet part 4233 located behind the circulation flow path part 820 and a flowing part 4231 located behind the drum. The flowing part 4231 may be provided so as to accommodate a part of the drum. The flowing part 4231 may accommodate a part of the drum so as to form a flow path behind the drum.

The flowing part 4231 may be provided in a ring shape so as to face the intake holes formed in the rear drum surface. The flowing part 4231 may be recessed from the rear panel 421. That is, the flowing part 4231 may have an open front surface, and may form the flow path together with the rear surface of the drum.

When the front surface of the flowing part 4231 is formed to be open, hot air moved to the flowing part 4231 may be moved directly to the drum without passing through any separate elements. Therefore, heat loss caused when hot air passes through other elements may be prevented. That is, drying efficiency may be increased by reducing heat loss of hot air.

The rear plate 420 may include the mounting part 425 provided radially inside the flowing part 4231. The mounting part 425 may provide a space in which the speed reducer 600 or the motor 500 is coupled thereto. That is, the rear plate 420 may include the mounting part 425 provided at the inner part thereof and the flowing part 4231 provided in a ring shape outside the mounting part 425 in the radial direction.

Specifically, the flowing part 4231 may include an outer circumferential portion 4231*a* surrounding the outer side of an inner space in which hot air flows. Further, the flowing part 4231 may include an inner circumferential portion 4231*b* surrounding the inner side of the inner space in which hot air flows. That is, the outer circumferential portion 4231*a* may form the outer circumference of the flowing part 4231, and the inner circumferential portion 4231*b* may form the inner circumference of the flowing part 4231.

Further, the flowing part 4231 may include a recessed surface 4232 forming the rear surface of the flow path along which hot air moves. The recessed surface 4232 may be provided so as to connect the outer circumferential portion 4231*a* and the inner circumferential portion 4231*b* to each other. That is, the inner circumferential portion 4231*b*, the outer circumferential portion 4231*a*, and the recessed surface 4232 may form the space in which the hot air discharged from the circulation flow path part 820 flows.

Further, the recessed surface 4232 may prevent hot air from leaking backwards, and may thus guide the hot air toward the drum. That is, the recessed surface 4232 may be the recessed surface of the flowing part 4231.

The inlet part 4233 may be located so as to face the circulation flow path part 820. The inlet part 4233 may be located so as to face the air blowing part 8231. The inlet part 4233 may be recessed backwards from the rear panel 421 so as to prevent interference with the air blowing part 8231. The upper portion of the inlet part 4233 may be connected to the flowing part 4231.

The laundry treating apparatus according to one embodiment of the present disclosure may include the connector 850 connected to the air blowing part 8231. The connector 850 may guide the hot air discharged from the air blowing part 8231 to the flowing part 4231. The connector 850 may form a flow path therein, and thereby, may guide the hot air discharged from the air blowing part 8231 to the flowing part 4231. That is, the connector 850 may form the flow path for connecting the air blowing part 8231 to the flowing part 4231. The connector 850 may be configured such that the cross-sectional area of the flow path formed therein gradually increases in a direction away from the air blowing part 8231.

The connector 850 may be located so as to face the inlet part 4233. The inlet part 4233 may be recessed backwards so as to prevent interference with the connector 850. Further, the upper end of the connector 850 may partition the flowing part 4231 and the inlet part 4233 from each other. That is, the hot air discharged from the connector 850 may be allowed to flow into the flowing part 4231, but may be prevented from flowing into the inlet part 4233.

The connector 850 may be provided so as to uniformly supply hot air to the flowing part 4231. The connector 850 may be configured such that the width thereof gradually increases in a direction away from the air blowing part 8231. The upper end of the connector 850 may be located along the extension line of the outer circumferential portion 4231*a* in the circumferential direction.

Therefore, the hot air discharged from the connector 850 may be uniformly supplied to the flowing part 4231, rather than moving to the inlet part 4233. The connector 850 may prevent the hot air from being concentrated on one side of the flowing part 4231, thus uniformly supplying the hot air to the inside of the drum. Therefore, laundry drying efficiency may be increased.

The connector 850 may be configured such that the width thereof gradually increases in the upstream direction, and thus the speed at which hot air moves along the connector 850 may decrease in the flowing direction of the hot air. That is, the connector 850 may function as a diffuser for controlling the speed of the hot air. The connector 850 may decrease the speed of the hot air so as to prevent the hot air from being intensively supplied to a specific region of the drum.

Due to the above-described shape of the connector 850, the inlet part 4233, which is provided so as to face the connector 850 and to prevent interference with the connector 850, may be configured such that the width thereof gradually increases in the direction away from the air blowing part 8231. The duct 423 may be generally shaped like "9" when viewed from the front, due to the shape of the inlet part 4233.

Since the drum is provided so as to rotate during the drying cycle, the drum may be spaced a designated distance apart from the flowing part 4231. Hot air may leak through such a space.

Therefore, the laundry treating apparatus may further include the sealing unit 450 to prevent hot air from leaking through the space between the drum and the flowing part 4231. The sealing unit 450 may be located along the circumference of the flowing part 4231.

The sealing unit 450 may include the first sealing member 451 provided along the outer circumference of the flowing part 4231. The first sealing member 451 may be provided between the drum and the outer circumference of the flowing part 4231. Further, the first sealing member 451 may be provided so as to be in contact with both the rear drum surface 220 and the rear plate 420, thereby more effectively preventing leakage of hot air.

The first sealing member 451 may be provided so as to be in contact with the front surface of the connector 850. Further, the first sealing member 451 may be provided so as to be in contact with the upper end of the connector 850. The connector 850 may form a flow path in which hot air flows together with the flowing part 4231. Therefore, the first sealing member 451 may be provided so as to be in contact with the connector 850, thereby preventing hot air from leaking through the gap between the drum and the connector 850.

The sealing unit 450 may include the second sealing member 452 provided along the inner circumference of the flowing part 4231. The second sealing member 452 may be provided between the drum and the inner circumference of the flowing part 4231. Further, the second sealing member 452 may be provided so as to be in contact with both the rear drum surface 220 and the rear plate 420. The second sealing member 452 may prevent hot air, flowing along the flowing part 4231, from leaking toward the mounting part 425.

Since the drum 200 rotates during operation of the laundry treating apparatus, the rear drum surface 220 continuously applies friction to the sealing unit 450. Therefore, it is desirable for the sealing unit 450 to be formed of a material that is capable of sealing the gap between the rear drum surface 220 and the flowing part 4231 without degradation of performance due to frictional force or frictional heat generated by rotation.

Figure 9:
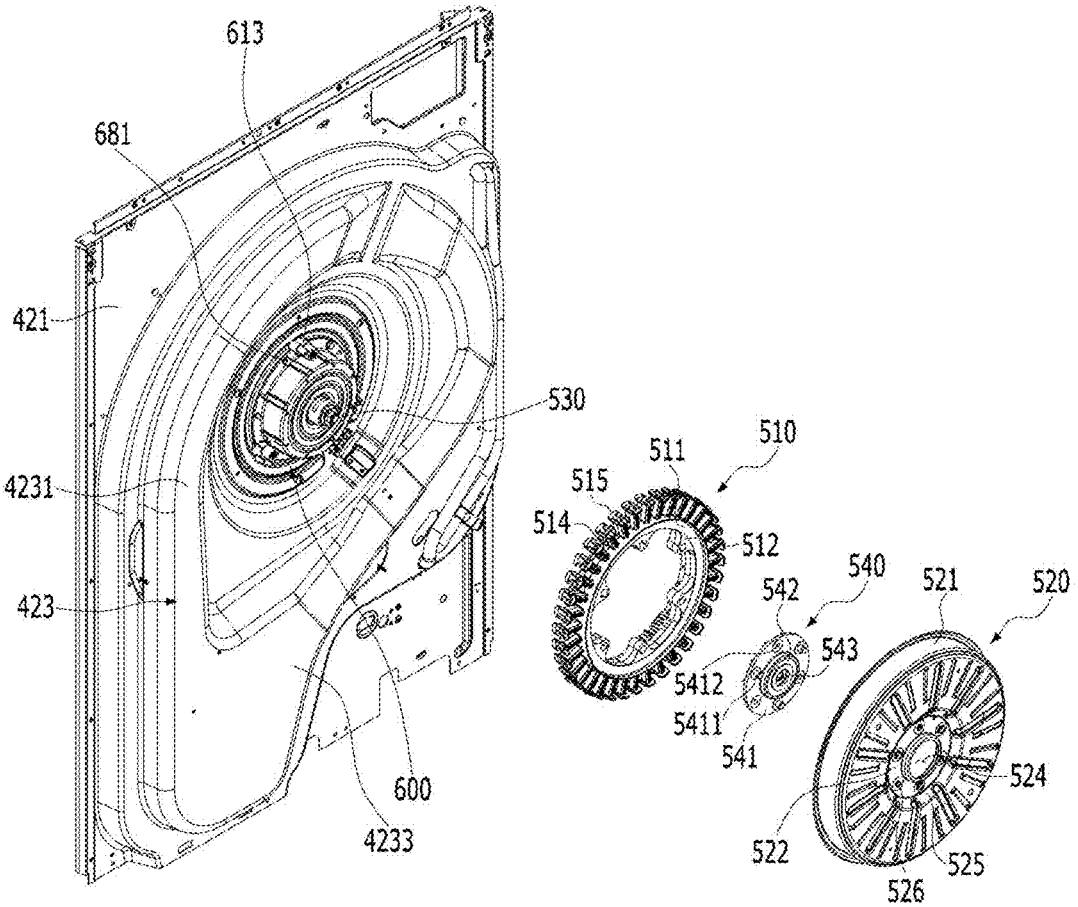
FIG. 9 is an exploded perspective view illustrating coupling of the speed reducer and a motor to the rear surface of the rear plate of the laundry treating apparatus according to one embodiment of the present disclosure.

FIG. 9 illustrates the coupling structure between the rear plate, and the speed reducer, and the motor according to one embodiment of the present disclosure.

Referring to FIG. 9, the speed reducer 600 may be supported by the rear plate 420, and the motor 500 may be coupled to the speed reducer 600. That is, the rear plate 420 may be provided so as to support both the speed reducer 600 and the motor 500.

The motor 500 for providing rotational power and the speed reducer 600 for reducing the power of the motor 500 and transmitting the reduced power to the drum may be located behind the rear plate 420.

The speed reducer 600 may be installed on the rear plate 420 so as to be located inside the duct 423. The speed reducer 600 may be located radially inside the flowing part 4231 so as to prevent interference with the flowing part 4231.

The gear assembly in the speed reducer 600 may be damaged by heat of hot air moving along the flowing part 4231. Therefore, the flowing part 4231 and the speed reducer 600 may be provided so as to be spaced a designated distance apart from each other.

The speed reducer 600 may be coupled to the rear plate 420 so as to penetrate the same. Therefore, the speed reducer 600 may be connected to the drum located in front of the rear plate 420.

The stator 510 may be coupled to the speed reducer 600. The stator 510 may be coupled to the speed reducer 600 so as to be spaced apart from the rear plate 420. Here, the speed reducer 600 may be located between the drum and the motor 500, and may support the drum and the motor 500 so that the drum and the motor 500 are spaced apart from the rear plate 420. That is, the speed reducer 600 may serve as a center of support of the drum and the motor 500.

The stator 510 may include a main body 511 provided in a ring shape, the fixing rib 512 extending from the inner circumferential surface of the main body 511 so as to be coupled to the stator coupler 613 of the speed reducer 600, teeth 514 extending from the outer circumferential surface of the main body 511 and arranged along the circumference of the main body 511 so that coils are wound thereon, and pole shoes 515 provided at the free ends of the teeth 514 so as to prevent the coils from being released from the teeth 514.

The rotor 520 may include a rotor body 521 provided in a hollow cylindrical shape. The rotor 520 may include an installation body 522 recessed forwards in the rear surface of the rotor body 521. Permanent magnets may be arranged along the inner circumferential surface of the rotor body 521.

The rotor 520 may be coupled to the drive shaft 530 so as to transmit the rotational power of the rotor 520 to the outside via the drive shaft 530. The drive shaft 530 may be connected to the rotor 520 via the washer 540.

Further, the motor 500 may include the washer 540 for supporting the drive shaft 530. The washer 540 may include the washer coupling body 541 coupled to the rotor 520. The washer coupling body 541 may be provided in a disk shape.

The washer 540 may include the accommodation body 542 accommodated in the rotor 520. The accommodation body 542 may be provided so as to protrude backwards from the washer coupling body 541. The washer 540 may include the shaft support hole 543 formed through the center of the accommodation body 542. The drive shaft 530 may be inserted into the shaft support hole 543 so as to be supported by the washer 540.

Further, the washer 540 may include the washer coupling holes 5412 formed through the washer coupling body 541. Further, the installation body 522 may include rotor coupling holes 526 provided at positions corresponding to the washer coupling holes 5412. That is, the washer 540 and the rotor 520 may be coupled to each other via coupling members penetrating both the washer coupling holes 5412 and the rotor coupling holes 526. That is, the washer 540 and the rotor 520 may be coupled to each other so as to rotate together.

Further, the washer 540 may include the washer coupling protrusions 5411 protruding backwards from the washer coupling body 541. Further, the installation body 522 may include washer protrusion accommodation holes 525 provided corresponding to the washer coupling protrusions 5411. The washer coupling protrusions 5411 may be inserted into the washer protrusion accommodation holes 525 so as to support coupling between the washer 540 and the rotor 520.

Further, the rotor 520 may include a rotor installation hole 524 formed through the center of the installation body 522. The rotor installation hole 524 may accommodate the accommodation body 542. Thereby, the washer 540 may be rotated together with the drive shaft 530 by the rotor 520, and may firmly support coupling between the drive shaft 530 and the rotor 520. Therefore, durability and reliability of the entirety of the motor 500 may be secured.

Figure 10:
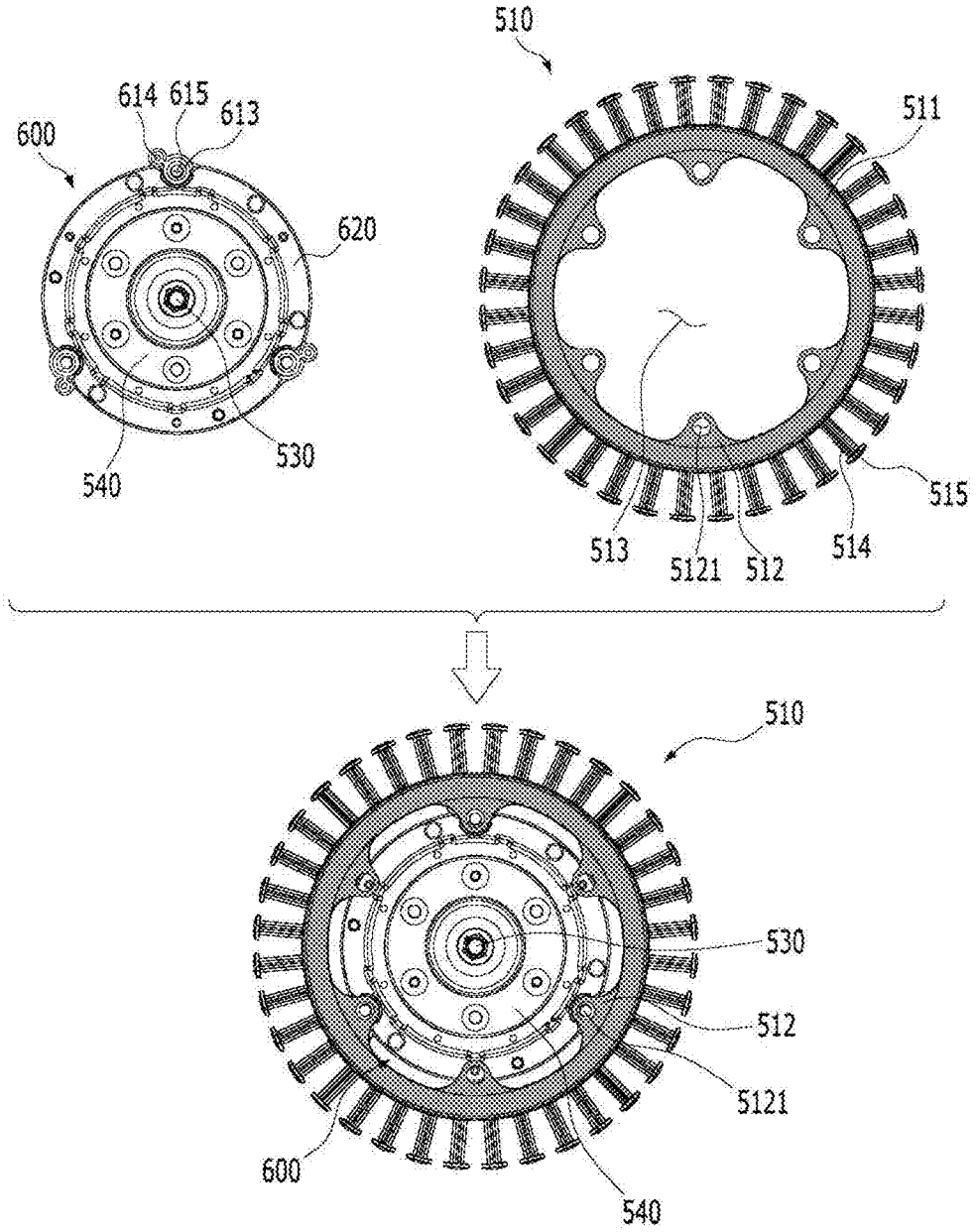
FIG. 10 is a view illustrating the coupling structure between the speed reducer and a stator of the laundry treating apparatus according to one embodiment of the present disclosure.

FIG. 10 is a rear view illustrating the coupling structure between the speed reducer and the stator according to one embodiment of the present disclosure.

The stator 510 may include the main body 511 fixed to the speed reducer 600 and provided in a ring shape, the fixing rib 512 extending from the inner circumferential surface of the main body 511 so as to be coupled to the stator fastening hole 615 in the speed reducer 600, the teeth 514 extending from the outer circumferential surface of the main body 511 and arranged along the circumference of the main body 511 so that coils are wound thereon, the pole shoes 515 provided at the free ends of the teeth 514 so as to prevent the coils from being released from the teeth 514, and a terminal (not shown) configured to perform control such that current is supplied to the coils.

The stator 510 may include an accommodation space 513 formed through the main body 511 and provided inside the main body 511. A plurality of fixing ribs 512 may be provided inside the main body 511 so as to be spaced apart from each other by a designated angle in the accommodation space 513, fixing rib holes 5121 may be provided in the fixing ribs 512 so that fixing members are installed therein, and thus the fixing rib holes 5121 and the stator fastening holes 615 in the speed reducer 600 may be coupled using the fixing members, such as pins.

When the stator 510 is directly coupled to the speed reducer 600, a part of the speed reducer 600 may be accommodated in the stator 510. Particularly, when the speed reducer 600 is accommodated in the stator 510, the overall thickness of the driving unit, including the speed reducer 600 and the motor 500, may be reduced, and thus the volume of the drum may be increased.

To this end, the speed reducer 600 may have a smaller diameter than the diameter of the main body 511. That is, the maximum diameter out of the diameters of the first housing 610 and the second housing 620 may be smaller than the diameter of the main body 511. Thereby, at least a part of the speed reducer 600 may be accommodated in the main body 511. However, the stator coupler 613 may extend so as to overlap the fixing rib 512 in the housing of the speed reducer 600. Thereby, the stator coupler 613 may be coupled to the fixing rib 512, and a portion of the first housing 610 and the second housing 620 may be located in the main body 511.

Figure 11:
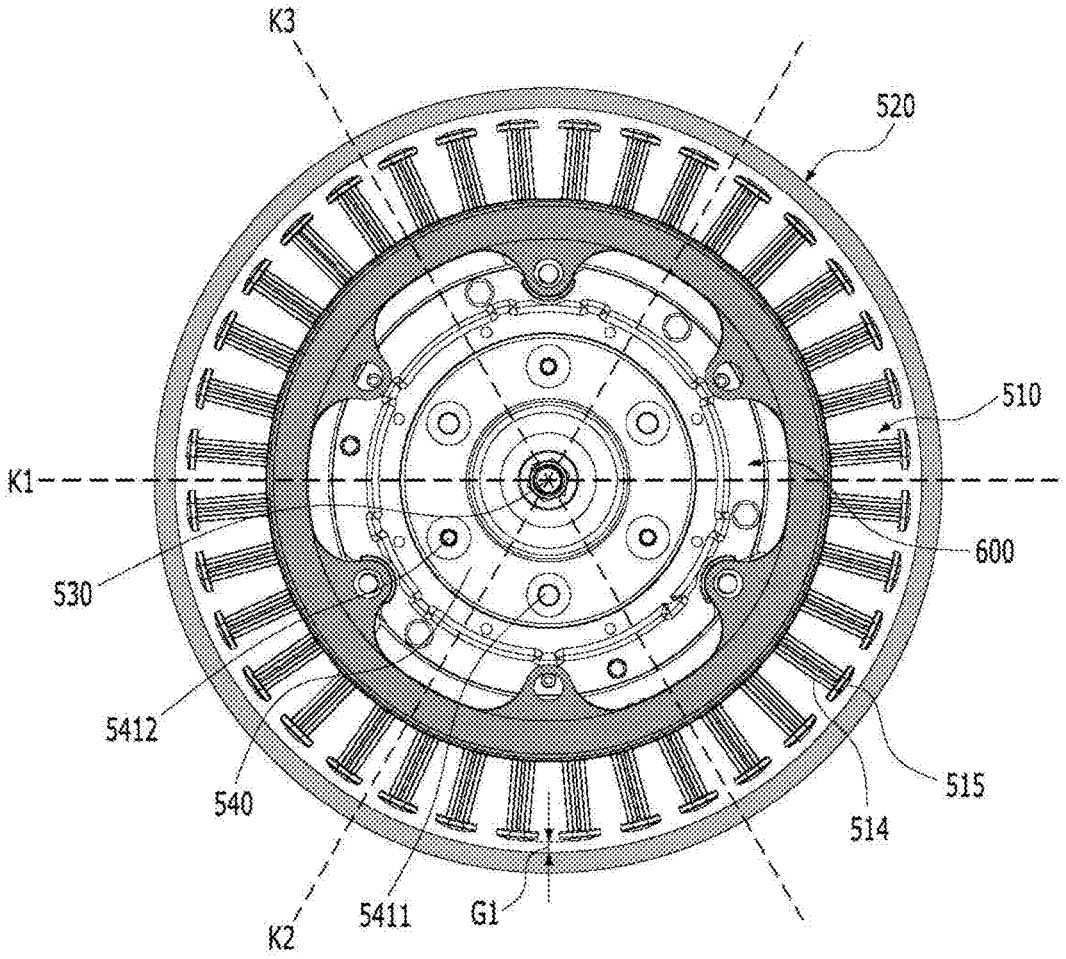
FIG. 11 is a view illustrating the coupling structure between the speed reducer and the motor of the laundry treating apparatus according to one embodiment of the present disclosure.

FIG. 11 illustrates coupling between the speed reducer and the motor according to one embodiment of the present disclosure.

The stator 510 may be coupled to the speed reducer 600. At least a portion of the speed reducer 600 may be accommodated in the main body 511 by coupling the stator 510 to the stator coupler 613 protruding outwards from the housing of the speed reducer 600. Thereby, the center of the main body 511, the drive shaft 530, and the center of the speed reducer 600 may always remain coaxial with one another.

The rotor 520 may be disposed so as to accommodate the stator 510 in the state in which the rotor 520 is spaced a designated distance apart from the pole shoes 515. Since the rotor 520 is fixed to the speed reducer 600, in which the drive shaft 530 is accommodated in the main body 511, the distance G1 between the rotor 520 and the stator 510 may be maintained constant.

Therefore, collision between the rotor 520 and the stator 510 or temporary torsional rotation of the rotor 520 on the stator 510 may be prevented, and thus generation of noise or unnecessary vibration may be prevented.

All of a first virtual diameter line K1 passing through the center of the speed reducer 600 and the center of the drive shaft 530, a second virtual diameter line K2 passing through the center of the main body 511, and a third virtual diameter line K3 passing through the center of the rotor 520 may be disposed at the center of rotation of the speed reducer 600.

Thereby, since the speed reducer 600 becomes the center of rotation of the drive shaft 530 and the stator 510 is directly fixed to the speed reducer 600, the driving shaft 530 may be prevented from being misaligned from the speed reducer 600. Accordingly, reliability of the speed reducer 600 may be secured.

Figure 12:
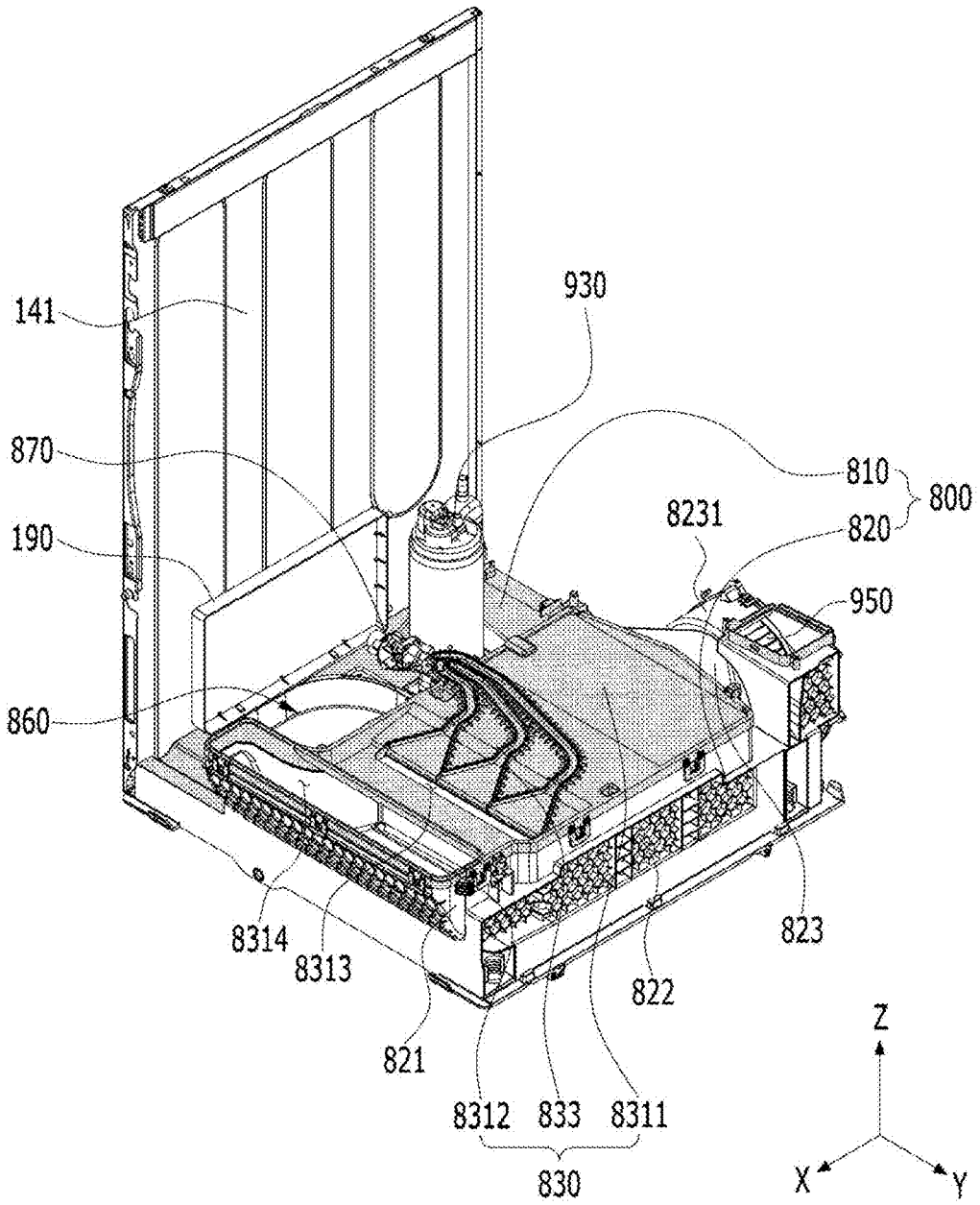
FIG. 12 is a view illustrating a base of the laundry treating apparatus according to one embodiment of the present disclosure.

FIG. 12 is a perspective view illustrating the base 800 of the laundry treating apparatus according to one embodiment of the present disclosure.

Referring to FIG. 12, the base 800 may include the circulation flow path part 820 provided on one side of the base 800 so as to circulate air in the drum. Further, a device installation part 810 providing a space in which elements necessary to operate the dryer are installed may be provided on the other side of the base 800. The device installation part 810 may be provided outside the circulation flow path part 820.

In the case of the conventional dryer, the circulation flow path part 820 is provided on the base 800, and the driving unit for driving the drum 200 is also installed on the base 800. Since the driving unit occupies the majority of the installation space on the base 800, the device installation part 810 formed in the space on the base 800 rather than the circulation flow path part 820 has a narrow space, and thus it is not easy to install other elements of the laundry treating apparatus in the device installation part 810.

However, in the laundry treating apparatus according to one embodiment of the present disclosure, the motor 500 for rotating the drum 200 may be spaced apart from the base 800 and may be disposed behind the drum 200, and thus the space on the base 800 in which the driving unit was conventionally installed may be used in various ways.

The compressor 930 for compressing a refrigerant necessary for heat exchange may be installed in the device installation part 810. Further, the base 800 may include a water collection part 860 provided so as to be spaced apart from the compressor 930 and configured to collect condensed water generated by the circulation flow path part 820. A control panel 190 configured to control the compressor 930 and the motor may be installed on the device installation part 810.

The control panel 190 may be installed on the base 800 so as to be firmly supported thereby. Further, connection wires for connecting the control panel 190 to the elements controlled by the control panel 190 may also be firmly supported by the base 800.

As another example, the water collection part 860 may be disposed so as to overlap the compressor 930 in the forward-backward direction, rather than being disposed between the compressor 930 and the circulation flow path part 820. The water collection part 860 may be located in the space in which the motor was conventionally disposed, and thus the volume of the water collection part 860 may be increased. When the volume of the water collection part 860 is increased, the frequency with which the user removes the collected condensed water may be reduced, and thus user convenience may be improved.

The side panels forming the side surfaces of the cabinet may be coupled to the side surfaces of the base 800. The side panels may include the left panel 141 and the right panel (not shown). The control panel 190 may be installed on the device installation part 810 at a position close to any one of the side panels.

The control panel 190 may control the overall operation of the laundry treating apparatus. Therefore, the control panel 190 may often be checked or repaired.

When the control panel 190 is provided close to left panel 141, the user may reach the control panel 190 only by removing the left panel 141. Therefore, ease of maintenance may be increased.

When the left panel 141 is removed, the user may easily reach various elements, such as the compressor 930 and the control panel 190, and thus the left panel 141 may be referred to as a service panel.

FIG. 12 illustrates the state in which the device installation part 810 is located at the left side of the base 800 and thus, when the left panel 141 is removed, the user is capable of reaching the control panel 190. However, the present disclosure is not limited thereto, and, in the case in which the circulation flow path part 820 is formed at the left side of the base 800 and the device installation part 810 is formed at the right side of the base 800, the control panel 190 or the compressor 930 may be repaired or checked by removing the right panel (not shown).

The circulation flow path part 820 may further include the duct cover 830 located above the circulation flow path part 820 so as to form the flow path in which the air discharged from the drum flows. The duct cover 830 may be coupled to the open upper surface of the circulation flow path part 820.

The upper surfaces of the inflow duct 821 and the transfer duct 822 may be open so that air enters and exits the inflow duct 821 and the transfer duct 822 through the open upper surfaces thereof. The duct cover 830 may shield the open upper surface of the transfer duct 822. Therefore, the duct cover 830 may allow air in the drum to enter the inflow duct 821, and may prevent the air having entered the inflow duct 821 from leaking through the open upper surface of the transfer duct 822. That is, the duct cover 830 may form one surface of the flow path guiding the air having entered the inflow duct 821 to the discharge duct 823.

The discharge duct 823 may include the air blowing part 8231 configured to discharge air to the outside of the discharge duct 823. The air blowing part 8231 may discharge air having passed through the inflow duct 821 and the transfer duct 822 to the outside of the discharge duct 823.

The air blowing part 8231 may provide a space in which the circulation flow path fan 950 configured to circulate air in the drum is installed. The circulation flow path fan 950 may forcibly circulate air to increase the circulation rate of air, and may thus increase the drying rate of laundry and shorten a time taken to dry the laundry.

When the circulation flow path fan 950 rotates, air may be discharged through the opening formed in the upper part of the air blowing part 8231. The air discharged from the air blowing part 8231 may again enter the drum so as to be used to dry laundry in the drum.

Various types of fans may be applied as the circulation flow path fan 950. For example, a sirocco fan may be applied so as to enable air to enter in the direction of a rotating shaft and then to discharge air in the radial direction. However, the present disclosure is not limited thereto, and various fans may be used to generate air flow depending on the purposes of design.

The duct cover 830 may include a communication cover body 8312 coupled to the upper part of the inflow duct 821 and a shield cover body 8311 coupled to the upper part of the transfer duct 822. The shield cover body 8311 may extend from the communication cover body 8312, and the shield cover body 8311 may be provided integrally with the communication cover body 8312.

The communication cover body 8312 may include an inflow communication hole 8314, through which the drum and the inflow duct 821 communicate with each other. The inflow communication hole 8314 may guide air discharged from the drum to the inflow duct 821 even when the communication cover body 8312 is coupled to the inflow duct 821.

Further, the shield cover body 8311 may shield the upper surface of the transfer duct 822, and thus air having entered the inflow duct 821 may be guided to the discharge duct 823 without leaking to the outside of the circulation flow path part 820 through the transfer duct 822.

The shield cover body 8311 may include a washing flow path part 833 provided on the upper surface thereof such that water may flow along the washing flow path part 833. The washing flow path part 833 may receive water, and may spray water toward the first heat exchanger located under the duct cover 830.

A cover through-hole 8313 vertically formed through the shield cover body 8311 may be provided downstream of the washing flow path part 833. Water moving along the washing flow path part 833 may be sprayed to a region below the shield cover body 8311 through the cover through-hole 8313.

The first heat exchanger configured to dehumidify air discharged from the drum may be provided under the cover through-hole 8313. Therefore, water having passed through the cover through-hole 8313 may be sprayed toward the first heat exchanger so as to wash the first heat exchanger.

A nozzle cover may be coupled to the upper part of the washing flow path part 833. The nozzle cover may shield the open upper surface of the washing flow path part 833. The nozzle cover may prevent air moving along the transfer duct 822 from leaking through the cover through-hole 8313. Further, the nozzle cover may shield the upper surface of the washing flow path part 833 so as to prevent water moving along the washing flow path part 833 from scattering to the outside.

In contrast, the circulation flow path part 820 may further include a duct filter (not shown) provided in front of the first heat exchanger and configured to remove foreign substances from air having passed through the inflow duct 821. The duct filter (not shown) may be disposed between the inflow duct 821 and the first heat exchanger so as to prevent foreign substances from being accumulated on the front surface of the first heat exchanger, and may thus improve drying efficiency and heat exchange efficiency of the first heat exchanger.

When foreign substances are accumulated on the duct filter (not shown), circulation of air passing through the inflow duct 821 and the transfer duct 822 may be impeded. In order to solve such a problem, the washing flow path part 833 may spray water toward the duct filter (not shown) so as to remove the foreign substances accumulated on the duct filter (not shown) using water pressure.

However, for convenience of description, the laundry treating apparatus in which the duct filter (not shown) is omitted will be described below.

The laundry treating apparatus may further include a flow path switch valve 870, which is coupled to the washing flow path part 833 so as to supply water necessary for washing to the washing flow path part 833. The flow path switch valve 870 may be connected to a water supply source, and may thus selectively supply water to the washing flow path part 833. The water supply source may include the water collection part 860.

The flow path switch valve 870 may be connected to the water collection part 860 via a hose, and may guide water collected in the water collection part 860 to the washing flow path part 833. The flow path switch valve 870 may guide water collected in the water collection part 860 to the water storage tank 120 (refer to FIG. 3).

Figure 13:
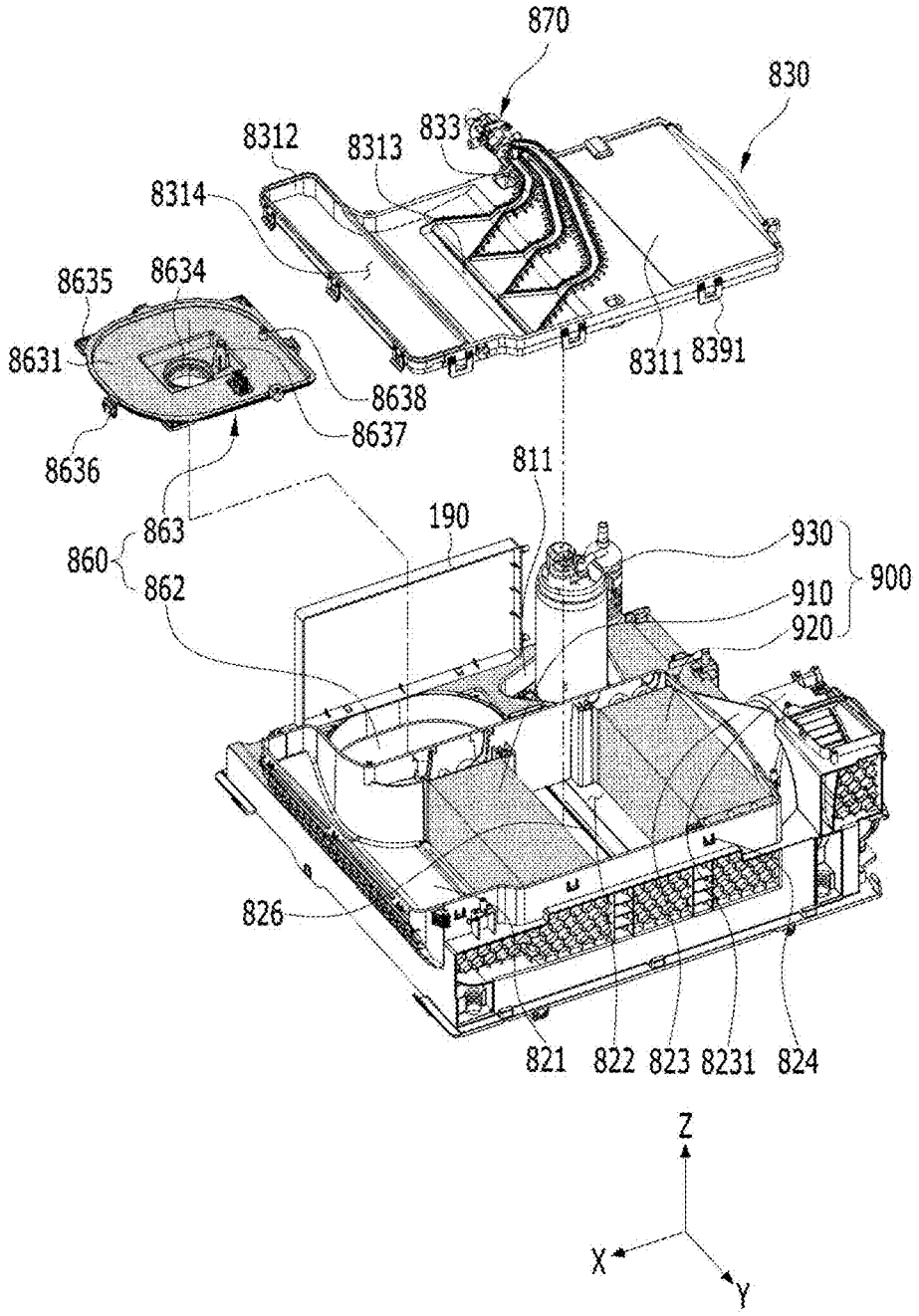
FIG. 13 is an exploded perspective view illustrating a water collection cover and a duct cover coupled to the base of the laundry treating apparatus according to one embodiment of the present disclosure.

FIG. 13 is an exploded perspective view illustrating the duct cover and a water collection cover separated from the base of FIG. 12.

Referring to FIG. 13, the first heat exchanger 910 and the second heat exchanger 920 configured to sequentially exchange heat with air in the drum 200 may be installed under the duct cover 830 so as to be spaced apart from each other in the forward-backward direction. Air in the drum 200 having entered the inflow duct 821 may be dehumidified through heat exchange by the first heat exchanger 910, and the dehumidified air may be heated through heat exchange by the second heat exchanger 920. The heated air may pass through the discharge duct 823, and may be supplied again to the inside of the drum 200.

The circulation flow path part 820 may further include a water cover 826 provided between the first heat exchanger 910 and the bottom surface of the transfer duct 822. The water cover 826 may be provided so as to be supported by the transfer duct 822.

The water cover 826 may be located under the first heat exchanger 910, and may be provided so as to support the lower surface of the first heat exchanger 910. The water cover 826 may support the first heat exchanger 910 so that the first heat exchanger 910 is spaced apart from the bottom surface of the transfer duct 822.

The first heat exchanger 910 may produce condensed water through condensation of wet steam discharged from the drum 200. When the condensed water remains in the laundry treating apparatus without being discharged to the outside, odors may be generated, or drying efficiency may be reduced. Therefore, it is necessary to collect the condensed water so as to be spaced apart from the first heat exchanger 910 or the second heat exchanger 920 and to discharge the collected condensed water.

The water cover 826 may support the first heat exchanger 910 so that the first heat exchanger 910 is spaced apart from the bottom surface of the transfer duct 822, and may thus form a space between the bottom surface of the transfer duct 822 and the water cover 826. Condensed water may flow into the water collection part 860 along the space formed by the water cover 826.

The air dehumidified by the first heat exchanger 910 is heated by the second heat exchanger 920. Air passing through the second heat exchanger 920 has a small moisture content and has an increased amount of saturated water vapor as the air is heated, and thus it is difficult to produce condensed water. Therefore, the water cover 826 may be located on the bottom surface of the transfer duct 822 adjacent to the first heat exchanger 910, and may be spaced apart from the second heat exchanger 920.

FIG. 13 illustrates a part of the upper surface of the water cover 826, and thus a description of the shape of the flow path formed by the water cover 826 and the detailed structure of the water cover 826 will be made later.

The base 800 may include the water collection part 860 provided so as to be spaced apart from the circulation flow path part 820 in order to collect condensed water generated in the circulation flow path part 820. The water collection part 860 may include a water collection body 862 forming a space in which the condensed water is collected.

The water collection part 860 may further include a water collection cover 863 configured to shield the open upper surface of the water collection body 862. Elements vulnerable to moisture may be installed around the water collection part 860. Therefore, it is necessary to prevent the condensed water collected in the water collection body 862 from scattering to the outside. The water collection cover 863 may be coupled to the water collection body 862, and may thus prevent the condensed water from leaking through the upper surface of the water collection body 862.

Further, the water collection part 860 may include a pump configured to move the condensed water collected in the water collection body 862 to the outside. In order to enable the pump to function properly, the inside of the water collection body 862 should be sufficiently sealed. The water collection cover 863 may seal the inside of the water collection body 862 so as to increase reliability of the pump.

The water collection cover 863 may include a water collection cover body 8631 forming the shield surface of the water collection body 862. Further, the water collection cover 863 may include at least one of support bodies 8635 provided so as to support the water collection cover body 8631 or fastening hooks 8636 provided so as to couple the water collection cover body 8631 to the water collection body 862. The water collection cover body 8631 may extend from the pump installation part, and may be detachably provided on the base or the water collection body 862 so as to shield or seal the space between the circumference of the pump 861 and the inner circumferential surface of the water collection body 862.

The support bodies 8635 may protrude from the circumference of the water collection cover body 8631, and may be seated on the base. The fastening hooks 8636 may protrude from the water collection cover body 8631. The fastening hooks 8636 may firmly fix the water collection cover body 8631 to the water collection body 862. The fastening hooks 8636 may be inserted into and fixed to hook holes, which will be described later.

The condensed water generated in the circulation flow path part 820 is collected in the water collection body 862. The upper surface of the water collection body 862 is open, and thus the condensed water may scatter to the outside. However, since the water collection body 862 is located adjacent to the control panel 190 and the compressor 930, the condensed water scattering to the outside of the water collection body 862 may cause failure of these devices.

The water collection cover 863 may shield the open upper surface of the water collection body 862 using the water collection cover body 8631 so as to prevent the condensed water from scattering, and the support bodies 8635 and the fastening hooks 8636 may firmly fix the water collection cover body 8631 to the water collection body 862. Therefore, failure of the devices due to scattering of the condensed water may be prevented.

Further, the water collection cover 863 may include a pump installation part 8634, which is provided in the water collection cover body 8631 for installation of the pump therein. The pump installation part 8634 may be provided as a recess depressed in the water collection cover body 8631 so as to accommodate a part of the pump 861, or may be provided as a hole formed through the water collection cover body 8631 so as to fix the outer circumferential surface of the pump 861.

Further, the water collection cover 863 may include a drain flow path 8637, which protrudes upwards from the water collection cover body 8631 and is provided in the shape of a pipe that enables the inside and the outside of the water collection body 862 to communicate with each other therethrough.

The pump for moving the condensed water collected in the water collection body 862 to the outside of the water collection body 862 may be installed in the pump installation part 8634. When the pump operates, the condensed water collected in the water collection body 862 may be discharged through the drain flow path 8637.

A hose may be connected to the drain flow path 8637 so as to guide the condensed water discharged therefrom to the outside of the water collection body 862. One end of the hose may be coupled to the drain flow path 8637, and the other end of the hose may be connected to the flow path switch valve 870. However, the present disclosure is not limited thereto, and the other end of the hose may be located outside the cabinet so as to directly discharge the condensed water to the outside of the cabinet. The other end of the hose may be connected to the water storage tank 120 (refer to FIG. 3) located in the upper part of the cabinet so as to guide the condensed water collected in the water collection body 862 to the water storage tank 120.

The water collection cover 863 may further include a return flow path 8638, which is spaced apart from the drain flow path 8637 and enables the inside and the outside of the water collection body 862 to communicate with each other therethrough. The return flow path 8638 may be configured such that the water collection body 862 and the water storage tank communicate with each other therethrough. The return flow path 8638 may guide water in the water storage tank again to the water collection body 862.

The return flow path 8638 may be connected to the water storage tank 120 (refer to FIG. 3) formed in the upper part of the cabinet via a hose. In order to prevent the water storage tank 120 from overflowing with water, when the water storage tank 120 is completely filled with water, the water stored in the water storage tank 120 may be moved to the water collection body 862 through the hose connecting the return flow path 8638 to the water storage tank 120. Therefore, the frequency with which the user directly removes the water may be reduced, and thus user convenience may be improved.

The flow path switch valve 870 configured to switch the flow path along which the condensed water collected in the water collection part 860 moves may be further provided.

The pump may be connected to the flow path switch valve 870 through the hose. Water stored in the water collection body 862 may be moved to the flow path switch valve 870 by the pump. The flow path switch valve 870 may guide the moved water along various paths.

The flow path switch valve 870 may be connected to the washing flow path part 833 so as to guide the water to the washing flow path part 833. The water guided to the washing flow path part 833 may be used to wash the first heat exchanger.

Further, the flow path switch valve 870 may be connected to the water storage tank 120 by the hose so as to guide condensed water moved from the water collection body 862 to the water storage tank 120. The user may directly drain the water storage tank 120 by withdrawing the storage tank 120 in which the condensed water is stored.

The flow path switch valve 870 may be controlled by the control panel 190, may be variably operated depending on a point in time of operation of the laundry treating apparatus. For example, when operation of the first heat exchanger 910 is finished during the drying cycle, the control panel 190 may control the flow path switch valve 870 so as to guide the condensed water to the washing flow path part 833. Further, at a point in time when washing of the first heat exchanger 910 is terminated, the control panel 190 may control the flow path switch valve 870 so as to guide the condensed water to the water storage tank 120.

As described above, in order to normally operate the pump, the inside of the space from which water is drained by the pump may be sealed. The water collection cover 863 may be firmly coupled to the water collection body 862 using the support bodies 8635 and the fastening hooks 8636, and may thus easily seal the space in which the condensed water is stored. Thereby, reliability in operation of the pump may be improved. A sealing member may be additionally provided on the contact surface between the water collection cover 863 and the water collection body 862 so as to improve space sealability.

The water collection cover 863 provided to seal the inside of the water collection body 862 may be detachably provided on the water collection body 862. Foreign substances, such as lint included in the condensed water generated by the first heat exchanger 910, may enter the water collection body 862. When large particulate foreign substances enter the water collection body 862, the foreign substances may disturb operation of the pump.

Therefore, in order to remove foreign substances having entered the water collection body 862 as needed, it is necessary to release the water collection cover 863 from the water collection body 862. Therefore, the water collection cover 863 may be detachably provided on the water collection body 862. Here, the water collection cover 863 may be easily released from the water collection body 862 using the fastening hooks 8636.

That is, in the general service environment, the water collection cover 863 may firmly shield the open upper surface of the water collection body 862 using the support bodies 8635 and the fastening hooks 8636, thus being capable of preventing the condensed water from scattering to the outside.

On the other hand, when it is necessary to release the water collection cover 863 from the water collection body 862 so as to remove foreign substances accumulated in the water collection body 862, the water collection cover 863 may be easily released from the water collection body 862 using the fastening hooks 8636.

The duct cover 830 may include cover mounting hooks 8391 formed along the circumference of the duct cover 830, and the circulation flow path part 820 may include duct protrusions 824 protruding along the circumferential of the circulation flow path part 820 and provided to be fastened to the cover mounting hooks 8391.

The duct cover 830 may be coupled to the circulation flow path part 820 by fastening the duct protrusions 824 to the cover mounting hooks 8391. That is, the duct cover 830 may be firmly coupled to the circulation flow path part 820 by fastening the duct protrusions 824 to the cover mounting hooks 8391 in the state in which the duct cover 830 is placed along the circumferences of the inflow duct 821 and the transfer duct 822.

A sealing member may be additionally provided on the contact surface between the duct cover 830 and the circulation flow path part 820 so as to prevent air in the circulation flow path part 820 from leaking to the outside.

Figure 14B:
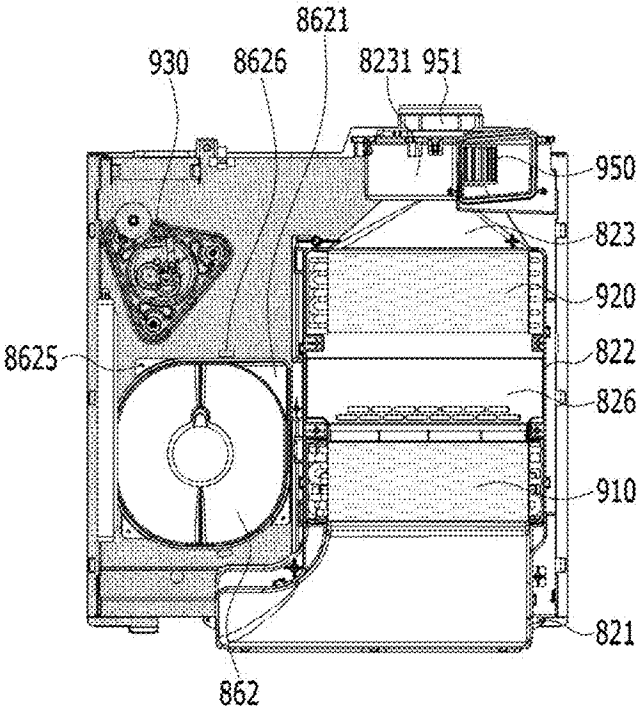
FIGS. 14A and 14B are top views of the base of the laundry treating apparatus according to one embodiment of the present disclosure.
Figure 14B:
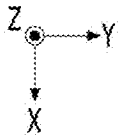
Figure 14A:
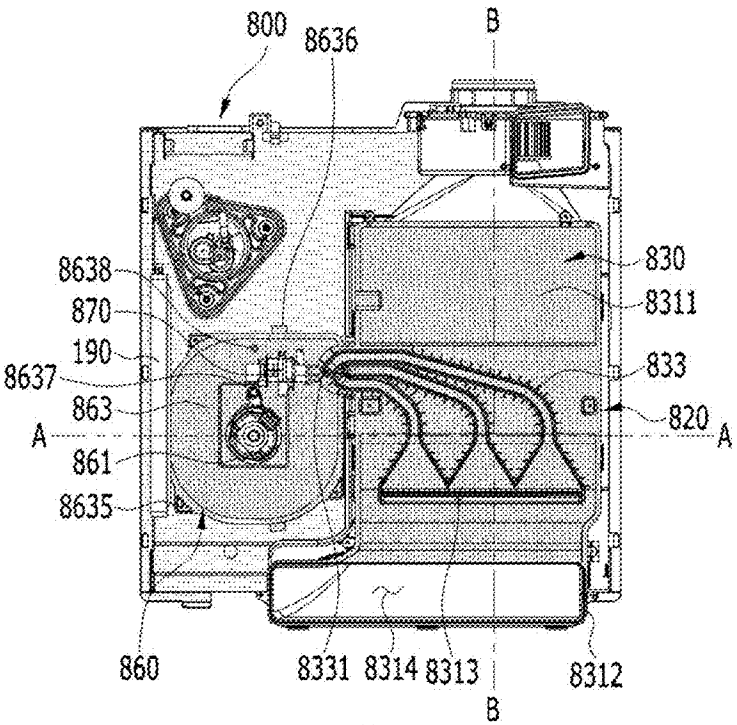

FIGS. 14A and 14B illustrate the base of the laundry treating apparatus of the present disclosure.

FIG. 14A is a top view of the base to which the above-described water collection cover and the duct cover are coupled. FIG. 14B is a top view of the base from which the water collection cover and the duct cover are separated.

The conventional dryer includes a motor configured to generate power to rotate the drum, and the motor is provided in the space in which the water collection part 860 shown in the drawings is located. The motor has a structure which rotates the drum using a pulley or a belt. Further, the water collection body configured to store condensed water is disposed between the compressor 930 and the circulation flow path part 820 due to the limit of the physical space. Therefore, the amount of condensed water accommodated in the water collection body is small, and thus the frequency with which the user is required to remove the condensed water stored in a water storage tank may be increased.

Further, in the conventional dryer, a space for installation of the control panel 190 on the base 800 is not secured due to the above-described disposition of the motor. Therefore, the control panel 190 is not supported by the base 800 and is disposed in the upper part of the cabinet, and thus the distances between the control box and elements requiring control by the control panel 190 are increased.

In addition, as control wires for connecting the control panel 190 to other elements, such as the motor, are increased, noise of the laundry treating apparatus is increased. Further, the control wires may interfere with the drum.

However, in the laundry treating apparatus according to the present disclosure, the motor 500 is disposed behind the drum 200 so as to be spaced apart from the base 800, the water collection part 860 configured to store condensed water may be disposed in the space in which the conventional motor 500 was mounted, and the control panel 190 may also be disposed in the corresponding space.

Further, the control panel 190 mounted on the base 800 may be stably connected to other elements, and may prevent problems, such as short circuit of control wires connected to the control panel 190 due to interference. In addition, the base 800 may include a control box installation part 813 (refer to FIG. 16), which will be described later, and thus the control panel 190 may be more firmly supported by the base 800.

The driving unit is disposed behind the drum 200 so as to be spaced apart from and separate from the base 800. That is, since the driving unit is disposed above the base 800, a space corresponding to the space necessary for installation of the driving unit may be further secured in the base 800.

Therefore, the base 800 of the laundry treating apparatus according to the present disclosure may increase the capacity of the water collection body 862 for storing condensed water, and thus a larger amount of condensed water may be stored in the water collection body 862. Therefore, a larger amount of water may be used to wash the first heat exchanger 910, thus making it possible to more effectively wash the first heat exchanger 910. Further, the amount of condensed water accommodated in the water collection body 862 is increased, and thus the frequency with which the user is required to empty the water storage tank 120 in order to remove the condensed water may be reduced. That is, user convenience may be improved.

Referring to FIG. 14A, the water collection part 860 may be increased in volume, and may thus be disposed so as to be parallel to a compressor installation part 811 in the direction in which the circulation flow path part 820 extends but not to overlap the compressor installation part 811 in the width direction of the circulation flow path part 820. Since the volume of the water collection body 862 is increased, the water collection part 860 may store a larger amount of condensed water. Accordingly, the frequency with which the user removes the condensed water may be reduced. As a result, user convenience may be improved.

The water collection part 860 may at least partially overlap the compressor installation part 811 in the forward-backward direction, but may not overlap the compressor installation part 811 in the leftward-rightward direction. The water collection part 860 may not share the space between the cabinet and the circulation flow path part 820 in the width direction with the compressor installation part 811.

Consequently, the water collection part 860 may be provided such that one side thereof faces the circulation flow path part 820, and may be expanded such that the other side thereof faces the side panels of the cabinet.

That is, the water collection part 860 may utilize the majority of the region of the base 800 that is located between the cabinet and the circulation flow path part 820.

The width of the inflow duct 821 may be formed to be larger than the width of the transfer duct 822. Therefore, one end of the inflow duct 821 may be disposed parallel to the transfer duct 822, and the other end of the inflow duct 821 may extend so as to protrude further than the side surface of the transfer duct 822 toward the water collection part 860, the side panels 140 of the cabinet, or the control panel 190.

Accordingly, at least a portion of the water collection part 860 may overlap the inflow duct 821 in the forward-backward direction. A portion of the water collection part 860 may overlap the inflow duct 821 in the forward-backward direction, and the remaining portion of the water collection part 860 may not overlap the inflow duct 821 in the forward-backward direction.

Consequently, the water collection part 860 may be disposed between the inflow duct 821 and the compressor installation part 811. The control panel 190 may be disposed at one side of the water collection part 860 so as to face the side panels 140 of the cabinet.

It can be considered that the water collection part 860 is disposed between the control panel 190 and the circulation flow path part 820. The water collection part 860 may be provided such that one side thereof faces the circulation flow path part 820 and the other side thereof faces the control panel 190.

The area of the water collection part 860 may be formed to be larger than the area of the compressor 910 or the area of the compressor installation part 811. The area of the water collection part 860 may be increased so as to be larger than the area of the pump 861. The area or diameter of the pump 861 may be formed to be smaller than the area of the compressor 910 or the area of the compressor installation part 811.

The water collection body 862 may be formed so as to be depressed in the base 800 in an area larger than the area of the pump 861. Accordingly, the water collection body 862 may secure, along the circumference of the pump 861, space in which to store the water or a flow path along which the water flows.

Since the inner circumferential surface of the water collection body 862 is spaced apart from the pump 861, the shape of the inner circumferential surface of the water collection body 862 and the shape of the outer circumferential surface of the pump 861 may differ from each other.

The water collection part 860 may be disposed between the opening 111 in the cabinet and the compressor installation part 811.

The pump 861 is installed in the water collection part 860, and thus it can be considered that the water collection part 860 overlaps the pump 861 and the compressor 930 in the direction in which the circulation flow path part 820 extends.

The width of the circulation flow path part 820 may be formed to be larger than half the width of the base 800, and thus the width of the water collection part 860 may be formed to be larger than the width of the compressor installation part 811.

The length of the water collection part 860 in the forward-backward direction may be formed to be longer than the length of the compressor installation part 811 in the forward-backward direction.

The area of the control panel 190 may be formed to be greater or wider than the diameter of the water collection part 860.

Therefore, the control panel 190 may be disposed so as to overlap at least one of the water collection part 860 or the compressor installation part 811 in the width direction.

The control panel 190 may be disposed between one end of the water collection part 860 and the other end of the compressor installation part 811. For example, the control panel 190 may be disposed between the front side of the water collection part 860 and the rear side of the compressor installation part 811.

The length of the water collection part 860 in the forward-backward direction may be formed to be shorter than the length of the control panel 190 in the forward-backward direction.

The duct cover 830 may be coupled to the upper portion of the circulation flow path part 820, and the washing flow path part 833 may be formed on the upper surface of the duct cover 830. The cover through-hole 8313 may be formed at the downstream region of the washing flow path part 833 so as to spray water flowing along the washing flow path part 833 toward the first heat exchanger.

Although not shown in the drawings, the nozzle cover configured to shield the open upper surface of the washing flow path part 833 so as to prevent water from scattering may be coupled to the upper surface of the washing flow path part 833.

The flow path switch valve 870 may be coupled to the upstream end of the washing flow path part 833. The flow path switch valve 870 may selectively supply water to a plurality of flow paths formed in the washing flow path part 833. The flow path switch valve 870 may receive water supplied from an external water supply source, and may then supply the received water to the washing flow path part 833.

Further, condensed water generated during the drying cycle may be used to wash the first heat exchanger 910. The water collection cover 863 may be coupled to the upper surface of the water collection body 862 in order to prevent water in the water collection body 862 from scattering to the outside. Since the water collection body 862 is formed to be larger than the pump 861, the water collection cover 863 may be formed so as to seal the space between the pump 861 and the water collection body 862.

Here, the term "sealing" means that the inner pressure of the water collection cover 863 is maintained different from the outer pressure so that the pump 861 is capable of discharging water stored in the water collection body 862.

The pump 861 may include a pump housing and an impeller provided in the pump housing so as to suction and discharge water.

Since the area of the water collection body 862 is formed to be larger than the area of the pump 861, the water collection cover 863 may be coupled to the water collection body 862 or the base 800 so as to fix the pump 861 to the water collection body 862.

The area of the water collection cover 863 may be formed so as to correspond to the area of the water collection body 862, and may thus be larger than the area of the pump 861.

The pump 861 configured to move water to the flow path switch valve 870 may be provided to pass through the water collection cover 863, and may be installed in the water collection body 862. Although not shown in the drawings, the pump 861 may be connected to the flow path switch valve 870 through a connection pipe, such as the hose.

When it is necessary to wash the first heat exchanger 910, the pump 861 may move condensed water stored in the water collection body 862 to the flow path switch valve 870, and the flow path switch valve 870 may supply the condensed water to the washing flow path part 833 so as to wash the first heat exchanger 910.

FIG. 14B illustrates the base 800 from which the water collection cover 863 and the duct cover 830 are separated. The water collection body 862 may include cover support planes 8625 recessed from the upper surface of the base 800 so that the support bodies 8635 of the water collection cover 863 are placed thereon. Further, the water collection body 862 may include the hook holes 8626 provided such that the fastening hooks 8636 of the water collection cover 863 are inserted thereinto.

The support bodies 8635 may be placed on the cover support planes 8625, and may be firmly fixed thereto using separate fastening members. Further, the fastening hooks 8636 may be inserted into the hook holes 8626. The fastening hooks 8636 may be formed of an elastic material, and may be inserted into the hook holes 8626 so as to be firmly supported thereby.

The control panel 190 configured to control operation of the laundry treating apparatus may be installed at the left side of the water collection part 860. Further, the compressor 930, which forms the heat exchange unit 900 together with the first heat exchanger 910 and the second heat exchanger 920 so as to compress the refrigerant exchanging heat with air in the drum, may be installed behind the water collection part 860.

The water collection cover 863 may be firmly coupled to the upper surface of the water collection body 862, and may prevent condensed water collected in the water collection body 862 from scattering toward the control panel 190, the compressor 930 or the like. Therefore, failure of such an element by the condensed water may be prevented.

The first heat exchanger 910 and the second heat exchanger 920 may be accommodated and disposed in the circulation flow path part 820 from which the duct cover 830 is removed, in the forward-backward direction. The water cover 826 configured to support the first heat exchanger 910 may be provided under the first heat exchanger 910. The detailed installed structure of the water cover 826 and the shape thereof will be described later.

Figure 15:
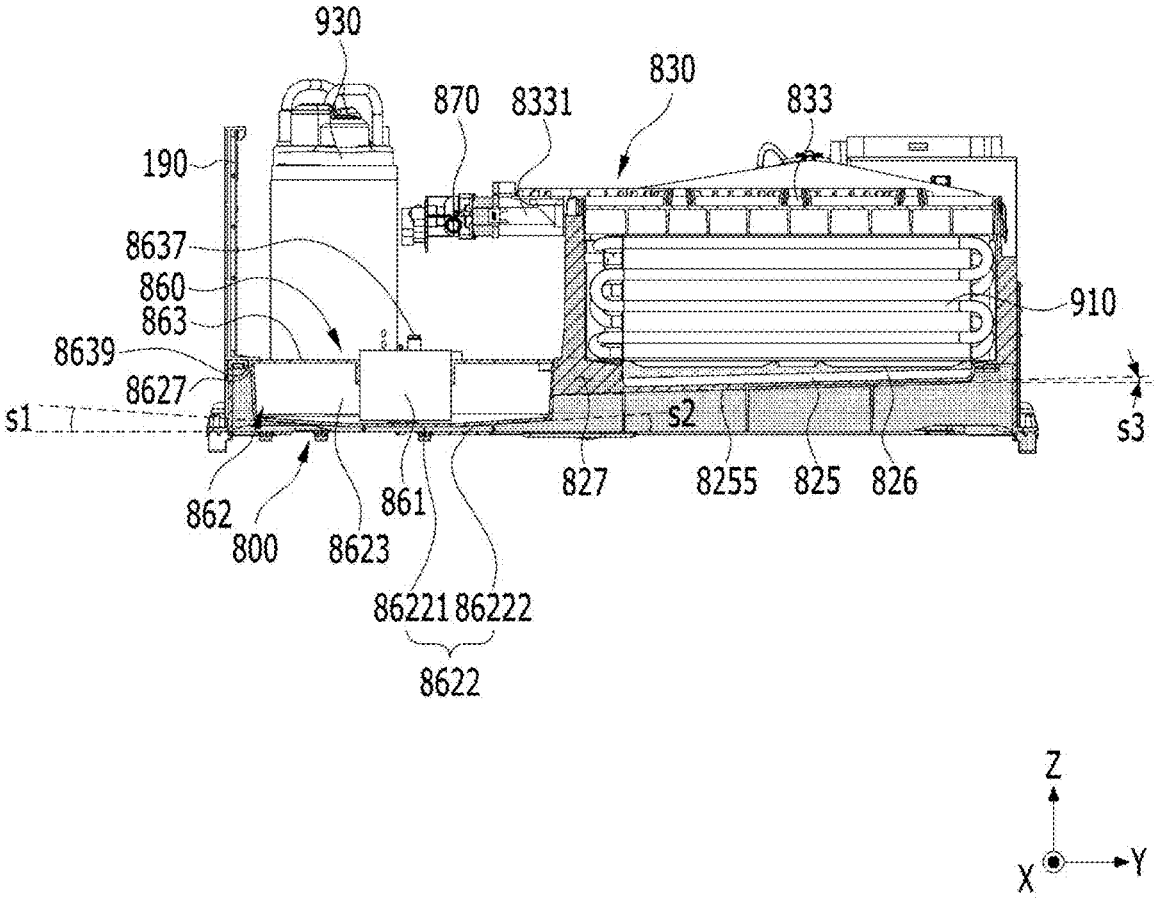
FIG. 15 is a cross-sectional view taken along line A-A in FIG. 14A.

FIG. 15 is a cross-sectional view taken along line A-A in FIG. 14A when viewed from the front.

Referring to FIG. 15, the water cover 826 configured to support the first heat exchanger 910 may be located under the first heat exchanger 910 located at the right side (in the Y-axis direction). The water cover 826 may be seated on the transfer duct 822, and may support the first heat exchanger 910 so that the first heat exchanger 910 is spaced apart from the bottom surface of the transfer duct 822.

The transfer duct 822 may include a water collection communication hole 827 formed in the side surface thereof so as to communicate with the water collection part 860.

The water collection communication hole 827 may be disposed between the condenser 920 and the evaporator 910, or may be disposed so as to overlap the evaporator 910. That is, the water collection communication hole 827 may be disposed so as to be spaced apart from the condenser 920 in the upstream direction.

Accordingly, water condensed by the evaporator 910 may be completely discharged to the water collection part 860 without contacting the condenser 920.

The bottom surface of the transfer duct 822 may be formed so as to be gradually lowered toward the water collection communication hole 827. The bottom surface of the transfer duct 822 may be lowered at a fourth inclination angle or a main inclination angle s4 in a direction from the evaporator 910 or the inflow duct toward the water collection communication hole 827. Further, the bottom surface of the transfer duct 822 may be lowered at a third inclination angle or an auxiliary inclination angle s3 in a direction from the other side surface of the transfer duct 822, which faces the water collection communication hole 827, toward the water collection communication hole 827. Accordingly, it is possible to prevent water from remaining on the bottom surface of the transfer duct 822.

Each of the third inclination angle s3 and the fourth inclination angle s4 may be set to be less than 5 degrees so that the condensed water sweeps foreign substances while flowing. The water collection part 860 may be provided at a lower height than the water collection communication hole 827, and may be provided at a lower height than the bottom surface of the transfer duct 822. Accordingly, water may be collected in the water collection part 860, rather than remaining in the circulation flow path part 820.

The transfer duct 822 may include a collection guide part 825 configured to guide condensed water generated in the circulation flow path part 820 to the water collection part 860. The water may be generated when air in the drum is cooled in the first heat exchanger 910. The collection guide part 815 may be recessed from the bottom surface of the circulation flow path part 820.

The collection guide part 825 may be located below the water cover 826, and may guide the condensed water generated by the first heat exchanger 910 to the water collection part 860. The collection guide part 825 may be formed to be stepped downwards from the bottom surface of the transfer duct 822, and may thus form a flow path along which the condensed water flows. The collection guide part 825 may guide the condensed water to the water collection part 860.

The condensed water flowing through the collection guide part 825 may pass through the water collection communication hole 827, and may be stored in the water collection body 862.

The water collection communication hole 827 may be provided to pass through one surface of the circulation flow path part 820 facing the water collection part 860, and the collection guide part 825 and the water collection part 860 may communicate with each other through the water collection communication hole 827.

In this drawing, the water collection communication hole 827 is marked with dotted lines. The water collection communication hole 827 may actually be located behind the position illustrated in this drawing (i.e. in the −X-axis direction). The water collection communication hole 827 may be formed through the side wall of the transfer duct 822. The condensed water generated by the first heat exchanger 910 may flow along the collection guide part 825 inclined toward the water collection communication hole 827, may pass through the water collection communication hole 827, and may then be stored in the water collection body 862. The collection guide part 825 may include a guide bottom surface 8255 forming the bottom surface on which the condensed water moves. The guide bottom surface 8255 may be provided so as to form a designated angle with the ground so that the condensed water on the guide bottom surface 8255 may be naturally moved toward the water collection communication hole 827. The angle between the leftward-rightward direction of the guide bottom surface 8255 and the ground may be defined as the third inclination angle s3. The third inclination angle s3 may be formed as an angle at which the distance between the guide bottom surface 8255 and the ground gradually decreases in a direction approaching the water collection communication hole 827.

The flow rate of the condensed water may be adjusted by adjusting the third inclination angle s3. When the flow rate of the condensed water is equal to or greater than a specific value, the condensed water may not be capable of sweeping lint or foreign substances located on the guide bottom surface 8255 down. Therefore, the third inclination angle s3 may be set as a designated angle at which the condensed water is capable of sweeping lint or foreign substances down.

The water collection body 862 may be provided in the base 800 so as to have a larger volume than the pump 861.

For example, the lengths of the water collection body 862 in the width direction and the forward-backward direction may be equal to or longer than the lengths of the pump 861 in the width direction and the forward-backward direction. Further, the length of the water collection body 862 in the width direction may be longer than a third of the length of the base in the width direction but shorter than half the length of the base in the width direction.

Accordingly, the water collection body 862 may form a flow path along which the water introduced thereinto from the water collection communication hole 827 flows into the pump 861 while rotating.

That is, the water collection body 862 may induce the condensed water to flow into the pump 861 while rotating, not only when the pump 861 is operating but also when the pump 861 is not operating.

Accordingly, lint or foreign substances in the water collection body 862 may be induced to be completely discharged to the outside through the pump 861, rather than remaining in the water collection body 862.

The length of the water collection body 862 in the width direction may be set to be longer than the length of the pump 861 in the width direction.

The water collection body 862 may include a water collection bottom surface 8622 forming the bottom surface of the space in which the condensed water is collected, and a water collection side surface 8623 forming the side surface of the space. The water collection bottom surface 8622 may be provided at a lower position than the collection guide part 825. Therefore, the condensed water may be collected on the water collection bottom surface 8622 by gravity.

The water collection body 862 may include the water collection side surface 8623 forming the side surface of the space in which the condensed water is collected. The water collection side surface 8623 may connect the water collection bottom surface 8622, which is recessed from the base 800, to the base 800.

Since the diameter of the water collection body 862 is formed to be larger than the diameter of the pump 861, the water collection bottom surface 8622 is formed to be larger than the diameter of the pump 861. Accordingly, space in which water can flow may be formed outside the pump 861.

The water collection bottom surface 8622 may be inclined toward a part thereof facing the pump. The water collection bottom surface 8622 may include an inflow surface 86221 facing the pump and a guide surface 86222 extending from the inflow surface 86221 toward the water collection side surface 8623.

The guide surface 86222 may form a rotation flow path in the water collection body 862, along which water flows into the pump 861 while rotating. To this end, the guide surface 86222 may be disposed further outwards than the pump 861.

The distance between the inner circumferential surface and the outer circumferential surface of the guide surface 86222 or the width of the guide surface 86222 may be greater than the diameter of the pump 861. The inflow surface 86221 may be disposed further downwards than the guide surface 86222. For example, the inflow surface 86221 may be flat, and the guide surface 86222 may be inclined. Here, a specific surface that is flat may be a surface having a certain inclination angle or less, at which liquid located on the surface can be maintained in a stationary state.

In other words, the inflow surface 86221 may be formed parallel to the ground at the center of the water collection bottom surface 8622, and the guide surface 86222 connecting the inflow surface 86221 to the water collection side surface 8623 may be provided such that the distance between the guide surface 86222 and the ground gradually increases in a direction from the inflow surface 86221 to the water collection side surface 8623.

In other words, the inflow surface 86221 and the guide surface 86222 may be disposed with designated inclinations. When viewed from the front, the guide surface 86222 extending leftwards from the inflow surface 86221 may be inclined from the inflow surface 86222 at a first inclination angle s1, and the guide surface 86222 extending rightwards from the inflow surface 86221 may be inclined from the inflow surface 86222 at a second inclination angle s2.

The first inclination angle s1 and the second inclination angle s2 may be the same. However, the present disclosure is not limited thereto, and the first inclination angle s1 and the second inclination angle s2 may be designed to be specific different angles at which water accommodated in the water collection body 862 may more smoothly flow.

The third inclination angle s3 may be equal to or less than the first inclination angle s1 and the second inclination angle s2. The condensed water on the collection guide part 825 may have an initial flow rate due to the flow of air on the circulation flow path part 820. Therefore, when the third inclination angle s3 is equal to or greater than a specific value, the flow rate of the condensed water may be excessively increased, and thus the condensed water is not moved toward the water collection communication hole 827, and may be moved to the side surface of the second heat exchanger. That is, the condensed water does not move along the collection guide part 825, and may overflow to the outside. Therefore, the third inclination angle s3 may be less than the first inclination angle s1 and the second inclination angle s2. However, overflow of the condensed water may be prevented using various methods other than control of the third inclination angle s3.

Relationships among the collection guide part 825, the water collection communication hole 827, and the water collection body 862 will be described later.

The pump 861 may be accommodated in the water collection cover 863 which shields the open upper surface of the water collection body 862. Referring to FIG. 13, the pump 861 is accommodated in the pump installation part 8634. When the condensed water is stored in the water collection body 862, the condensed water stagnant in the water collection body 862 for a long time may be contaminated, and the contaminated water may generate odors or microbial growth. In order to prevent such a problem, the pump 861 may discharge water collected in the water collection body 862 as much as possible so as to minimize the amount of residual water.

In order to normally operate the pump 861, the pump 861 should be spaced apart from the water collection bottom surface 8622 by a designated distance or more. However, when the pump 861 is spaced apart from the water collection bottom surface 8622, water accommodated between the pump 861 and the water collection bottom surface 8622 may remain. Therefore, in order to minimize the amount of residual water between the pump 861 and the water collection bottom surface 8622 while spacing the pump 861 apart from the water collection bottom surface 8622, the water collection bottom surface 8622 may be inclined.

When the water collection bottom surface 8622 is provided to be flat without any inclination, water equal to a volume acquired by multiplying the area of the water collection bottom surface 8622 by the distance between the water collection bottom surface 8622 and the pump 861 may remain in the water collection body 862. On the other hand, when the water collection bottom surface 8622 includes the inflow surface 86221 and the guide surface 86222 and is provided to be inclined, water may be concentrated on the inflow surface 86221, and thus a small amount of water may remain compared to the case in which the water collection bottom surface 8622 is provided to be flat.

That is, when the guide surface 86222 extends from the water collection side surface 8623 to the inflow surface 86221 and thus the distance from the ground is reduced, generation of odors or microbial growth due to the water remaining in the water collection body 862 may be prevented.

The flow path switch valve 870 may be coupled to a guide flow path 8331 protruding from the side surface of the duct cover 830. The guide flow path part 8331 may extend from the upstream end of the washing flow path part 833. The flow path switch valve 870 may be coupled to the guide flow path 8331, and may shorten a process compared to coupling of the washing flow path part 833 to the flow path switch valve 870 by a rubber hose, and may prevent water leakage between the flow path switch valve 870 and the washing flow path part 833.

Figure 16:
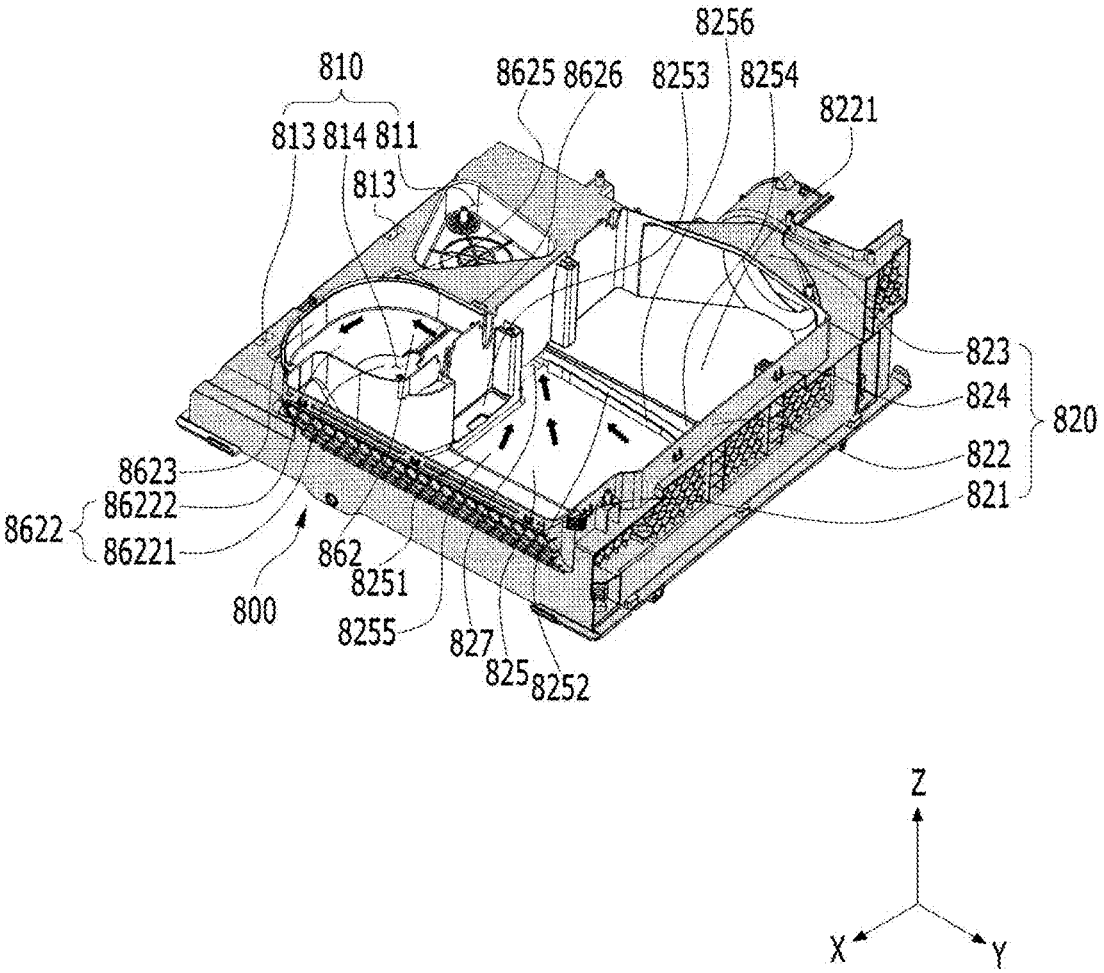
FIG. 16 is a perspective view illustrating the base of the laundry treating apparatus according to one embodiment of the present disclosure.
Figure 17:
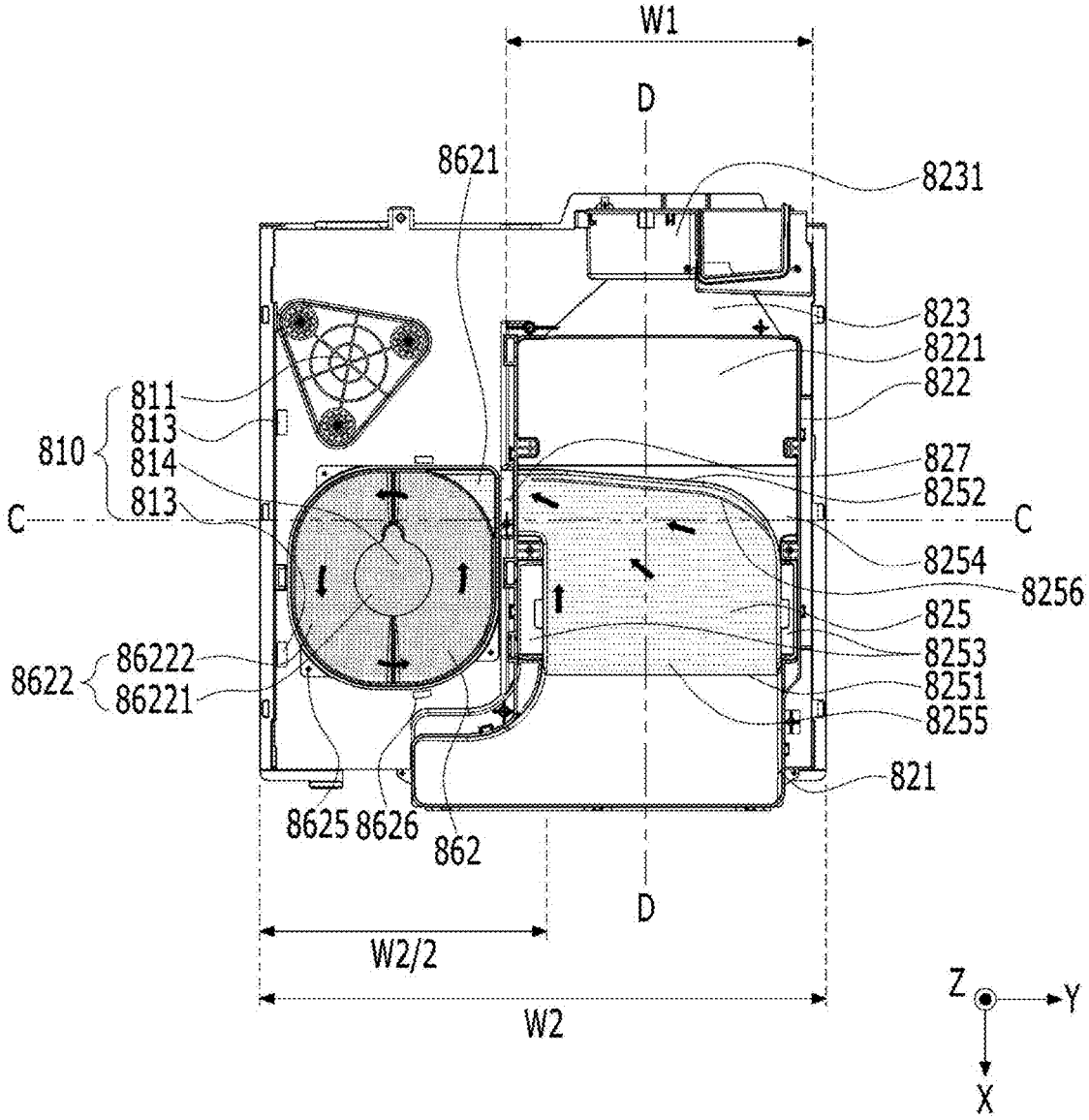
FIG. 17 is a top view illustrating the base according to one embodiment of the present disclosure.

FIGS. 16 and 17 are a perspective view and a top view illustrating the base from which all the elements installed on the base are removed.

Referring to FIGS. 16 and 17, the base 800 may include the circulation flow path part 820 provided on one side of the base 800 so as to circulate air in the drum therethrough, and the device installation part 810 provided on the other side of the base 800 so as to provide the space in which the devices required to operate the laundry treating apparatus are installed, as described above.

The base 800 may include the water collection part 860 provided to communicate with the circulation flow path part 820 so as to collect condensed water generated in the circulation flow path part 820. The water collection part 860 may include the water collection body 862 forming the space in which water is stored. The water collection body 862 may be recessed downwards from the base 800. The water collection bottom surface 8622 forming the water collection surface of the water collection body 862 in which water is stored may be recessed downwards from the device installation part 810. The water collection side surface 8623 forming the side wall of the water collection body 862 may connect the water collection bottom surface 8622 which is recessed from the base 800, to the base 800.

The water collection bottom surface 8622 may include the inflow surface 86221 formed on one surface thereof facing the pump 861 parallel to the ground, and the guide surface 86222 configured to extend from the inflow surface 86221 toward the water collection side surface 8623 so as to be inclined upwards.

The condensed water entering the water collection body 862 along the guide surface 86222 may generate a rotating flow in a direction represented by arrows shown in the drawings. Since the rotating flow is generated using the guide surface 86222, foreign substances, such as lint, included in the condensed water may not be moved to the inflow surface 86221 by centrifugal force, and may be accumulated adjacent to the water collection side surface 8623. When the foreign substances reach the inflow surface 86221, the foreign substances enter the pump 861 and may thus damage the pump 861. Therefore, the guide surface 86222 may prevent the foreign substances from entering the pump 861 by generating the above-described flow of the condensed water.

The control panel 190 configured to control operation of the laundry treating apparatus may be installed at the side of the water collection part 860 away from the circulation flow path part 820. The base 800 may include the control box installation part 813 configured to provide the space in which the control panel 190 is installed. The control box installation part 813 may include recesses formed in the device installation part 810. The control panel 190 may be coupled to the base 800 by fitting into the recesses provided in the control box installation part 813.

The control box installation part 813 may indicate the entirety of one surface of the base 800 that is in contact with the control panel 190. Further, the control box installation part 813 may indicate one surface of the device installation part 810 facing the control panel 190.

That is, a plane of projection of the control panel 190 onto the base 800 when the control panel 190 installed on the base 800 is projected onto the base 800 from the top may be defined as the control box installation part 813.

The water collection part 860 may be disposed between the control box installation part 813 and the circulation flow path part 820. Further, the control box installation part 813 may be disposed to overlap with the water collection part 860 in the leftward-rightward direction.

Since the water collection part 860 may be spaced apart from the circulation flow path part 820, when the water collection part 860 is disposed between the circulation flow path part 820 and the control box installation part 813, the space on the base 800 rather than the space on which the circulation flow path part 820 is disposed may be more effectively used.

When the control panel 190 is exposed to an excessive amount of moisture, an error or failure of the control panel 190 may occur. Therefore, the control box installation part 813 may be disposed to be spaced apart from the circulation flow path part 820 in which wet steam flows, and thereby, stability of the control panel 190 may be increased.

That is, damage to the control panel 190 may be prevented by disposing the water collection part 860 between the circulation flow path part 820 and the control box installation part 813.

Further, the control box installation part 813 may be located such that at least a portion thereof overlaps the collection guide part 825 in the leftward-rightward direction. Further, the control box installation part 813 may be located such that at least a portion thereof overlaps the water collection communication hole 827 in the leftward-rightward direction.

When the control box installation part 813 is located to overlap the collection guide part 825 or the water collection communication hole 827 in the leftward-rightward direction, the control box installation part 813 may be located adjacent to the water collection part 860 connected to the water collection communication hole 827 so as to collect water. Further, when the control box installation part 813 is located adjacent to the water collection part 860, the control box installation part 813 may be located adjacent to the pump.

The control panel 190 may be connected to the pump through the control wire, and may thus control the pump. Therefore, the control panel 190 may be easily connected to the pump.

That is, the control panel 190 may include coupling protrusions protruding downwards from the lower end thereof, and the coupling protrusions may be fixedly inserted into the recesses provided in the control box installation part 813. However, the present disclosure is not limited thereto, and the control panel 190 may be installed in the control box installation parts 813 through various methods, so long as the control panel 190 can be firmly fixed to the control box installation parts 813.

The cover support planes 8625 and the hook holes 8626 may be formed around the circumference of the water collection side surface 8623 so as to couple the water collection cover to the water collection body. The coupling structure between the water collection cover and the water collection body has already been described above with reference to FIG. 13.

The base 800 may include a compressor installation part 811 configured to provide a space in which the compressor is mounted. The device installation part 810 may include the compressor installation part 811.

The compressor installation part 811 may be disposed to overlap the water collection cover 863 in the forward-backward direction. Further, the compressor installation part 811 may be located behind the water collection cover 863. The compressor installation part 811 may be recessed downwards from the device installation part 810. The compressor installation part 811 may be provided to support the bottom surface of the compressor.

The compressor installation part 811 may be located to overlap the water collection part 860 in the forward-backward direction. In the conventional dryer, the motor is installed on the base 800, and thus the space on the base 800 is narrow. Therefore, the water collection part 860 should be provided between the compressor installation part 811 and the circulation flow path part 820. However, the space between the compressor installation part 811 and the circulation flow path part 820 is narrow, and thus the amount of water collected by the water collection body is not sufficient.

However, in the laundry treating apparatus according to one embodiment of the present disclosure, the motor 500 is installed behind the drum 200, and thus the space on the base 800 that was conventionally occupied by the motor may be used. The water collection part 860 and the compressor installation part 811 may be disposed in the forward-backward direction.

Therefore, the volume of the water collection body 862 may be increased, and the water collection body 862 may store a larger amount of condensed water. Therefore, the frequency with which the user removes the condensed water may be reduced. Accordingly, user convenience may be improved.

Further, the compressor installation part 811 may be located so as to overlap the second heat exchanger in the leftward-rightward direction. The refrigerant compressed by the compressor may be supplied to the second heat exchanger, and may heat the circulation flow path part 820. When the compressor installation part 811 is located so as to overlap the second heat exchanger in the leftward-rightward direction, the distance between the two elements is reduced, and occurrence of heat loss of the refrigerant moving from the compressor to the second heat exchanger may be prevented. Therefore, heat exchange efficiency may be increased.

Further, the water collection part 860 may be disposed so as to overlap the first heat exchanger or the second heat exchanger in the leftward-rightward direction or the width direction.

The water collection part 860 may be located so as to at least partially overlap the first heat exchanger in the leftward-rightward direction. In general, condensed water is generated by the first heat exchanger. Therefore, when the water collection part 860 is located so as to overlap the first heat exchanger 910 in the leftward-rightward direction, the flow path along which the condensed water generated by the first heat exchanger moves may be shortened. Therefore, it is possible to prevent the condensed water from remaining in the first heat exchanger, thereby preventing generation of odors or microbial growth due to the residual water.

The water collection part 860 may be disposed so as not to overlap the second heat exchanger 920 in the width direction or the leftward-rightward direction. For example, the water collection part 860 may be spaced apart from the second heat exchanger 920 so as to be close to the first heat exchanger 910. The water collection part 860 may be disposed further forwards than the second heat exchanger 920.

The compressor installation part 811 may be located behind the water collection part 860. The compressor may generate noise during operation. Therefore, when the compressor installation part 811 is disposed in the rear portion of the laundry treating apparatus, transfer of noise to a user may be prevented. That is, when the compressor installation part 811 is disposed in the rear portion of the laundry treating apparatus, user convenience may be improved.

Further, when the water collection part 860 is disposed in the front portion of the laundry treating apparatus, the distance between the water collection part 860 and the first heat exchanger may be reduced. The condensed water collected in the water collection body 862 may be used to wash the first heat exchanger and, when the distance between the first heat exchanger and the water collection part 860 is reduced, the length of a hose connecting the two elements may be shortened.

The transfer duct 822 may include a transfer bottom surface 8221 provided to face the second heat exchanger. The transfer bottom surface 8221 may be provided to support the second heat exchanger.

The base 800 may further include the collection guide part 825 formed on the bottom surface of the circulation flow path part 820 facing the first heat exchanger so as to guide the condensed water to the water collection part 860, and the compressor installation part 811 may be located behind the collection guide part 825.

The collection guide part 825 may perform a function of preventing the condensed water generated by the first heat exchanger 910 installed thereon from remaining in the lower portion thereof, and guiding the condensed water to the water collection part 860. The collection guide part 825 may extend backwards from a spot at which the first heat exchanger 910 is installed to a spot located between the first heat exchanger 910 and the second heat exchanger 920. The collection guide part 825 may be disposed in front of the transfer bottom surface 8221.

The collection guide part 825 may include an inclined guide portion 8251 provided to prevent the condensed water from flowing backwards to the inflow duct 821.

The inclined guide portion 8251 may connect the inflow duct 821 to the bottom surface of the transfer duct 822 in a stepped shape. The inclined guide portion 8251 may be provided at the front portion of the collection guide part 825.

The inclined guide portion 8251 may indicate a portion in which the height of the bottom surface extending along the inflow duct 821 is drastically decreased. The collection guide part 825 may extend backwards from the inclined guide portion 8251.

The collection guide part 825 may include an extending stepped portion 8252 configured to prevent the condensed water from overflowing toward the second heat exchanger 920. The extending stepped portion 8252 may be located between the first heat exchanger 910 and the second heat exchanger 920. The extending stepped portion 8252 may be a portion in which the height of the bottom surface of the transfer duct 822 is increased stepwise.

Further, the extending stepped portion 8252 may have a curved surface so as to guide the flow of the condensed water flowing therein toward the water collection part 860 in one direction.

The circulation flow path part 820 and the water collection part 860 may communicate with each other through the water collection communication hole 827. Further, the water collection communication hole 827 may guide the condensed water moving along the collection guide part 825 to the water collection body 862. That is, the water collection communication hole 827 may spatially connect the circulation flow path part 820 to the water collection body 862.

The water collection communication hole 827 may be spaced apart from the second heat exchanger 920 in the upstream direction based on the direction in which air moves. That is, since the water collection part 860 is disposed closer to the first heat exchanger 910 than to the second heat exchanger 920, the water collection communication hole 827 may also be disposed closer to the first heat exchanger 910 than to the second heat exchanger 920.

Accordingly, the distance between the circulation flow path part 820 and the water collection part 860 may be further reduced, thereby preventing water from remaining in the circulation flow path part 820. The water collection communication hole 827 may be located in front of the second heat exchanger 920. When the water collection communication hole 827 is located in front of the second heat exchanger, the condensed water moving along the collection guide part 825 may be prevented from contacting the second heat exchanger 920. Further, the condensed water may be guided to the water collection part 860 while being spaced apart from the second heat exchanger 920.

The water collection part 860 may extend from the water collection communication hole 827 in the downstream direction or the upstream direction. In other words, the water collection part 860 may extend only forwards from the water collection communication hole 827, or may extend only backwards from the water collection communication hole 827.

Accordingly, the tangential direction of the water collection body 862 may be parallel to the direction in which the water collection communication hole 827 passes through the circulation flow path part 820.

The water introduced into the water collection body 862 through the water collection communication hole 827 may move while rotating along the circumference of the water collection body 862, and may then flow into the pump 861.

Therefore, reduction in heat exchange efficiency of the second heat exchanger 920 due to evaporation of the condensed water reheated by the second heat exchanger 920 may be prevented. Therefore, drying efficiency may be improved.

The driving unit 500 and 600 may be provided so as to face the rear surface of the drum 200, and may thus be disposed further upwards than the water collection part 860, the compressor installation part 811, and the circulation flow path part 820. The driving unit may be disposed further backwards than the drum 200, and thus the water collection part 860, the control panel 190, and the compressor installation part 811 may be disposed further forwards than the driving unit.

Referring to FIG. 17, the extending stepped portion 8252 may be provided so as to be inclined so as to naturally transfer water, moving along the collection guide part 825, toward the water collection communication hole 827. Further, the extending stepped portion 8252 may have a curved surface.

In other words, the extending stepped portion 8252 may be formed such that the distance between the extending stepped portion 8252 and the inclined guide portion 8251 gradually increases in a direction approaching the water collection communication hole 827.

The extending stepped portion 8252 may extend from one side surface of the transfer duct 822, in which the water collection communication hole 827 is formed, to the other side surface of the transfer duct 822.

The extending stepped portion 8252 may be formed such that the width of the collection guide part 825 decreases toward the water collection communication hole 827 or the discharge duct 823. One end of the extending stepped portion 8252, which faces the other side surface of the transfer duct 822, may be disposed closer to the evaporator 910 than the other end of the extending stepped portion

8252, which faces the water collection communication hole 827. The extending stepped portion 8252 may have a predetermined curvature at which the extending stepped portion 8252 is convex downwards toward the inflow duct 821. The extending stepped portion 8252 may extend from the other side surface of the transfer duct 822 toward the water collection communication hole so as to be close to the discharge duct 823.

The extending stepped portion 8252 may prevent condensed water on the collection guide part 825 from contacting the condenser 920. The height of the extending stepped portion 8252 may be formed to be equal to or higher than the height of the water collection communication hole 827.

The shape of the extending stepped portion 8252 is not limited to that shown in the drawings or described above, and may be formed in various other shapes. The collection guide part 825 may include the guide bottom surface 8255 forming the bottom surface on which the condensed water moves. The guide bottom surface 8255 may connect the inclined guide portion 8251 and the extending stepped portion 8252 to each other. The guide bottom surface 8255 may be provided such that the distance between the guide bottom surface 8255 and the ground is less than the distance between the bottom surface of the inflow duct 821 and the ground. Therefore, backflow of the condensed water transferred on the guide bottom surface 8255 toward the inflow duct 821 may be prevented.

The collection guide part 825 may further include a guide partition 8256 configured to prevent the condensed water from overflowing toward the second heat exchanger 920. The guide partition 8256 may protrude upwards from the guide bottom surface 8255. The guide partition 8256 may serve as a partition which prevents the condensed water flowing on the guide bottom surface 8255 from overflowing toward the second heat exchanger 920 by the volume of air circulating in the circulation flow path part 820.

The second heat exchanger 920 functions to heat circulating air and, when the condensed water overflows toward the second heat exchanger 920, the second heat exchanger 920 may also heat the condensed water, and thus the condensed water may be evaporated. However, since air heated by the second heat exchanger 920 is supplied to the drum so as to dry laundry in the drum, when the condensed water is evaporated and thus the humidity of air supplied to the drum is increased, drying efficiency may be reduced. Further, when the second heat exchanger 920 configured to heat air supplied to the drum exchanges heat with the condensed water, heat exchange efficiency may also be reduced.

The guide partition 8256 may be formed parallel to the extending stepped portion 8252. That is, the guide partition 8256 may serve to assist the condensed water overflow prevention function performed by the extending stepped portion 8252. The guide partition 8255 may be provided to protrude from the guide bottom surface 8255 so as to be spaced apart from the extending stepped portion 8252 by a designated distance. However, in order to assist the condensed water overflow prevention function, the guide partition 8256 may be provided close to the extending stepped portion 8252.

The guide partition 8256 and the extending stepped portion 8252 may prevent the condensed water from overflowing to the outside of the collection guide part 825, and thereby, heat exchange efficiency and laundry drying efficiency of the laundry treating apparatus may be improved. Although the drawings illustrate a single guide partition 8256, the present disclosure is not limited thereto, and a plurality of guide partitions may be provided.

Further, the guide partition 8256 and the extending stepped portion 8252 may form an accommodation surface. A cover partition 8267 (refer to FIG. 20) of the water cover 826, which will be described later, may be inserted into the accommodation surface. The cover partition 8267 may be inserted into a space between the guide partition 8256 and the extending stepped portion 8252, and may thus couple the water cover 826 to the collection guide part 825.

The collection guide part 825 serves to guide the condensed water to the water collection part 860. However, the side wall of the transfer duct 822 may be located between the water collection body 862 and the collection guide part 825. Therefore, the collection communication hole 827 through which the collection guide part 825 and the water collection body 862 communicate with each other may be formed through the lower portion of the side wall of the transfer duct 822.

The guide bottom surface 8255 may be provided to have designated inclination angles s3 and s4 (refer to FIGS. 15 and 18) so as to allow the condensed water to flow toward the collection communication hole 827 due to the weight thereof. The guide bottom surface 8255 may be provided to have an inclination in the forward-backward direction such that the height thereof from the ground decreases in a direction from the inclined guide portion 8251 to the extending stepped portion 8252. Further, as shown in the drawings, the guide bottom surface 8255 may be provided to have an inclination in the leftward-rightward direction such that the height thereof from the ground gradually decreases in a direction approaching the water collection part 860. In other words, the guide bottom surface 8255 may be formed such that the distance between the guide bottom surface 8255 and the ground at the water collection communication hole 827 is the minimum and the distance between the guide bottom surface 8255 and the ground gradually increases in a direction away from the water collection communication hole 827.

When the guide bottom surface 8255 is provided to have the above-described inclination, the condensed water generated by the first heat exchanger may naturally flow toward the water collection communication hole 827 in the direction represented by arrows shown in the drawings, and thus generation of various problems, such as odors and reduction in drying efficiency, due to the residual water on the guide bottom surface 8255 may be prevented.

The water collection body 862 may include a connection flow path 8621 connecting the space in which water is stored to the water collection communication hole 827. The connection flow path 8621 may be provided to be stepped upwards from the water collection bottom surface 8622. The connection flow path 8621 may guide the condensed water having passed through the water collection communication hole 827 to the water collection body 862 in the circumferential direction thereof.

The connection flow path 8621 may be provided outside the circumference of the water collection bottom surface 8622. Therefore, the connection flow path 8621 may connect the water collection bottom surface 8622 to the water collection communication hole 827 to each other in a stepped shape. However, the present disclosure is not limited thereto, and the connection flow path 8621 may be provided as an inclined surface connecting the water collection communication hole 827 to the water collection bottom surface 8622.

The connection flow path 8621 may prevent the condensed water stored in the water collection body 862 from flowing backwards to the collection guide part 825 when the pump operates. The connection flow path 8621 may be formed to be stepped such that the connection flow path 8621 is located at a higher position than the pump, thereby preventing backflow of the condensed water.

The compressor installation part 811 may be located behind the water collection communication hole 827. Since the compressor installation part 811 is located behind the water collection communication hole 827, the distance between the collection guide part 825 and the water collection part 860 may be reduced. Therefore, generation of odors or microbial growth due to the condensed water remaining between the collection guide part 825 and the water collection part 860 may be prevented.

Since the water collection part 860 is located between the inflow duct 821 and the compressor installation part 811, the distance between the transfer duct 822 in which the condensed water is generated and the water collection part 860 may be reduced, the water collection part 860 may be disposed adjacent to the spot at which the condensed water is generated, and thus generation of problems due to residual condensed water may be prevented.

The compressor installation part 811 may be located to be spaced apart from the transfer duct 822 in the leftward-rightward direction, and may be located to be spaced apart from the water collection part 860 in the direction of extension of the transfer duct 822.

Since the transfer duct 822 extends in the forward-backward direction of the laundry treating apparatus, when the water collection part 860 is disposed to be spaced apart from the transfer duct in the width direction and the compressor installation part 811 is disposed to be spaced apart from the water collection part 860 in the forward-backward direction, the space on the base 800 may be effectively used.

The compressor installation part 811 may be located such that at least a portion thereof overlaps the discharge duct 823 in the leftward-rightward direction. Since the discharge duct 823 is disposed at the rear portion of the circulation flow path part 823, when the compressor installation part 811 overlaps the discharge duct 823 in the leftward-rightward direction, the compressor installation part 811 may also be located at the rear portion of the base 800. Therefore, the water collection part 860 may be located in front of the compressor installation part 811, the space occupied by the water collection body 862 may be expanded, and thus a larger amount of the condensed water may be stored.

The laundry treating apparatus according to one embodiment of the present disclosure may further include the front plate 410 (refer to FIG. 5), and the water collection part 860 may be located between the front plate 410 and the compressor installation part 811.

The front plate 410 may be located at the front portion of the base 800 and the compressor installation part 811 may be located at the rear portion of the base 800, and thus, when the water collection part 860 is located between the front plate 410 and the compressor installation part 811, the condensed water accommodating capacity of the water collection body 862 may be increased.

The cabinet 100 may further include the side panels 140 forming the side surfaces of the cabinet 100, which include the left panel 141 (refer to FIG. 12), and the compressor installation part 811 may be located between the left panel 141 and the circulation flow path part 820.

Further, the control panel 190 configured to control the motor 500 may be installed on the base 800 between the left panel 141 and the water collection part 860, and at least a portion of the compressor installation part 811 may be located behind the control panel 190.

In the conventional laundry treating apparatus, the motor 500 is installed on the base 800, and thus the space in which the control panel 190 is installed is not secured. Therefore, the control panel 190 should be located in the upper portion of the cabinet 100. However, in the laundry treating apparatus according to one embodiment of the present disclosure, the motor 500 is located behind the drum 200 separately from the base 800, and thus the control panel 190 may be located on the base 800. Therefore, electric wires for connecting the control panel 190 to the compressor 930, the motor 500, etc. may be fixed to the base 800, and thus problems, such as short circuit of the electric wires due to interference with other elements, may be prevented during operation of the laundry treating apparatus.

Further, the rear plate 420 (refer to FIG. 8) located between the drum and the motor 500 so as to guide air discharged from the circulation flow path part 820 to the drum may be installed on the base 800. The compressor installation part 811 may be disposed between the water collection part 860 and the rear plate 420.

The speed reducer 600 connected to the motor 500 so as to reduce the power generated by the motor 500 to rotate the drum may be fixed to the rear surface of the rear plate 420, and the motor 500 may be fixed to the speed reducer 600 so as to be spaced apart from the rear plate 420.

Since the motor 500 is fixed to the rear plate 420, the water collection part 860 and the compressor installation part 811 may be disposed in the forward-backward direction, as described above, and thus the amount of the condensed water accommodated in the water collection body 862 may be increased.

Further, since the compressor installation part 811 is disposed between the water collection part 860 and the rear plate 420, the amount of the condensed water accommodated in the water collection body 862 may be increased.

The control box installation part 813 may be located such that at least a portion thereof overlaps the compressor installation part 811 in the leftward-rightward direction. Further, the control box installation part 813 may be disposed in front of the compressor installation part 811.

When the control box installation part 813 and the compressor installation part 811 are disposed to overlap each other in the leftward-rightward direction, the space on the base 800 may be more effectively used.

Further, the compressor 930 may be connected to the control panel 190 so as to be controlled thereby. Therefore, a control wire for connecting the control panel 190 to the compressor 930 may be shortened, noise may be reduced, and thus control reliability may be improved.

The control box installation part 813 may be located between the left panel 141 (refer to FIG. 12) and the circulation flow path part 820. Further, the control box installation part 813 may be located between the water collection part 860 and the left panel 141.

The control panel 190 (refer to FIG. 12) may be installed parallel to the left panel 141 in the control box installation part 813. The control panel 190 may be installed in the control box installation part 813 so as to be in contact with the left panel 141.

When the control box installation part 813 is located between the circulation flow path part 820 and the left panel 141, the space on the base 800 may be more effectively used, and thus efficiency in space utilization may be improved. Further, when the control box installation part 813 is located between the water collection body 862 and the left panel 141, a very narrow space formed between the water collection part 860 and the left panel 141 may be used. Therefore, efficiency in space utilization may be improved.

Further, the control panel 190 may be provided as a PCB having a thin thickness, and, when the control panel 190 is installed parallel to the left panel 141 in the control box installation part 813, the space located between the water collection body 862 and the left panel 141 may be used.

In the case in which the control panel 190 is in contact with the left panel 141, the control panel 190 may be supported by the left panel 141. Therefore, release of the control panel 190 from the control box installation part 813 due to vibration may be prevented.

The water cover 826 may be coupled to the open upper surface of the connection guide part 825, and the water cover 826 may support the first heat exchanger 910 so that the first exchanger 910 is spaced apart from the guide bottom surface 8255. The water cover 826 may also be coupled to the open upper surface of the connection guide part 825 so as to be spaced apart the guide bottom surface 8255, and inflow support planes 8253 configured to support the water cover 826 may be formed at the left and right sides of the front portion of the collection guide part 825. The inflow support planes 8253 may be provided on the side walls of the transfer duct 822, and may be recessed so that the water cover 826 is firmly supported by the inflow support planes 8253.

A transfer support surface 8254 may be provided behind the collection guide part 825. The transfer support surface 8254 may extend backwards from the upper end of the guide partition 8256 to form a support surface, and may be stepped downwards from the bottom surface of the transfer duct 822 in which the second heat exchanger 920 is installed, in consideration of the thickness of the water cover 826.

The collection guide part 825 may be recessed from the bottom surface of the transfer duct 822 so as to be located at a lower position than the transfer support surface 8254. The collection guide part 825 may extend to the water collection communication hole 827 from the front side of the transfer duct 822, the lower side of the evaporator 910, or the region facing the lower side of the evaporator 910.

Accordingly, water condensed in the evaporator 910 may be collected in the collection guide part 825, and may then be guided to the water collection communication hole 827.

The front and rear portions of the water cover 826 may be supported by the inflow support planes 8253 and the transfer support surface 8254, and the water cover 826 may support the first heat exchanger 910 so that the first heat exchanger 910 is spaced apart from the guide bottom surface 8255. A detailed structure of the water cover 826 coupled to the inflow support planes 8253 and the transfer support surface 8254 will be described later.

The conventional dryer is limited in that the width of the transfer duct is less than half the width of the base due to the space occupied by the driving unit. However, in the laundry treating apparatus according to one embodiment of the present disclosure, the driving unit is located behind the drum, the space which was occupied by the driving unit is usable, and thus the width W1 of the transfer duct 822 in which air moves may be increased. Therefore, the transfer duct 822 may be provided such that the width W1 thereof is greater than or equal to half the width W2 of the base 800.

The width W1 of the transfer duct 822 may indicate a distance between the side walls of the transfer duct 822 which extend upwards from the base 800 to form the side surfaces of the transfer duct 822. The width W1 of the transfer duct 822 may indicate the distance between the side walls thereof.

The width W1 of the transfer duct 822 may be understood as the width of the transfer duct 822 including the thicknesses of the side walls provided at both sides of the transfer duct 822. That is, the width W1 of the transfer duct 822 may indicate the maximum distance between the outer surface of the right side wall and the outer surface of the left side wall of the transfer duct 822. Further, the width W2 of the base 800 may indicate a distance between the left side surface and the right side surface of the base 800.

The width W1 of the transfer duct 822 is increased, and thus the flow rate of air passing through the transfer duct 822 per unit time may be increased. Therefore, air in the drum may be circulated at a higher speed, and may thus shorten a drying time.

Further, as the width W1 of the transfer duct 822 is increased, the widths of the first heat exchanger and the second heat exchanger installed in the transfer duct 822 may also be increased. Therefore, air transferred along the transfer duct 822 may be more rapidly dehumidified by the first heat exchanger, and may be more rapidly heated by the second heat exchanger.

That is to say, the transfer duct 822 is provided such that the width W1 thereof is greater than or equal to half the width W2 of the base 800, and thus the widths of the first heat exchanger and the second heat exchanger may also be increased, and a larger amount of air may be dehumidified, heated and supplied to the drum. Therefore, the drying time may be shortened, and drying efficiency may be increased.

The transfer duct 822 may be provided such that the width W1 thereof is greater than or equal to half the width W3 of the front plate 410 (refer to FIG. 5). Further, the transfer duct 822 may be provided such that the width W1 thereof is greater than or equal to half the diameter W4 of the drum 200 (refer to FIG. 5).

As described above, since the driving unit is located behind the drum 200 so as to be spaced apart from the base 800, the transfer duct 822 may be provided such that the width W1 thereof is greater than half the width W3 of the front plate 410 or half the diameter W4 of the drum 200.

Such an increase in the width W1 of the transfer duct 822 may increase the flow rate of circulating air, and may shorten a time taken to dry laundry.

As described above, in the conventional dryer, there is a limit in increasing the width of the transfer duct because of the space occupied by the driving unit. Therefore, it is difficult to dispose the transfer duct so as to overlap the center of rotation of the drum in the height direction.

However, in the laundry treating apparatus according to one embodiment of the present disclosure, the motor 500 is disposed in the rear portion of the laundry treating apparatus so as to be spaced from the base 800, and thus the transfer duct 822 may be located to overlap the center of rotation of the drum 200 on the first axis M1 (refer to FIG. 5) in the height direction (in the Z-axis direction).

The transfer duct 822 overlaps the center of rotation of the drum 200 in the height direction, and thus the width W1 of the transfer duct 822 may be increased. Therefore, the flow rate of air passing through the transfer duct 822 per unit time may be increased. Therefore, air in the drum may be circulated at a higher speed, and thus the drying time may be shortened.

Further, the transfer duct 822 overlaps the center of rotation of the drum 200 in the height direction, and thus air transferred along the circulation flow path part 820 may transfer close to the center of rotation of the drum 200. Therefore, air discharged from the circulation flow path part 820 may be discharged close to the center of rotation of the drum 200. Therefore, hot air discharged from the circulation flow path part 820 may be more uniformly supplied to the drum 200, compared to the case in which air discharged from the circulation flow path part 820 is discharged away from the center of rotation of the drum 200.

Further, the first heat exchanger 910 (refer to FIG. 13) or the second heat exchanger 920 (refer to FIG. 14B) may be located to overlap the center of rotation of the drum 200 in the height direction. When the transfer duct 822 is located to overlap the center of rotation of the drum 200 on the first axis M1, as described above, the first heat exchanger 910 and the second heat exchanger 920 located in the transfer duct 822 may be disposed to overlap the center of rotation of the drum 200 on the first axis M1.

The width of the first heat exchanger 910 or the second heat exchanger 920 may be increased, and thereby, the amount of air dehumidified or heated per unit time may be increased. Therefore, the drying time may be shortened, and drying efficiency may be improved.

Hereinafter, the structure in which the condensed water collected in the circulation flow path part 820 flows into the water collection part 860 while rotating will be described with reference to FIG. 17.

The water collection body 862 may be formed to have a larger diameter than the pump 861, and the pump 861 may be spaced apart from the inner circumferential surface of the water collection body 862.

Therefore, the water collection body 862 may include a flow path or a collection space formed along the circumference of the pump 861 to store water therein or to move water therealong.

The connection flow path 8621 may supply water to the guide surface 86222 of the water collection body 862. That is, the connection flow path 8621 may supply water toward the inner circumferential surface of the water collection body 862, rather than supplying water toward the center of the water collection body 862.

The connection flow path 8621 may supply water toward the inner circumferential surface of the water collection body 862, or may supply water toward the space between the outer circumferential surface of the pump 861 and the inner circumferential surface of the water collection body 862.

Accordingly, the water introduced through the connection flow path 8621 may move from the inner circumferential surface of the water collection body 862 toward the inflow surface 86221 while rotating along the guide surface 86222. Consequently, the water introduced into the water collection body 862 may sweep foreign substances while moving toward the pump 861.

The connection flow path 8621 may be connected to the water collection body 862 so as to supply water toward the outside of the pump 861. That is, the connection flow path 8621 may be disposed so as not to face the center of the pump 861.

The connection flow path 8621 may supply water in a direction tangential to the inner circumferential surface of the water collection body 862.

The connection flow path 8621 may extend from one surface of the circulation flow path part 820 in a direction away from the circulation flow path part 820. The water collection body 862 may extend from the end of the connection flow path only in one of the directions in which the circulation flow path part extends.

Accordingly, the connection flow path 8621 may be spaced apart from the rearmost or foremost part of the water collection body 862, thereby preventing water from being supplied toward the inside of the water collection body 862.

The connection flow path 8621 may extend in the lateral direction from one surface of the circulation flow path part 820, and the water collection body 862 may extend forwards or backwards from the free end of the connection flow path 8621.

That is, the connection flow path 8621 may be connected to a rear portion or a front portion of the water collection body 862. FIG. 17 illustrates the structure in which the connection flow path 862 is connected to a rear portion of the water collection body 862.

Since the water collection body 862 is provided at a lower position than the connection flow path 8621, the bottom surface of the connection flow path 8621 may be located at a higher position than the bottom surface of the water collection body 862. The connection flow path 8621 may extend from the water collection communication hole 827 toward the space between the outer circumferential surface of the guide surface 86222 and the outer circumferential surface of the inflow surface 86221. The end of the connection flow path 8621 may form a portion of the inner circumferential surface of the water collection body 862.

That is, the bottom surface of the connection flow path 8621 may form a portion of the side surface of the water collection body 862, and the end of the connection flow path 8621 that is connected to the water collection body 862 may have a curvature corresponding to the inner circumferential surface of the water collection body 862.

Accordingly, the water supplied to the connection flow path 8621 may flow to the water collection body 862 due to the weight thereof, and may then flow from the water collection body 862 to the inflow surface 86221 while rotating along the circumference of the guide surface 86222 due to the inclination of the guide surface 86222.

Further, when the condensed water rotates along the inner circumferential surface of the water collection body 862, the movement of water may not be impeded by the connection flow path 8621, which is formed to be stepped at a high position.

Figure 18:
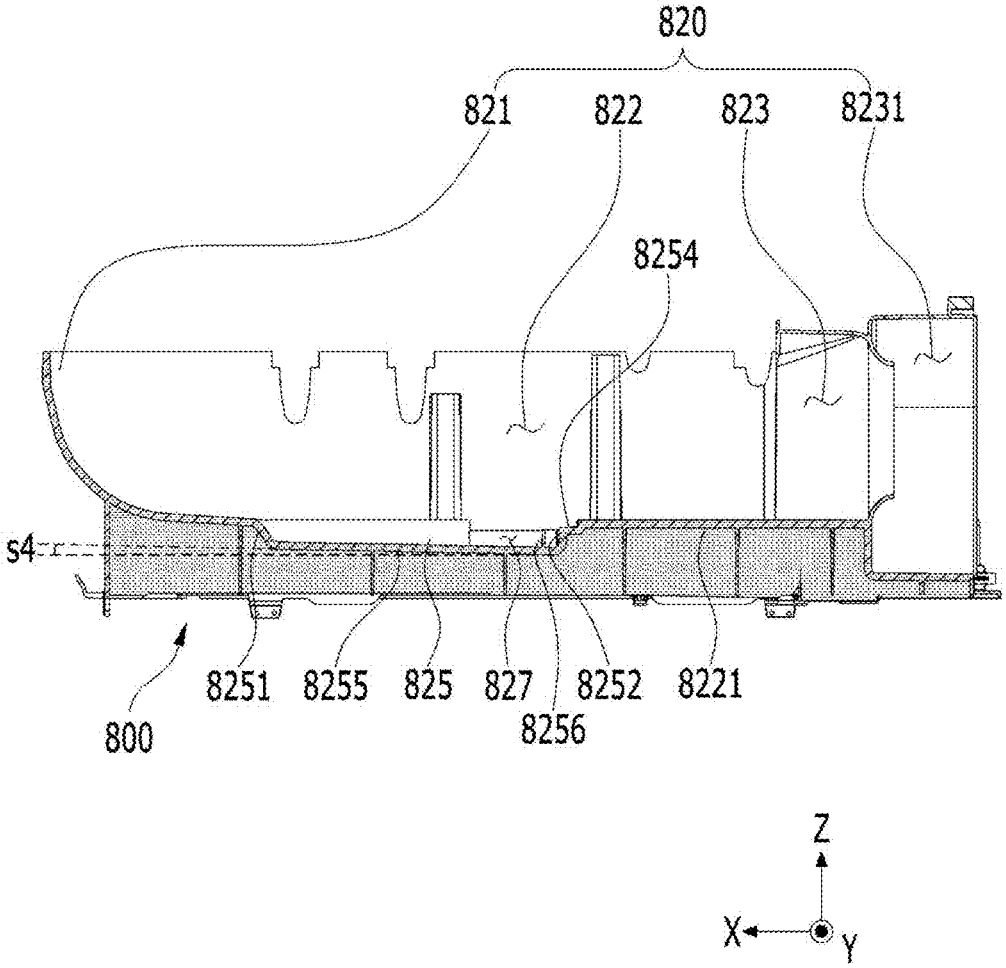
FIG. 18 is a cross-sectional view taken along line D-D in FIG. 17.

FIG. 18 is a cross-sectional view taken along line D-D in FIG. 17 when viewed from the right.

Referring to FIG. 18, the collection guide part 825 may include the extending stepped portion 8252, which extends from the bottom surface of the transfer duct, which supports the condenser, so as to be stepped downwards, the guide bottom surface 8255, which extends from the extending stepped portion 8252 to the region below the evaporator, and the inclined guide portion 8251, which extends from the guide bottom surface 8255 to the bottom surface of the transfer duct or the inflow duct.

The transfer duct 822 may include the guide bottom surface 8255 recessed downwards so as to guide the condensed water to the water collection part 860. The collection guide part 825 may include the inclined guide portion 8251 forming the front surface thereof.

Further, the bottom surface of the inflow duct 821 and the guide bottom surface 8255 may be connected via the inclined guide portion 8251.

The inclined guide portion 8251 may be formed in the shape of a curve that is convex downwards, or may extend downwards in a stepped shape from the bottom surface of the transfer duct 822.

In the case in which the inclined guide portion 8251 is formed to be stepped downwards, a portion of the bottom surface of the transfer duct 822, which is recessed downwards so that the condensed water moves thereon, may be defined as the guide bottom surface 8255.

The guide bottom surface 8255 may extend backwards from the inclined guide portion 8251, and may be connected to the bottom surface of the transfer duct 822, facing the second heat exchanger 920, in a stepped shape. That is, the guide bottom surface 8255 may be disposed at a lower position than the transfer bottom surface 8221. The collection guide part 825 may include the extending stepped portion 8252 forming the rear surface thereof. The guide bottom surface 8255 may be connected to the transfer bottom surface 8221 in a stepped shape by the extending stepped portion 8252.

In other words, the guide bottom surface 8255 may be provided at a lower position than the bottom surface of the inflow duct 821 and the transfer bottom surface 8221. That is, among the guide bottom surface 8255, the bottom surface of the inflow duct 821 and the transfer bottom surface 8221, the guide bottom surface 8255 may be located closest to the ground.

The extending stepped portion 8252 and the inclined guide portion 8251 may form the space of the collection guide part 825 in which the condensed water is accommodated.

The guide bottom surface 8255 may form the bottom surface of the collection guide part 825 which guides the condensed water generated by the first heat exchanger to the water collection part 860. The collection guide part 825 may include the water collection communication hole 827 formed through the side wall of the movement duct 822 so as to allow the circulation flow path part 820 and the water collection part 860 to communicate with each other. The water collection communication hole 827 may be provided between the inclined guide portion 8251 and the extending stepped portion 8252.

The distance between the extending stepped portion 8252 and the inclined guide portion 8251 or the distance therebetween in the forward-backward direction may be less than the width of the guide bottom surface 8255 or the length of the guide bottom surface 8255 in the leftward-rightward direction.

The distance between the extending stepped portion 8252 and the inclined guide portion 8251 may gradually decrease in a direction from one side surface of the transfer duct 822, in which the water collection communication hole 827 is formed, to the other side surface of the transfer duct 822.

Accordingly, the water collected on the guide bottom surface 8255 may be rapidly guided to the water collection communication hole 827.

Further, the guide partition 8256 configured to protrude upwards from the guide bottom surface 8255 so as to prevent the condensed water flowing on the guide bottom surface 8255 from overflowing toward the spot at which the second heat exchanger is installed may be provided between the inclined guide portion 8251 and the extending stepped portion 8252.

The guide partition 8256 may be spaced apart from the extending stepped portion 8252 by a designated distance, and thereby, overflow of the condensed water flowing through the collection guide part 825 toward the second heat exchanger may be primarily prevented by the guide partition 8256, and may then be secondarily prevented by the extending stepped portion 8252.

The guide bottom surface 8255 may be provided such that the distance between the guide bottom surface 8255 and the ground decreases in the direction from the inclined guide portion 8251 to the extending stepped portion 8252, as shown in this drawing. That is, the guide bottom surface 8255 may be inclined downwards toward the water collection communication hole 827. In other words, the guide bottom surface 8255 may be inclined so that the condensed water moves toward the water collection communication hole 827 due to the weight thereof. An inclination formed between the guide bottom surface 8255 and the ground in the forward-backward direction may be defined as the fourth inclination angle s4. The fourth inclination angle s4 (the main inclination angle) may be more gentle than a reference inclination angle, at which water flows slowly for a time period exceeding a reference time period. For example, the main inclination angle may be set to be less than 5 degrees, and the reference time period may be set to 3 seconds. The main inclination angle s4 may be more gentle than the auxiliary inclination angle s3.

The transfer support surface 8254 connected to the bottom surface of the transfer duct 822, facing the second heat exchanger 920, in a stepped shape may be formed at the upper end of the extending stepped portion 8252. The transfer support surface 8254 may support the water cover coupled to the upper portion of the collection guide part 825.

Figure 19:
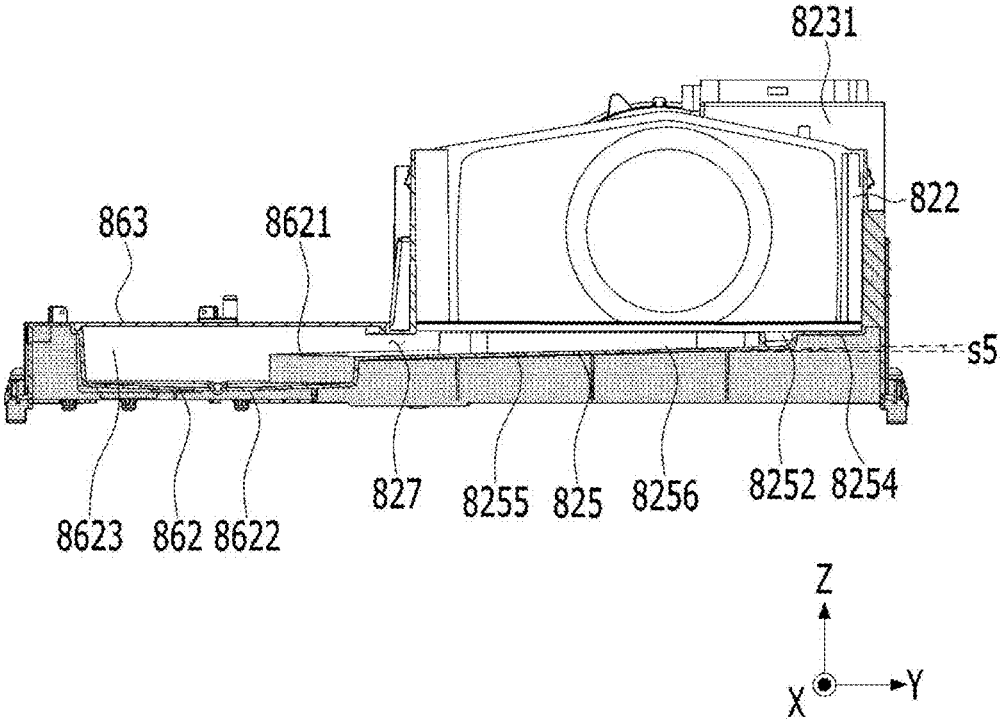
FIG. 19 is a cross-sectional view taken along line C-C in FIG. 17.

FIG. 19 is a cross-sectional view taken along line C-C in FIG. 17 when viewed from the front.

Referring to FIG. 19, as described above, the circulation flow path part 820 may be provided on one side of the base 800, and the water collection part 860 configured to collect condensed water generated in the circulation flow path part 820 may be provided on the other side of the base 800. The water collection part 860 and the circulation flow path part 820 may communicate with each other through the water collection communication hole 827 formed through the side wall of the circulation flow path part 820.

The base 800 may include the connection flow path 8621 connecting the water collection body 862 to the water collection communication hole 827. The collection guide part 825 for guiding the condensed water generated by the first heat exchanger to the water collection part 860 may be formed on the bottom surface of the transfer duct 822.

The water collection body 862 may be formed to be depressed in the base 800 such that the bottom surface thereof is located at a lower position than the collection guide part 825 or the connection flow path 8621.

The connection flow path 8621 may be located at a higher position than the bottom surface 8622 of the water collection body 862.

Accordingly, the majority of the collection guide part 825 is located at a higher position than the water collection communication hole 827, and the water collection part 860 is located at a lower position than the water collection communication hole 827. Therefore, it is possible to prevent water from remaining in the transfer duct 822.

The lower surface of the pump 861 may be located at a lower position than the water collection communication hole 827. Therefore, it possible to minimize the amount of water remaining in the water collection part 860.

When it is sensed that the water collection part 860 is full of water, the pump 861 may discharge the water so that the water level is lowered to a level lower than the height of the outer circumferential surface of the water collection body 862 or the height of the outer circumferential surface of the guide surface 86222.

The connection flow path 8621 may be inclined such that the height thereof gradually decreases from the water collection communication hole 827 to the outer circumferential surface of the water collection body 862. The inclination may correspond to the third inclination angle s3 or the fifth inclination angle s5.

Accordingly, the water collected in the collection guide part 825 may be collected in the water collection body 862 due to the weight thereof.

Specifically, the guide bottom surface 8255 forming the bottom surface of the collection guide part 825 may be inclined so that the condensed water moves to the water collection communication hole 827 due to the weight thereof.

The guide bottom surface 8255 may be formed such that the distance between the guide bottom surface 8255 and the ground gradually decreases in a direction approaching the water collection communication hole 827. That is, the distance between the guide bottom surface 8255 and the ground may gradually increase in a direction away from the water collection communication hole 827. In other words, the guide bottom surface 8255 may be inclined such that the height thereof gradually decreases in a direction approaching the water collection communication hole 827, and owing to such an inclination, the condensed water on the guide bottom surface 8255 may be naturally transferred to the water collection communication hole 827, and the condensed water having passed through the water collection communication hole 827 may be stored in the water collection body 862.

Among inclinations formed between the guide bottom surface 8255 and the ground, an inclination formed between the guide bottom surface 8255 and the ground in the direction from the water collection guide part 825 to the water collection body 862 may be defined as a fifth inclination angle s5. That is, an inclination formed between the guide bottom surface 8255 and the ground in the width direction may be defined as the fifth inclination angle s5.

The fourth inclination angle s4, i.e. the inclination of the guide bottom surface 8255 in the forward-backward direction defined in FIG. 18, and the fifth inclination angle s5 of the guide bottom surface 8255 may be provided as angles at which the condensed water flowing on the guide bottom surface 8255 may flow toward the water collection communication hole 827 without being stagnant at a specific position of the guide bottom surface 8255. For example, the fifth inclination angle s5 may be equal to the fourth inclination angle s4, or may be equal to or less than the fourth inclination angle s4.

The guide bottom surface 8255 may be connected parallel to the connection flow path 8621 through the water collection communication hole 827. The connection flow path 8621 may be provided to be stepped upwards from the circumference of the water collection bottom surface 8622 forming the bottom surface of the water collection body 862, and may be connected to the guide bottom surface 8255. The connection flow path 8621 may be inclined with respect to the ground in the same manner as the guide bottom surface 8255. Further, an inclination angle between the connection flow path 8621 and the ground may be equal to the fifth inclination angle s5.

That is, the guide bottom surface 8255 and the connection flow path 8621 may be connected into one surface through the water collection communication hole 827, and the water collection bottom surface 8622 may be stepped downwards from such a surface so as to store the condensed water. The water collection bottom surface 8622 may be disposed at a lower position than the guide bottom surface 8255.

Further, the connection flow path 8621 may be provided so as to be in contact with the water collection side surface 8623. That is, the connection flow path 8621 may be located between the water collection side surface 8623 and the water collection communication hole 827. Therefore, the connection flow path 8621 may guide the condensed water having entered through the water collection communication hole 827 so that the condensed water flows along the water collection side surface 8623.

The connection flow path 8621 may guide the condensed water having passed through the water collection communication hole 827 so that the condensed water does not directly fall to the water collection bottom surface 8622, and flows along the circumference of the water collection body 862 while passing through the upper surface of the connection flow path 8621. When the condensed water is accelerated in the circumferential direction of the water collection body 862 while passing over the connection flow path 8621, the condensed water may flow while rotating along the circumference of the water collection body 862.

When the condensed water flows while rotating along the circumference of the water collection body 862, foreign substances or lint included in the condensed water may be naturally accumulated on the side surface of the water collection body 862. The foreign substances are not moved to the center of the water collection body 862 provided with the pump installed therein, and are accumulated on the side surface of the water collection body 862 by the rotating flow, thereby being capable of preventing occurrence of an error in operation of the pump due to the foreign substances.

Further, when the pump operates, the condensed water stored in the water collection body 862 may be transferred to the water collection communication hole 827 by centrifugal force, and, in this case, the connection flow path 8621 is stepped from the water collection bottom surface 8622 and may thus prevent the condensed water from flowing to the water collection communication hole 827.

In other words, the connection flow path 8621 may guide the condensed water entering the water collection body 862 through the water collection communication hole 827 so that the condensed water flows along the water collection side surface 8623, and may prevent the condensed water stored in the water collection body 862 from flowing backwards through the water collection communication hole 827.

Figure 20:
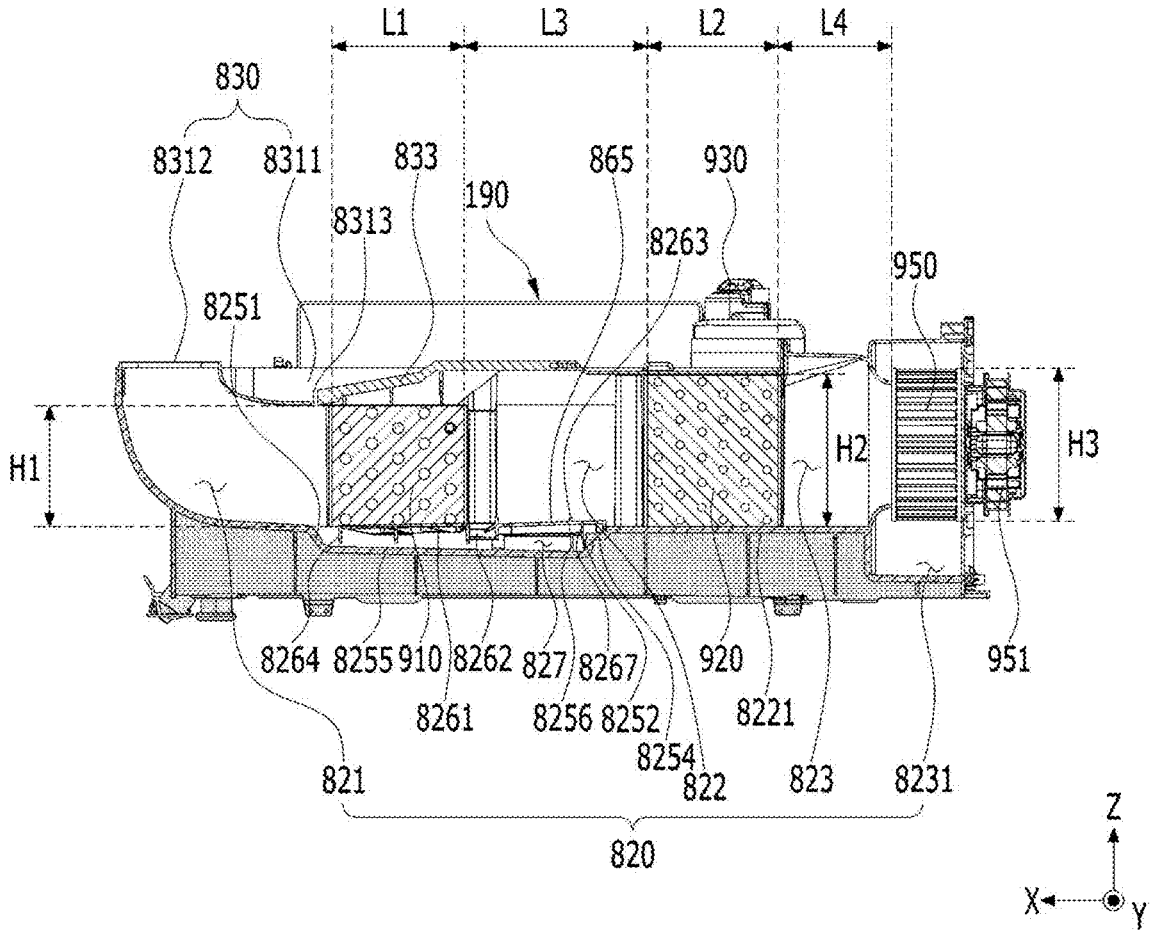
FIG. 20 is a cross-sectional view taken along line B-B in FIG. 14A.

FIG. 20 is a cross-sectional view taken along line B-B in FIG. 14A when viewed from the right. FIG. 20 illustrates the elements, such as the first heat exchanger, the second heat exchanger, the water cover, the duct cover, the compressor, etc., installed on the base and, when a description of FIG. 20 is given, FIGS. 14, 15, and 18 will be referred to. Hereinafter, elements added in FIG. 20 will be mainly described.

In the conventional laundry treating apparatus, the water cover configured to support the first heat exchanger so that the first heat exchanger is spaced apart from the bottom surface of the circulation flow path part is located under the second heat exchanger, and may thus support the second heat exchanger also. Therefore, condensed water generated by the first heat exchanger may flow to the second heat exchanger, or may contact the second heat exchanger. Thereby, the condensed water may be evaporated again, and may then enter the inside of the drum.

However, it is necessary to maintain the lower moisture content of air supplied to the inside of the drum in order to improve drying efficiency of laundry and, in the conventional laundry treating apparatus, from this point of view, heat exchange efficiency of the heat exchange unit is reduced and drying efficiency of the entirety of the laundry treating apparatus is reduced.

Referring to FIG. 20, the water cover 826 may be installed under the first heat exchanger 910. The first heat exchanger 910 may be installed to be supported by the water cover 826. The water cover 826 may be coupled to the open upper surface of the collection guide part 825 so as to prevent the condensed water transferred through the collection guide part 825 from contacting the first heat exchanger 910.

The water cover 826 according to one embodiment of the present disclosure may be provided to be spaced apart from the second heat exchanger 920. The water cover 826 may support the first heat exchanger 910, and may be spaced apart from the second heat exchanger 920 so as to prevent the condensed water from evaporating again around the second heat exchanger 920.

Therefore, the condensed water may be effectively collected in the water collection part 860, and heat exchange of the second heat exchanger 920 with the condensed water may be prevented and thus heat exchange efficiency of the second heat exchanger 920 may be improved. Further, as heat exchange efficiency of the second heat exchanger 920 is increased, drying efficiency of the entirety of the laundry treating apparatus may be improved.

The water cover 826 may be installed to be supported by the inflow support planes 8253 and the transfer support surface 8254 formed at the collection guide part 825, and may thus be spaced apart from the guide bottom surface 8255. A shield body 8263 of the water cover 826 may be supported by the transfer support surface 8254 formed at the upper end of the extending stepped portion 8252.

The water cover 826 may include a water transmission body 8261, which is in contact with the lower surface of the first heat exchanger 910 so as to guide the condensed water generated by the first heat exchanger 910 to the collection guide part 825, and the shield body 8263 configured to extend backwards from the water transmission body 8261 so as to shield the open upper surface of the collection guide part 825.

The water transmission body 8261 may include barrier ribs 8264 configured to extend from the water transmission body 8261 in a direction away from the first heat exchanger 910. The barrier ribs 8264 may prevent air having entered through the inflow duct 821 from entering the collection guide part 825 without passing through the first heat exchanger 910. A plurality of barrier ribs 8264 may be provided to be spaced apart from each other in the forward-backward direction. That is, the plurality of barrier ribs 8264 may be disposed sequentially from front to rear so as to be spaced apart from each other.

Further, the cover partition 8267 extending downwards from the shield body 8263 may be disposed between the guide partition 8256 and the extending stepped portion 8252. The cover partition 8267 may prevent the condensed water transferred on the collection guide part 825 from being released from the collection guide part 825 and then overflowing toward the second heat exchanger 920 due to the volume of circulating air passing through the transfer duct 822.

The cover partition 8267 may prevent overflow of the condensed water together with the guide partition 8256, which is located in front thereof, and the extending stepped portion 8252, which is located in the rear thereof.

The width W1 of the transfer duct 822 (refer to FIG. 17) may be increased to be greater than or equal to half the width W2 of the base 800 (refer to FIG. 17), and thus the widths of the first heat exchanger 910 and the second heat exchanger 920 installed in the transfer duct 822 may also be increased.

As the widths of the first heat exchanger 910 and the second heat exchanger 920 are increased, air flowing along the circulation flow path part 820 may be dehumidified or heated over a larger area. Therefore, although the lengths L1 and L2 of the first heat exchanger 910 and the second heat exchanger 920 in the forward-backward direction are slightly reduced, the first heat exchanger 910 and the second heat exchanger 920 may exchange heat with the same or larger amount of air, compared to the conventional heat exchanger.

As the length L2 of the second heat exchanger 920 in the forward-backward direction is reduced, the distance L3 between the first heat exchanger 910 and the second heat exchanger 920 may be greater than or equal to the length L2 of the second heat exchanger 920 in the forward-backward direction.

As the width W1 of the transfer duct 822 is increased, the width of the second heat exchanger 920 may also be increased. Further, as the width of the second heat exchanger 920 is increased, the length L2 of the second heat exchanger 920 in the forward-backward direction may be reduced, and thus the distance L3 between the first heat exchanger 910 and the second heat exchanger 920 may be increased.

Since the space between the first heat exchanger 910 and the second heat exchanger 920 is increased, contact of the condensed water generated by the first heat exchanger 910 with the second heat exchanger 920 may be prevented. When the condensed water contacts the second heat exchanger 920, the second heat exchanger 920 exchanges heat with the condensed water, and thus heat exchange efficiency of the second heat exchanger 920 may be reduced. However, since the space between the first heat exchanger 910 and the second heat exchanger 920 is expanded, reduction in heat exchange efficiency of the second heat exchanger 920 may be prevented.

Further, the second heat exchanger 920 is provided to heat air. Since a large amount of energy is consumed to heat air, increase in heat exchange efficiency of the second heat exchanger 920 is important in increasing the overall efficiency of the dryer.

However, as the area of the second heat exchanger 920 that is in contact with elements other than air increases, the quantity of heat that should be used to heat air may be consumed. Therefore, the second heat exchanger 920 may be installed so as to minimize the area thereof that is in contact with other elements.

When the second heat exchanger 920 is installed in the transfer duct 822, the lower surface of the second heat exchanger 920 may be supported by the transfer duct 822. Therefore, when the area of the lower surface of the second heat exchanger 920 is reduced, loss of the quantity of heat of the second heat exchanger 920 due to thermal conduction may be prevented.

Therefore, the length L2 of the second heat exchanger 920 in the forward-backward direction may be less than or equal to the length L1 of the first heat exchanger 920 in the forward-backward direction. Thereby, heat loss from the lower surface of the second heat exchanger 920 may be reduced. Further, when the length L2 of the second heat exchanger 920 in the forward-backward direction is reduced, the distance L3 between the first heat exchanger 910 and the second heat exchanger 920 may be increased, and the condensed water may be prevented from contacting the second heat exchanger 920.

The diameter H3 of the circulation flow path fan 950 may be greater than or equal to the height H2 of the second heat exchanger 920. When the width W1 of the transfer duct 822 is increased, the amount of air flowing along the circulation flow path part 820 may be increased. Then, the circulation flow path fan 950 having the increased diameter H3 may increase the circulation rate of air.

Figure 21:
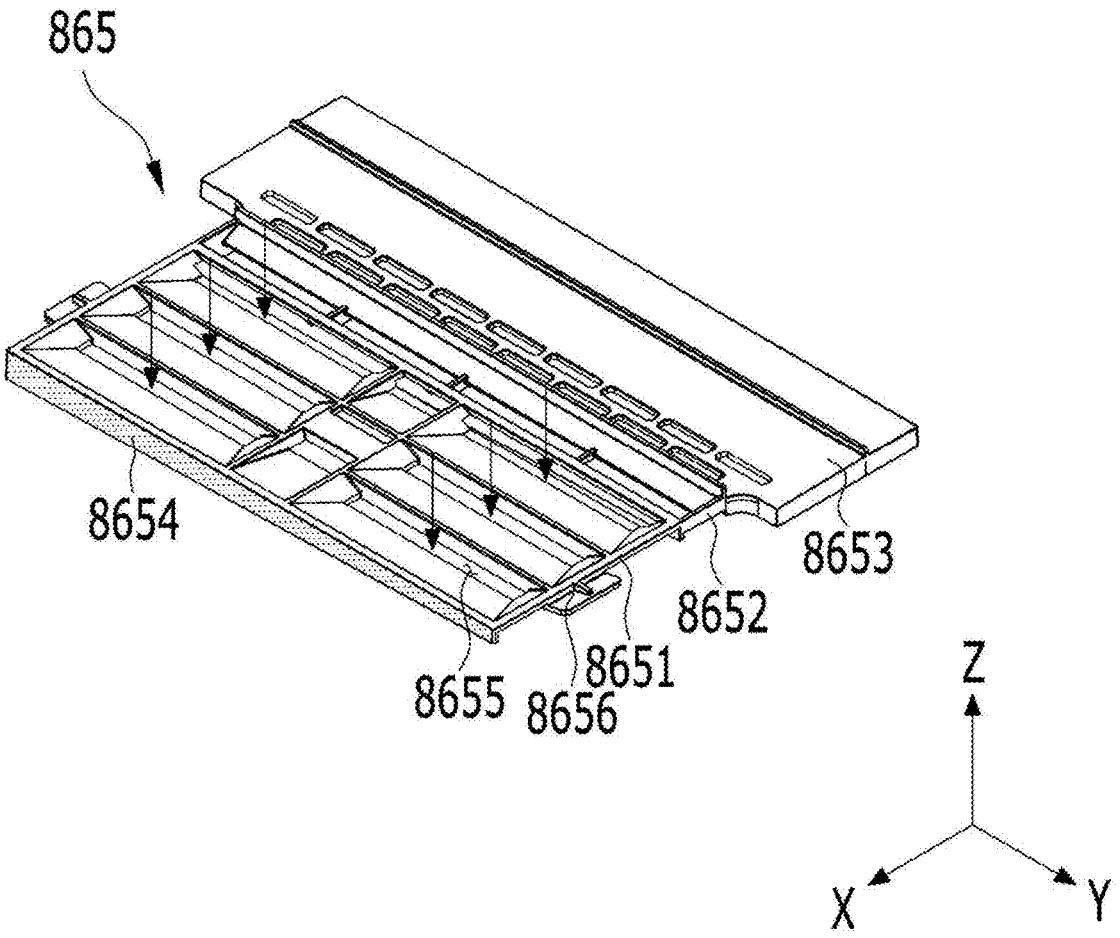
FIG. 21 is a perspective view illustrating a water cover according to one embodiment of the present disclosure when viewed from above.
Figure 22:
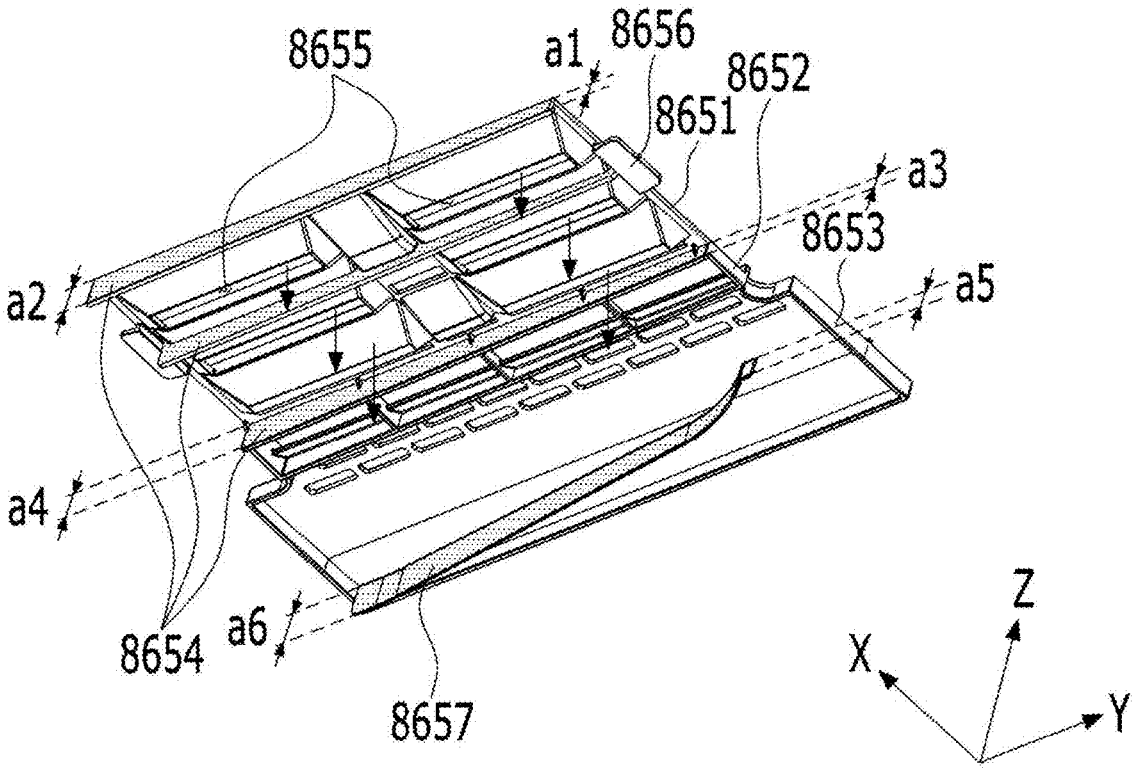
FIG. 22 is a perspective view illustrating the water cover according to one embodiment of the present disclosure when viewed from below.

FIG. 21 is a perspective top view of the water cover according to one embodiment of the present disclosure, and FIG. 22 is a perspective bottom view of the water cover according to one embodiment of the present disclosure.

Referring to FIG. 21, the water cover 826 may include the water transmission cover 8261 provided to support the first heat exchanger 910 and to guide the condensed water generated by the first heat exchanger 910 to the collection guide part 825 through the water cover 826, the shield body 8263 provided at the rear of the water transmission cover 8261 so as to shield the open upper surface of the collection guide part 825, and a connection body 8262 connecting the water transmission cover 8261 to the shield body 8263.

The first heat exchanger 910 may be supported by the upper surface of the water transmission cover 8261. Water transmission holes 8265 may be formed through the water transmission body 8261. A plurality of water transmission holes 8265 may be provided in various shapes as long as it may easily transmit the condensed water generated by the first heat exchanger 910. The water transmission holes 8265 may be provided as communication holes so as to guide the condensed water generated by the first heat exchanger 910 to the collection guide part 825 through the water transmission body 8261.

Support ribs 8266 configured to protrude from the side surfaces of the water transmission body 8261 so as to support the water transmission body 8261 spaced apart from the guide bottom surface 8255 may be formed on the side surfaces of the water transmission body 8266. The support ribs 8266 may protrude from the left and right side surfaces of the water transmission body 8261. Referring to FIGS. 16 and 17, the support ribs 8266 may be supported by the inflow support planes 8253 provided at the side surfaces of the collection guide part 825.

The rear portion of the shield body 8263 may be supported by the transfer support surface 8254 of the collection guide part 825. The support ribs 8266 are supported by the inflow support planes 8253, the shield body 8263 is supported by the transfer support surface 8254, and thereby, the water cover 826 may withstand the load of the first heat exchanger 910, and may support the first heat exchanger 910 so that the first heat exchanger 910 is spaced apart from the collection guide part 825.

Referring to FIG. 22, the water cover 826 may further include the barrier ribs 8264 configured to extend downwards from the lower surface of the water transmission body 8261. The barrier ribs 8264 may be installed between the space between the guide bottom surface 8255 and the water transmission body 8261. During the drying cycle, air discharged forwards from the drum 200 is dehumidified by the first heat exchanger 910, is heated by the second heat exchanger 920, and is then supplied again to the rear portion of the drum 200. In order to improve heat exchange efficiency and drying efficiency, air discharged from the drum 200 may pass through only a space in which the first heat exchanger 910 and the second heat exchanger 920 are installed.

However, the collection guide part 825 configured to guide the condensed water to the water collection body 862 may be formed on the bottom surface of the transfer duct 822 in which the first heat exchanger 910 and the second heat exchanger 920 are installed, as described above. Thereby, there is the possibility that air discharged forwards from the drum 200 enters the collection guide part 825 located under the first heat exchanger 910. When the discharged air enters the collection guide part 825, the corresponding air may not sufficiently exchange heat with the first heat exchanger 910, and thus the dehumidification degree of the air is reduced. In this case, drying performance may be reduced due to reduction in heat exchange efficiency.

Therefore, it is desirable to prevent air from entering into the space between the guide bottom surface 8255 and the water transmission body 8261 supporting the first heat exchanger 910. The barrier ribs 8264 extending downwards from the water transmission body 8261 may be installed in the above space between the water transmission body 8261 and the guide bottom surface 8255, and may thus prevent excessive inflow of air into the space. Here, a plurality of barrier ribs 8264 may be provided to be spaced apart from each other in the forward-backward direction.

The barrier ribs 8264 may be provided to be spaced apart from the guide bottom surface 8255 so as not to impede the flow of the condensed water transferred on the guide bottom surface 8255. That is, the barrier ribs 8264 may prevent circulating air from leaking to the collection guide part 825 by blocking a designated part of the space formed between the water transmission body 8261 and the guide bottom surface 8255.

The shield body 8263 may include the cover partition 8267 configured to extend downwards from the lower surface thereof. The cover partition 8267 may be formed in a structure corresponding to the shape of the extending stepped portion 8252 of the collection guide part 825. In the case in which the extending stepped portion 8252 is provided parallel to the inclined guide portion 8251, the cover partition 8267 may be provided parallel to the extending stepped portion 8252. In the case in which the extending stepped portion 8252 is provided to gradually get closer to the inclined guide portion 8251 in the direction from left to right, the cover partition 8267 may be provided to gradually get closer to the water transmission body 8261 in the direction from left to right in the same manner as the extending stepped portion 8252.

When the water cover 826 is installed above the collection guide part 825, the cover partition 8267 may be located in front of the extending stepped portion 8252. Further, the cover partition 8267 may be located between the extending stepped portion 8252 and the guide partition 8256.

The cover partition 8267 may prevent the condensed water within the collection guide part 825 from overflowing toward the second heat exchanger 920 due to the volume of air moving from front to rear when air in the drum 200 is circulated.

The condensed water located in the collection guide part 825 may be transferred backwards by air flowing toward the transfer duct 822. Here, the guide partition 8256, the cover partition 8267 and the extending stepped portion 8252 may prevent the condensed water from flowing to the outside of the collection guide part 825 and thus overflowing toward the second heat exchanger 920.

The barrier ribs 8264 may extend downwards from the water transmission body 8261 to different lengths depending on the positions of the barrier ribs 8264. The barrier ribs 8264 may block the space between the water cover 826 and the guide bottom surface 8255 while not impeding the flow of the condensed water on the collection guide part 825. Since the guide bottom surface 8255 may be inclined toward the water collection communication hole 827, as described above, when the barrier ribs 8264 extend from the water transmission body 8261 by the same length, the distance between the guide bottom surface 8255 and the barrier ribs 8264 gradually increases in the direction approaching the water collection communication hole 827. Therefore, air may enter the corresponding space, and thus heat exchange efficiency may be reduced.

Therefore, the lengths of the barrier ribs 8264 extending from the water transmission body 8261 may increase in the direction approaching the water collection communication hole 827. As shown in this drawing, the length of the barrier ribs 8264 extending from the water transmission body 8261 may be increased in the direction from right to left (in the Y-axis direction). Further, when a plurality of barrier ribs 8264 is provided at corresponding positions in the forward-backward direction (i.e. in the X-axis direction), the barrier rib 8264 located at a rear position may extend to a greater length than the barrier rib 8264 located at a front position. That is, the barrier ribs 8264 may be provided to have lengths corresponding to the inclination of the guide bottom surface 8255 facing the ends of the barrier ribs 8264.

The barrier ribs 8264 may be provided to correspond to the inclination of the guide bottom surface 8255, as described above, and thereby, reduction in heat exchange efficiency due to inflow of air in the drum 200 into the collection guide part 825 without passing through the first heat exchanger 910 may be prevented.

Figure 23B:
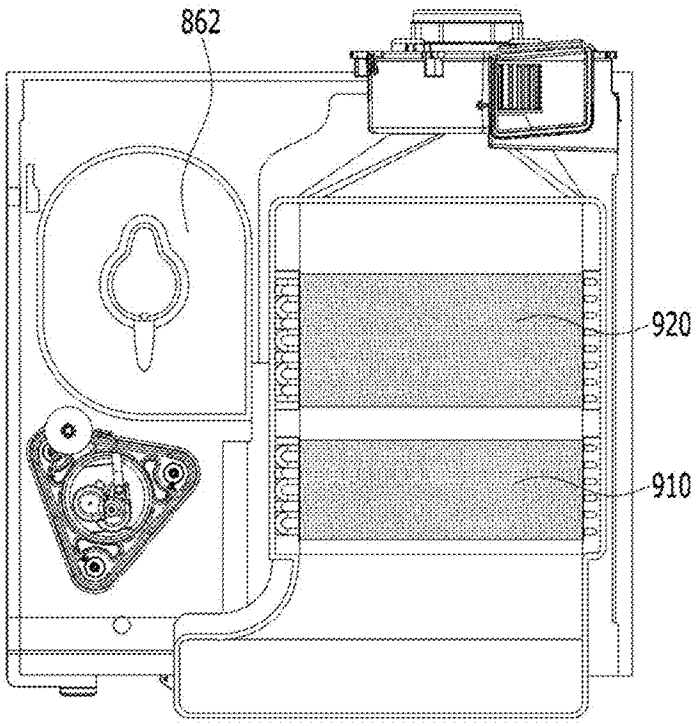
FIGS. 23A and 23B are top views illustrating a base according to another embodiment of the present disclosure.
Figure 23A:
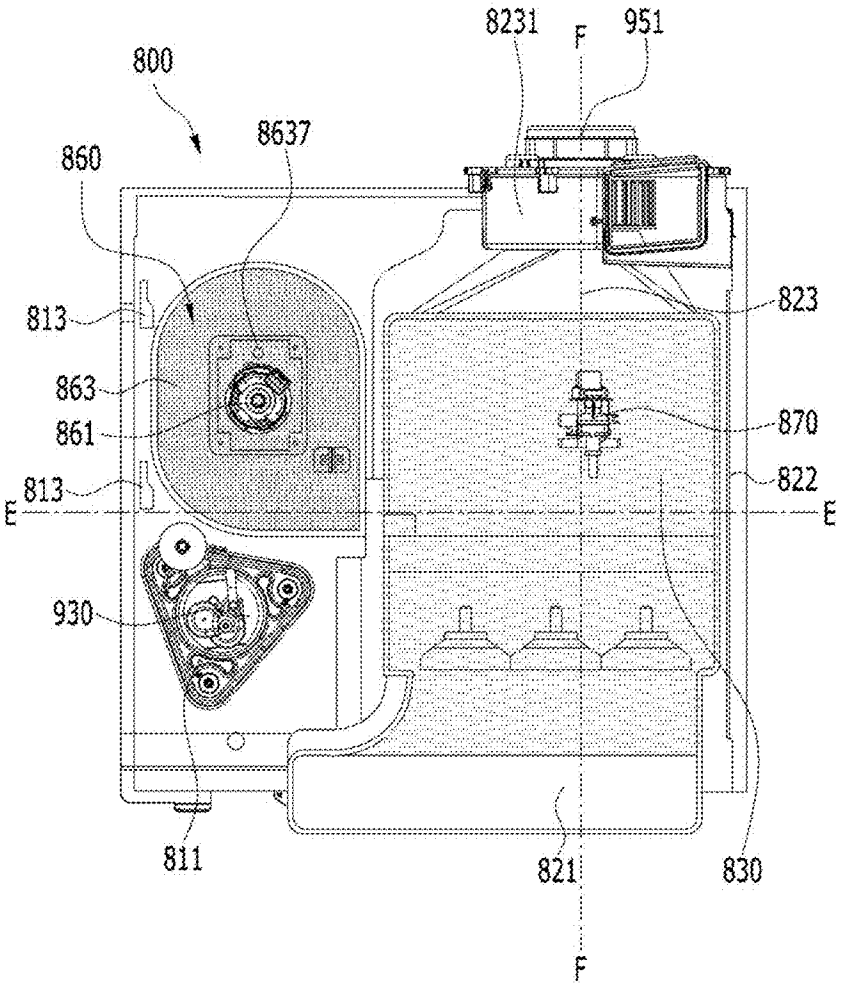
Figure 24:
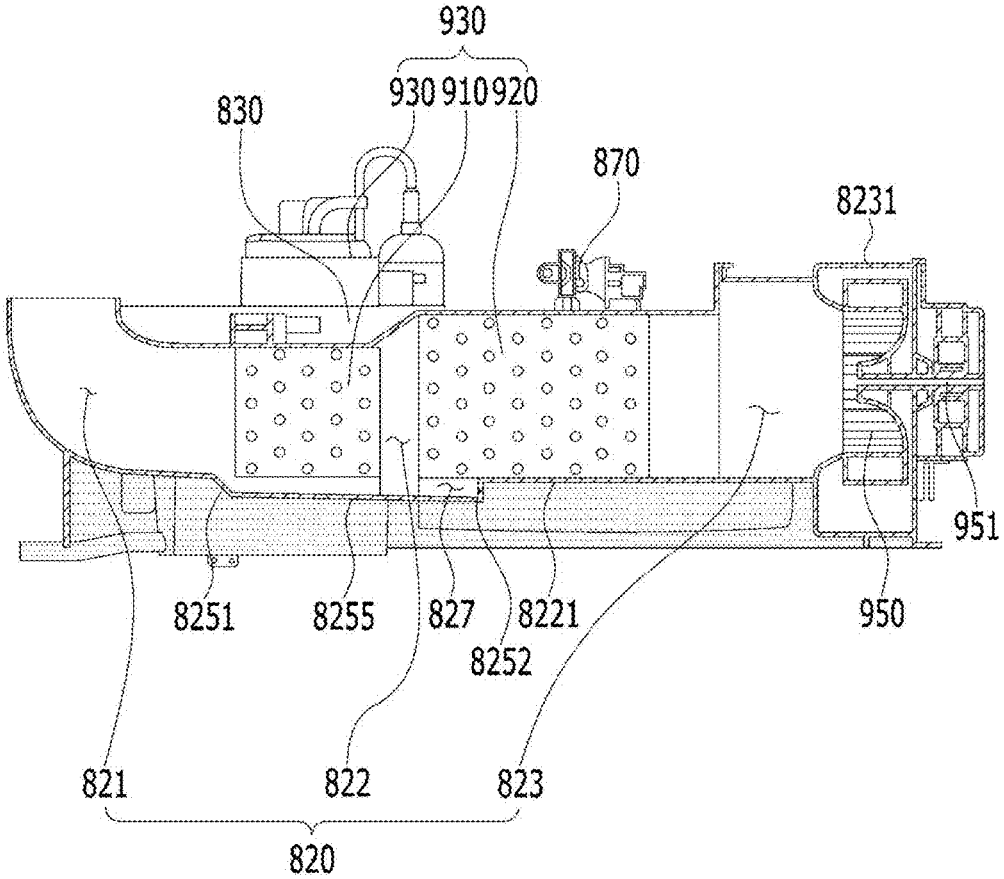
FIG. 24 is a cross-sectional view taken along line F-F in FIG. 23A when viewed from the right.
Figure 25:
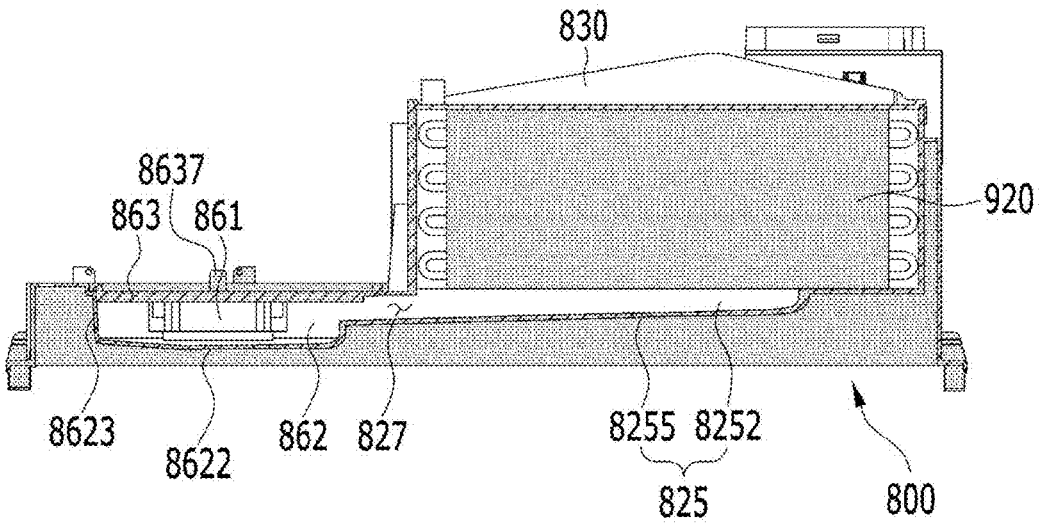
FIG. 25 is a cross-sectional view taken along line E-E in FIG. 23A when viewed from the front.

FIGS. 23A and 23B illustrate a laundry treating apparatus according to another embodiment of the present disclosure, and specifically, is a top view of a base on which a compressor is disposed in front of a water collection part. FIG. 24 is a cross-sectional view taken along line F-F in FIG. 23A when viewed from the right. FIG. 25 is a cross-sectional view taken along line E-E in FIG. 23A when viewed from the front.

The illustration shown in FIGS. 23A and 23B will be understood with reference to FIGS. 14A and 14B, the illustration shown in FIG. 24 will be understood with reference to FIG. 15, and the illustration shown in FIG. 25 will be understood with reference to FIG. 20. Other elements except for modified elements in this embodiment, which are substantially the same as those in the former embodiment in which the compressor is located behind the water collection part, will be denoted by the same reference numerals even though they are denoted in different drawings. Hereinafter, the disposition relationships between a compressor installation part and the water collection part will be mainly described.

Referring to FIGS. 23A and 23B, a circulation flow path part 820 configured to circulate air in a drum may be disposed on one side of a base 800, and a compressor installation part 811 spaced from the circulation flow path part 820 to accommodate a compressor 930 mounted therein and a water collection part 860 may be disposed on the other side of the base 800.

The compressor installation part 811 may be disposed such that at least a portion thereof overlaps the water collection part 860 in the forward-backward direction. Further, the compressor installation part 811 may be disposed in front of the water collection part 860.

When the water collection part 860 is disposed to overlap the compressor installation part 811 in the forward-backward direction, the capacity of the water collection part 860 to accommodate the condensed water may be increased. Therefore, the frequency with which the user removes the condensed water may be reduced, and thus user convenience may be improved.

Since compression efficiency of the compressor 930 is reduced when the compressor 930 is overheated, it is favorable to properly cool the compressor 930. Since the second heat exchanger 920 serves to heat the air in the drum, the disposition of the compressor 930 adjacent to the second heat exchanger 920 may be disadvantageous for cooling of the compressor 930.

In the case in which the compressor installation part 811 is disposed in front of the water collection part 860, the distance between the compressor 930 and the second heat exchanger 920 may be increased compared to the case in which the compressor installation part 811 is disposed behind the water collection part 860. Therefore, the disposition of the compressor installation part 811 in front of the water collection part 860 may be advantageous for cooling of the compressor 930. When cooling efficiency of the compressor 930 is increased, compressor efficiency of the compressor 930 may be increased, heat exchange efficiency of the second heat exchanger 920 may also be increased, and thus drying efficiency of the laundry treating apparatus may be improved.

The circulation flow path part 820 may include an inflow duct 821 configured such that air discharged from the drum flows thereinto, a discharge duct 823 configured to discharge the air toward the drum, and a transfer duct 822 connecting the inflow duct 821 to the discharge duct 823.

A first heat exchanger 910 and the second heat exchanger 920 may be installed in the transfer duct 822. The first heat exchanger 910 and the second heat exchanger 920 may sequentially exchange heat with air discharged from the drum so as to dehumidify and heat the air.

The water collection part 860 may be disposed such that at least a portion thereof overlaps the second heat exchanger 920 in the leftward-rightward direction. Further, the compressor installation part 811 may be disposed such that at least a portion thereof overlaps the first heat exchanger 910 in the leftward-rightward direction.

When the water collection part 860 is disposed to overlap the second heat exchanger in the leftward-rightward direction and the compressor installation part 811 is disposed to overlap the first heat exchanger 910 in the leftward-rightward direction, the distance between the compressor installation part 811 and the second heat exchanger 920 may be increased, as described above. Therefore, cooling efficiency of the compressor 930 may be improved.

Further, when the compressor installation part 811 is disposed to overlap the first heat exchanger 910 and the water collection part 860 is disposed to overlap the compressor installation part 811 in the forward-backward direction, the water collection part 860 may be located at the rear portion of the base 800.

When the water collection part 860 is located at the rear portion of the base 800, the distance between a water storage tank (refer to FIG. 3), which stores condensed water so that the user removes the condensed water stored in the water collection part 860, and the water collection part 860 is reduced, and thus the length of a flow path connecting the water storage tank to the water collection part 860 may be reduced, and power consumption of a pump 861 configured to move water upwards may be reduced.

Further, a general laundry treating apparatus, such as a washer, is installed in a space (for example, a boiler room, a bathroom or the like) in which water is capable of being directly drained, and it is not necessary for a user to separately drain water used in washing. When the laundry treating apparatus according to this embodiment is installed in the space in which water is capable of being directly drained in the same manner as the washer, the condensed water may be discharged from the water collection part 860 directly to the outside of the cabinet using the pump 861.

In the case in which water is discharged from the water collection part 860 directly to the outside of the cabinet, when the water collection part 860 is located adjacent to the rear surface of the cabinet, power consumed by the pump 861 may be reduced.

Further, the water collection part 860 may be disposed such that at least a portion thereof overlaps the discharge duct 823 in the leftward-rightward direction. In addition, the compressor installation part 811 may be disposed such that at least a portion thereof overlaps the inflow duct 821.

The discharge duct 823 may be located at the rear portion of the circulation flow path part 820. Further, the inflow duct 821 may be located at the front portion of the circulation flow path part 820. Therefore, when the water collection part 860 overlaps the discharge duct 823 in the leftward-rightward direction and the compressor installation part 811 overlaps the inflow duct 821 in the leftward-rightward direction, the compressor installation part 811 may be disposed at the front portion of the base 800. Further, the water collection part 860 may be disposed at the rear portion of the base 800.

Therefore, cooling efficiency may be increased and thus drying efficiency may be improved, as described above. Further, power consumption of the pump 861 may be reduced.

In addition, the water collection part 860 may be disposed to overlap a control box installation part 813 in the leftward-rightward direction. When the water collection part 860 is disposed to overlap the control box installation part 813, a control wire connected to the pump 861 may be shortened, and thus control reliability may be increased.

The compressor 930 installed in the compressor installation part 811 may generate a large amount of heat. When an excessive amount of heat is applied to a control box, noise is generated, and thus reliability may be reduced. Therefore, the compressor installation pat 811 may be disposed in front of the control box installation part 813. Deterioration of reliability of the control panel may be prevented by locating the compressor 930 and the control panel 190 so as to be spaced apart from each other.

Further, the water collection part 860 may be disposed between the compressor installation part 811 and the rear plate 420 (refer to FIG. 5). When the water collection part 860 is disposed between the compressor installation part 811 and the rear plate 420, the compressor installation part 811, the water collection part 860 and the rear late 420 may be sequentially disposed in the forward-backward direction.

Therefore, the compressor installation part 811 may be disposed at the front portion of the base 800, and the water collection part 860 may be disposed at the rear portion of the base 800. Therefore, cooling efficiency of the compressor 930 may be increase, and power consumed by the pump 861 may be reduced.

Referring to FIG. 24, the base 800 may include a collection guide part 825 configured to guide condensed water generated by the first heat exchanger 910 to the water collection part 860. Further, the circulation flow path part 820 may include a water collection communication hole 827 configured such that the collection guide part 825 and the water collection part 860 communicate with each other therethrough.

The collection guide part 825 may be disposed to overlap the compressor installation part 811 in the leftward-rightward direction. Further, the water collection communication hole 827 may be located behind the compressor installation part 811.

The collection guide part 825 may include a guide bottom surface 8255 recessed downwards from the bottom surface of the transfer duct 822 so as to guide the condensed water generated by the first heat exchanger 910. The guide bottom surface 8255 may be provided at a lower position than the bottom surface of the inflow duct 821 and a transfer bottom surface 8221.

The collection guide part 825 may include an inclined guide portion 8251 forming the front surface of the collection guide part 825 and an extending stepped portion 8252 forming the rear surface of the collection guide part 825. The inclined guide portion 8251 may connect the inflow duct 821 and the guide bottom surface 8255 to each other in a stepped shape. The extending stepped portion 8252 may connect the bottom surface of the transfer duct 822 and the guide bottom surface 8255 to each other in a stepped shape.

The water collection communication hole 827 may be located under the second heat exchanger 920. When the water collection communication hole 827 is located under the second heat exchanger 920, the length of the collection guide part 825 in the forward-backward direction may be increased compared to the case in which the water collection communication hole 827 is disposed between the first heat exchanger 910 and the second heat exchanger 920.

Therefore, the transfer distance of the condensed water to reach the water collection part 860 may be increased. Therefore, a larger amount of the condensed water may be accommodated. The frequency with which the user removes the condensed water may be reduced, and thus user convenience may be improved.

The collection guide part 825 may be provided to be inclined toward the water collection communication hole 827. That is, the guide bottom surface 8255 may be provided such that the distance between the guide bottom surface 8255 and the ground gradually decreases in the direction approaching the water collection communication hole 827. Due to such an inclination, the condensed water flowing along the collection guide part 825 may be transferred toward the water collection communication hole 827 by gravity. When the condensed water is transferred through the water collection communication hole 827, the condensed water may pass through a region under the second heat exchanger 920.

Referring to FIG. 25, the water collection communication hole 827 may allow the collection guide part 825 and the water collection part 860 to communicate with each other under the second heat exchanger 920. The guide bottom surface 8255 may be inclined downwards toward the water collection communication hole 827.

That is, the guide bottom surface 8255 may be provided such that the distance between the guide bottom surface 8255 and the ground gradually decreases in the direction approaching the water collection communication hole 827. A water cover may be coupled to the open upper surface of the collection guide part 825. The water cover may prevent the condensed water transferred along the collection guide part 825 from contacting the first heat exchanger 910 and the second heat exchanger 920.

Further, the extending stepped portion 8252 forming the rear end of the collection guide part 825 may be located under the second heat exchanger 920. Since the extending stepped portion 8252 is located under the second heat exchanger 920, the space of the collection guide part 825 extending from the inclined guide portion 8251 to the extending stepped portion 8252 may be expanded so as to collect a larger amount of the condensed water.

A water collection body 862 may include a water collection bottom surface 8622 forming the bottom surface of the water collection body 862 in which the condensed water is collected, and a water collection side surface 8623 forming the side surface of the water collection body 862. The water collection side surface 8623 may connect the upper surface of the base to the water collection bottom surface 8622 in the manner of being stepped downwards.

A water collection cover 863 may be coupled to the open upper surface of the water collection body 862 so as to prevent water collected in the water collection body 862 from scattering to the outside. The pump 861 may be installed to pass through the water collection cover 863, and may move the condensed water collected in the water collection body 862 to the outside.

When the water collection part 860 is located behind the compressor 930, as described above, the collection guide part 825 may be expanded to collect a larger amount of the condensed water, and the frequency with which the user removes the condensed water may be reduced, and thus user convenience may be improved.

As is apparent from the above description, a driving unit for rotating a drum may be disposed at a position spaced apart from a base, which is disposed below the drum, thus providing a larger space for installation of parts in the base.

In addition, it is possible to effectively use the remainder of a space in a base other than a circulation flow path part for circulating air in a drum.

In addition, it is possible to secure the volume of a water collection part, which collects condensed water discharged from a drum, in a base without being restricted by a heat pump system or a driving unit.

In addition, a water collection part and a compressor of a heat pump system may be disposed parallel to each other beside a circulation flow path part in a flow direction.

In addition, a compressor of a heat pump system may be installed closer to the rear side of a cabinet than to the front side of the cabinet, thus reducing leakage of noise to outside.

In addition, it is possible to increase the amount of space for storing condensed water generated during a drying cycle, thus increasing the volume of the condensed water that can be accommodated.

In addition, it is possible to increase the amount of space for storing condensed water generated during a drying cycle, thus reducing the frequency with which a user removes the stored condensed water.

In addition, a compressor installation part, in which a compressor is installed, and a water collection part, in which condensed water is stored, are disposed in the forward-backward direction of a laundry treating apparatus, thus increasing the amount of space for accommodating the water collection part.

The above description is merely illustrative of specific embodiments of the present disclosure, and it will be apparent to those skilled in the art that various modifications and variations can be made in the present disclosure without departing from the spirit or scope of the present disclosure as defined by the appended claims.

What is claimed is:

1. A laundry treating apparatus comprising:

a cabinet;

a drum rotatably disposed in the cabinet and configured to accommodate laundry;

a base disposed below the drum, the base defining a space configured to at least one of (i) receive air discharged from the drum and guide the air to the drum or (ii) receive moisture condensed from the air;

a driving unit disposed at a rear of the drum and configured to rotate the drum, the driving unit being spaced apart from the base; and a heat exchange unit comprising (i) a heat exchanger disposed at the base and configured to condense the moisture from the air or to heat the air and (ii) a compressor configured to supply a refrigerant to the heat exchanger to thereby enable heat exchange between the refrigerant and the air, wherein the base defines:

a circulation flow path that accommodates the heat exchanger and is configured to guide the air to the drum, a compressor installation space that is spaced apart from the circulation flow path and supports the compressor, and a water collection space that is defined outside the circulation flow path and configured to collect water condensed from the air by the heat exchanger, and wherein the laundry treating apparatus further comprises a pump disposed at the water collection space and configured to discharge the collected water from the water collection space, the pump being located forward relative to the compressor installation space.

2. The laundry treating apparatus according to claim 1, wherein the compressor is disposed rearward relative to the water collection space, and wherein the compressor installation space is defined rearward relative to the water collection space.

3. The laundry treating apparatus according to claim 1, further comprising:

a controller configured to control the driving unit or the compressor, the controller being disposed at the base and facing the cabinet, wherein the pump is disposed between the controller and the circulation flow path.

4. The laundry treating apparatus according to claim 3, wherein a first side of the water collection space faces the circulation flow path, and a second side of the water collection space faces the controller.

5. The laundry treating apparatus according to claim 3, wherein the water collection space is defined forward relative to the compressor installation space.

6. The laundry treating apparatus according to claim 1, wherein the pump overlaps with at least a portion of the heat exchanger along a left-right direction.

7. The laundry treating apparatus according to claim 6, wherein the heat exchanger comprises:

an evaporator disposed in the circulation flow path and configured to cool the air discharged from the drum; and a condenser disposed rearward relative to the evaporator and configured to heat the air cooled by the evaporator, and wherein the pump overlaps with at least a portion of the evaporator along the left-right direction.

8. The laundry treating apparatus according to claim 7, wherein the pump is disposed forward relative to the condenser.

9. The laundry treating apparatus according to claim 1, wherein the heat exchanger comprises:

an evaporator disposed in the circulation flow path and configured to cool the air discharged from the drum; and a condenser disposed rearward relative to the evaporator and configured to heat the air cooled by the evaporator, and wherein the water collection space and the condenser are disposed along a left-right direction such that the water collection space overlaps with at least a portion of the condenser along the left-right direction.

10. The laundry treating apparatus according to claim 9, wherein the water collection space is defined rearward relative to the evaporator.

11. The laundry treating apparatus according to claim 1, wherein the circulation flow path comprises:

an inflow duct configured to fluidly communicate with the drum to thereby receive the air discharged from the drum;

a transfer duct that extends from the inflow duct and accommodates the heat exchanger, the transfer duct being configured to guide the air from the inflow duct; and a discharge duct that extends from the transfer duct and configured to fluidly communicate with the drum to thereby discharge the air from the transfer duct to the drum, and wherein the water collection space is defined between the inflow duct and the compressor installation space.

12. The laundry treating apparatus according to claim 11, wherein the water collection space is defined rearward relative to the inflow duct, and wherein a width of the inflow duct in a left-right direction is greater than a width of the transfer duct in the left-right direction.

13. The laundry treating apparatus according to claim 12, wherein a portion of the inflow duct protrudes from the transfer duct in the left-right direction, and wherein the water collection space is defined rearward relative to the portion of the inflow duct.

14. The laundry treating apparatus according to claim 1, wherein the pump is disposed forward relative to the driving unit.

15. The laundry treating apparatus according to claim 1, wherein the cabinet defines an opening at a front portion thereof, and wherein the pump is disposed between the opening of the cabinet and the compressor installation space.

16. The laundry treating apparatus according to claim 1, wherein the water collection space and the compressor installation space are defined forward relative to the driving unit.

17. The laundry treating apparatus according to claim 16, wherein the water collection space is defined forward relative to the compressor installation space.

18. The laundry treating apparatus according to claim 16, wherein the water collection space is offset from the compressor installation space in a forward-rearward direction.

19. The laundry treating apparatus according to claim 1, wherein the heat exchanger comprises:

an evaporator disposed in the circulation flow path and configured to cool the air discharged from the drum; and a condenser disposed rearward relative to the evaporator and configured to heat the air cooled by the evaporator, and wherein the water collection space is located closer to the evaporator than to the condenser.

* * * * *